US008387427B2

(12) United States Patent
Matsui et al.

(10) Patent No.: US 8,387,427 B2
(45) Date of Patent: Mar. 5, 2013

(54) WATER JET PEENING METHOD AND APPARATUS THEREOF

(75) Inventors: Yuji Matsui, Hitachinaka (JP); Masahiro Tooma, Hitachiota (JP); Atsushi Baba, Tokai (JP); Kouichi Kurosawa, Hitachi (JP); Fujio Yoshikubo, Mito (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 433 days.

(21) Appl. No.: 12/830,169

(22) Filed: Jul. 2, 2010

(65) Prior Publication Data

US 2011/0005288 A1 Jan. 13, 2011

(30) Foreign Application Priority Data

Jul. 8, 2009 (JP) ..... 2009-161282
Jul. 22, 2009 (JP) ..... 2009-171264

(51) Int. Cl.
*B21D 7/06* (2006.01)

(52) U.S. Cl. ..... 72/53

(58) Field of Classification Search ..... 72/53; 29/90.7; 451/38–40
See application file for complete search history.

(56) References Cited

U.S. PATENT DOCUMENTS

| | | | | |
|---|---|---|---|---|
| 6,058,153 | A | 5/2000 | Kurosawa et al. | |
| 6,240,155 | B1 | 5/2001 | Kurosawa et al. | |
| 7,716,961 | B2 * | 5/2010 | Hatou et al. | 72/53 |
| 2009/0056399 | A1 * | 3/2009 | Hatou et al. | 72/53 |

FOREIGN PATENT DOCUMENTS

| | | | |
|---|---|---|---|
| JP | 5-78738 | A | 3/1993 |
| JP | 2841963 | B2 | 3/1993 |
| JP | 6-47668 | A | 2/1994 |
| JP | 8-71919 | A | 3/1996 |
| JP | 10-293191 | A | 11/1998 |
| JP | 3530005 | B2 | 11/1998 |

* cited by examiner

*Primary Examiner* — Faye Francis
(74) *Attorney, Agent, or Firm* — Crowell & Moring LLP

(57) ABSTRACT

A high-pressure water jet is injected from a nozzle scanned and a shock wave generated due to the collapse of bubbles included in the water jet is impacted on a WJP execution object. Tensile residual stress close to the surface of the WJP execution object is improved to compressive residual stress. The shock wave is detected by a pressure sensor and a shock wave generation frequency is obtained. Whether the obtained shock wave generation frequency is larger than a set value or not is decided. When the shock wave generation frequency is larger than the set value, a high-pressure pump is stopped and the injection of the water jet from the nozzle is stopped. When the shock wave generation frequency is equal to or smaller than the set value, the operation condition of the high-pressure pump is changed. The pressure of the water jet injected from the nozzle is increased and the WJP is executed for a part of the WJP execution object where the shock wave generation frequency is equal to or smaller than the set value. Improvement effect of the residual stress of the WJP execution object can be confirmed more accurately.

35 Claims, 33 Drawing Sheets

WATER JET PEENING METHOD AND APPARATUS THEREOF

CLAIM OF PRIORITY

The present application claims priority from Japanese Patent application serial no. 2009-161282, filed on Jul. 8, 2009 and Japanese Patent application serial no. 2009-171264, filed on Jul. 22, 2009, the content of which is hereby incorporated by reference into this application.

BACKGROUND OF THE INVENTION

1. Technical Field

The present invention relates to a water jet peening method and an apparatus thereof, and more particularly, to a water jet peening method and an apparatus thereof suitable for improving tensile residual stress of a structure in a nuclear reactor to compressive residual stress by water jet peening.

2. Background Art

When there exists residual stress in close to a surface of a welding portion and a heat-affected zone of a structural member composing a nuclear reactor, a process of executing water jet peening (hereinafter, referred to as WJP) for the welding portion and heat-affected zone thereof to improve tensile residual stress existing in the close to the surface of the structural member to compressive residual stress is performed. In a state that the structural member the stress of which is to be improved is immersed in water, the WJP is executed by injecting a high-pressure water jet from a nozzle in the water. A shock wave is generated due to collapse of bubbles included in the injected water jet. The shock wave impacts on the surface of the structural member in the water, thus the tensile residual stress in the close to the surface of the structural member is improved to compressive residual stress. Therefore, the generation of stress corrosion cracking (SCC) in the structural member is suppressed. The stress improvement method by the WJP is described, for example, in Japanese Patent 2841963, Japanese Patent 3530005, Japanese Patent Laid-Open No. 8 (1996)-71919, and Japanese Patent Laid-Open No. 6 (1994)-47668.

In the execution of the WJP for the structural member, a method for confirming execution condition of the WJP is proposed in Japanese Patent Laid-Open No. 8 (1996)-71919 and Japanese Patent Laid-Open No. 6 (1994)-47668.

In Japanese Patent Laid-Open No. 8 (1996)-71919, the WJP is executed for a pipe which is attached to bottom of a reactor pressure vessel and passes through the bottom. The WJP is executed for the place of the pipe existing in the reactor pressure vessel. A high-pressure water jet is injected from the nozzle existing in the water in the close to the WJP execution object of the pipe and the shock wave generated due to collapse of bubbles included in the water jet impacts on the surface of the pipe in the reactor pressure vessel. An AE (acoustic emission) sensor attached to an outer surface of the pipe outside the reactor pressure vessel detects an acoustic signal generated at the time of impact of the shock wave with the place of the pipe in the reactor pressure vessel during execution of the WJP and outputs an AE signal (acoustic power). Whether the residual stress is sufficiently improved for the pipe objected for the WJP or not is confirmed based on the AE signal. When the residual stress is not improved sufficiently, the injection condition (injection s pressure) of the water jet to be injected is controlled and the nozzle position is adjusted.

Japanese Patent Laid-Open No. 6 (1994)-47668 describes that at the time of execution of the WJP, a piezo-electric ceramics (PZT) sensor is attached to a nozzle in the proximity of a jet outlet of the nozzle for injecting a high-pressure and high-speed water jet. When the high-pressure water jet is injected from the nozzle, the PZT sensor detects a shock pulse (a cavitation generation event) generated in the nozzle. The frequency distribution of a signal output from the PZT sensor is analyzed based on the detected shock pulse by a frequency analyzer. A decision apparatus inputting analytical results of frequency distribution outputs a control signal based on comparison results of peak frequency and amplitude thereof obtained from the frequency distribution with their set values. The distance between the nozzle and a surface of a WJP execution object is adjusted based on the excellence peak frequency and the discharge pressure of the pump for supplying water to the nozzle is adjusted based on the peak frequency.

PRIOR ART LITERATURES

Patent Literatures

Patent Literature 1: Japanese Patent 2841963

Patent Literature 2: Japanese Patent 3530005

Patent Literature 3: Japanese Patent Laid-Open No. 8 (1996)-71919

Patent Literature 4: Japanese Patent Laid-Open No. 6 (1994)-47668

SUMMARY OF THE INVENTION

Problem for Solving by the Invention

In the WJP described in Japanese Patent Laid-Open No. 8 (1996)-71919, the acoustic signal (an elastic wave) generated at the time of impact of the shock wave with the place of the pipe in the reactor pressure vessel is detected by the AE sensor attached to the outer surface of the pipe outside the reactor pressure vessel during execution of the WJP. However, the AE sensor detects not only the elastic wave generated in the pipe due to the shock wave generated by collapse of bubbles included in the water jet injected from the nozzle but also an elastic wave generated in the pipe by shock force when the injected water jet directly impacts on the pipe. On the other hand, to the improvement of the tensile residual stress existing in the close to the pipe surface to compressive residual stress, the shock wave generated due to collapse of bubbles contributes greatly. Therefore, the elastic wave generated due to the shock force when the injected water jet directly impacts on the pipe lowers the reliability to the decision result for whether the improvement of the residual stress of the pipe by the WJP is sufficient or not. Further, when there exist a plurality of pipes and these pipes are sequentially subjected to the WJP the pipe on which the AE sensor is to be installed must be changed in accordance with the pipe to be subjected to the WJP. Namely, labor and time for removing the AE sensor from the pipe finishing the execution of WJP and then attaching the AE sensor to the pipe to be subjected to the WJP are required.

In the WJP described in Japanese Patent Laid-Open No. 6 (1994)-47668, the PZT sensor is attached to the nozzle used for execution of the WJP, so that problems caused in the WJP described in Japanese Patent Laid-Open No. 8 (1996)-71919 are dissolved. However, in the WJP described in Japanese Patent Laid-Open No. 6 (1994)-47668, a new problem described below arises because the PZT sensor is attached to the nozzle. The PZT sensor is mounted to the nozzle, so that the PZT sensor detects a shock pulse based on fluid vibration of high-pressure water including bubbles passing through a narrow jet outlet. That is, in the WJP described in Japanese Patent Laid-Open No. 6 (1994)-47668, the detected shock pulse is strongly influenced by the number of bubbles included in the high-pressure water jet passing through the jet outlet.

As described later, when injecting a high-pressure water jet from the nozzle toward the surface of the WJP execution object, since the high-pressure water jet including many bubbles passes through the narrow jet outlet formed in the nozzle, a large fluid noise (an elastic wave) is generated even if no bubbles are collapsed. The PZT sensor mounted to the nozzle detects also the fluid noise. However, all the bubbles included in the high-pressure water jet passing through the jet outlet are not always collapsed after the water jet is injected from the nozzle. In Japanese Patent Laid-Open No. 6 (1994)-47668, the PZT sensor also detects fluid noise generated by the nozzle by non-collapsed bubbles (bubbles generating no shock wave). Therefore, even by Japanese Patent Laid-Open No. 6 (1994)-47668, the improvement effect of the residual stress of WJP execution object cannot be confirmed accurately.

An object of the present invention is to provide a water jet peening method and an apparatus thereof capable of confirming more accurately the improvement effect of the residual stress of an water jet peening execution object and an apparatus thereof.

Means for Solving the Problems

A feature of the present invention for accomplishing the above object is to apply a shock wave generated due to collapse of bubbles included in a water jet injected into water from a nozzle to an water jet peening execution object, detect the shock wave generated in the water by a shock wave detection apparatus disposed in the water, and obtain an generation frequency of the detected shock wave.

Since the shock wave generated at the time of execution of the water jet peening is detected by the shock wave detection apparatus and the generation frequency of the shock wave is obtained, the improvement effect of the residual stress of the WJP execution object can be confirmed more accurately based on the generation frequency of the shock wave directly contributing to improvement of the residual stress of the WJP execution object.

Shock wave generated due to collapse of bubbles included in water injected from a nozzle into the water is detected by a plurality of shock wave detection apparatuses disposed in the water, and generation position of the shock wave is obtained based on a difference in the detection time of the shock wave between a certain shock wave detection apparatus and another shock wave detection apparatus, and generation frequency of the shock wave for each of a plurality of sections set in a direction separating from a surface of a water jet peening execution object is obtained based on the generation position of the shock wave, thus the aforementioned object of the present invention can be accomplished.

The generation frequency of the shock wave is obtained for each of the plurality of sections set in the direction separating from the surface of the water jet peening execution object, so that in the direction separating from the surface of the water jet peening execution object, it can be confirmed that in which section the generation frequency of the shock wave is high. Consequently, the shock wave contributing to the improvement of the residual stress of the water jet peening execution object can be confirmed and the improvement effect of the residual stress of the WJP execution object can be confirmed more accurately.

The aforementioned object can also be accomplished by detecting a plurality of shock waves generated due to collapse of bubbles included in water injected from a nozzle into the water by a plurality of shock wave detection apparatuses disposed in the water, obtaining the generation positions of shock waves based on a difference in the shock wave detection time between a certain shock wave detection apparatus and another shock wave detection apparatus, obtaining energy of the plurality of generated shock waves based on detection signals of the shock waves detected by the plurality of shock wave detection apparatuses, and obtaining energy received by the water jet peening execution object from the plurality of shock waves based on the obtained energy of the plurality of shock waves and the plurality of generation positions of the shock waves.

Advantageous Effect of the Invention

According to the present invention, the improvement effect of the residual stress of the water jet peening execution object can be confirmed more accurately.

DETAILED DESCRIPTION OF THE PREFERRED EMBODIMENTS

Residual stress of a structural member structure due to WJP is not improved by shock force when high-pressure water jet injected from a nozzle directly impacts on a surface of the structural member but, substantially, is improved by collision impact of shock wave generated due to collapse of bubbles included in the injected water jet with the structural member.

The residual stress improvement of the structural member by the shock wave generated due to collapse of bubbles included in the high-pressure water jet injected from the nozzle will be explained below in more detail. The high-pressure water jet injected from the nozzle arranged in the water includes many bubbles. Bubbles are not only included in the high-pressure water jet injected from the nozzle but also are generated in the water jet injected into the water from the nozzle. When the high-pressure water jet is injected from the nozzle disposed in the water, many eddies are generated by shearing force generated on the boundary between the stationary water existing around the nozzle and the water jet injected from the nozzle and local pressure fluctuation are caused close around the eddies. At this time, bubbles are generated in the region decompressed locally to a negative pressure.

Bubbles included in the high-pressure water jet at the time of injection from the nozzle and bubbles generated in the water jet after injection grow at the negative pressure and compress at positive pressure. When the positive pressure increases more, the generated bubbles are collapsed. When the bubbles are collapsed, a very large shock wave is emitted. The processes of such generation, growth, compression, and crushing of bubbles are called cavitation. If cavitation is generated, a large shock wave is emitted, and this shock wave impacts on the structural member, thereby improving the tensile residual stress of the structural member close to the surface to compressive residual stress.

Figure 5:
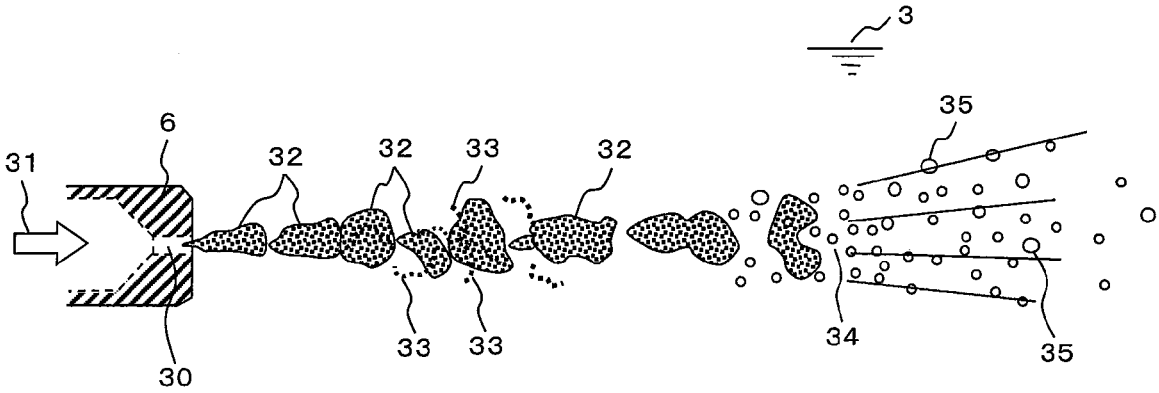
FIG. 5 is an explanatory drawing schematically showing condition of bubbles in water jet injected from a nozzle.

A state from generation of bubbles in the injected water jet until collapse thereof is shown schematically in FIG. 5. High-pressure water 31 is supplied from a pump (not shown) to a nozzle 6 disposed in water 3. When the high-pressure water 31 is injected from a jet outlet 30 of the nozzle 6 into the water, a cavitation cloud 32 in which many minute bubbles are generated in the water and form a cluster is generated. When one or several bubbles among a plurality of cavitation clouds 32 generated are collapsed, a shock wave is emitted. The shock waves generated due to collapse of bubbles repeatedly impact on the surface of the structural member, thus the residual stress existing close to the surface of the structural member is improved. When one or several bubbles in the injected water jet are collapsed and the shock wave is generated, many bubbles existing around the collapsed bubbles are swept by the shock wave. Therefore, vortex cavitation 33 with swept bubbles stringed is formed. Furthermore, spots in which bubbles are swept, thereby seeming to disappear, are observed. In FIG. 5, numeral 35 indicates large bubbles.

The stress improvement effect of the structural member is made by the shock wave generated due to collapse of bubbles. The inventors found that the stress improvement effect can be confirmed not by the number of bubbles included in the water jet injected from the nozzle and the number of bubbles existing in the water of the injected water jet but by the number of collapsed bubbles (the bubble collapse frequency), that is, generation frequency of the shock wave. The present invention was created based on this knowledge.

When WJP execution conditions such as the pressure and flow rate of the water jet injected from the nozzle and the distance between the nozzle and the surface of the WJP execution object (stand off) are held at the respective set values, the shock force when the injected water jet directly impacts on the surface of the structural member is almost fixed. However, since the cavitation generation mechanism in the water jet injected from the nozzle is complicated, the shock wave is not generated always at the expected frequency. Therefore, the generation frequency of the shock wave is monitored, thus during execution of the WJP, the stress improvement effect of the structural member can be confirmed.

Further, the inventors found that the stress improvement effect can be confirmed not by the number of bubbles included in the water jet injected from the nozzle and the number of bubbles existing in the water of the injected water jet but by the number of collapsed bubbles (the bubble collapse frequency) per unit time, that is, the number of shock wave generations (the generation frequency of the shock wave) per unit time. The inventors found particularly that the number of shock wave generations per unit time for each position from the surface of the structural member (distance) is obtained, thus the improvement degree of the residual stress close to the surface of the structural member can be confirmed accurately. The other feature of the present invention is created based the knowledge.

The concept of the other feature of the present invention created based on the knowledge is explained below by referring to one concrete example shown in FIG. 18. A nozzle 106 and a support member 117 are attached to a movement apparatus 119 and two AE sensors (shock wave detection apparatuses) 116A and 116B are mounted at intervals in the axial direction of the nozzle 106 (refer to (A) shown in FIG. 18). The nozzle 116 and AE sensors 116A and 116B are disposed in the water and a structural member 102 that is a WJP execution object is also disposed in the water. The nozzle 106 is opposite to the surface of the structural member 102 in which the WJP is executed. The AE sensor 116A is disposed close to the surface of the structural member 102 and the AE sensor 116B is disposed at the position slightly separated from the surface of the structural member 102 compared with an end of the nozzle 106. Shock wave conversion plates 133A and 133B are mounted to the support member 117 and are mounted in contact with the fronts of the AE sensors 116A and 116B. As a shock wave detection apparatus, in addition to the AE sensor, a pressure sensor, an acceleration sensor, and an underwater microphone may be used.

When a bubble 135 included in a high-pressure water jet 134 injected from the nozzle 106 is collapsed, a shock wave 136 is generated. The shock wave 136 passes through a propagation path 143A, is converted to an acoustic wave in the shock wave conversion plate 133A, and is transferred to the AE sensor 116A. Further, the shock wave 136 passes through a propagation path 143B, is converted to an acoustic wave in the shock wave conversion plate 133B, and is transferred to the AE sensor 116B. In this way, the AE sensors 116A and 116B respectively detect the shock wave and output a shock wave detection signal.

Figure 18:
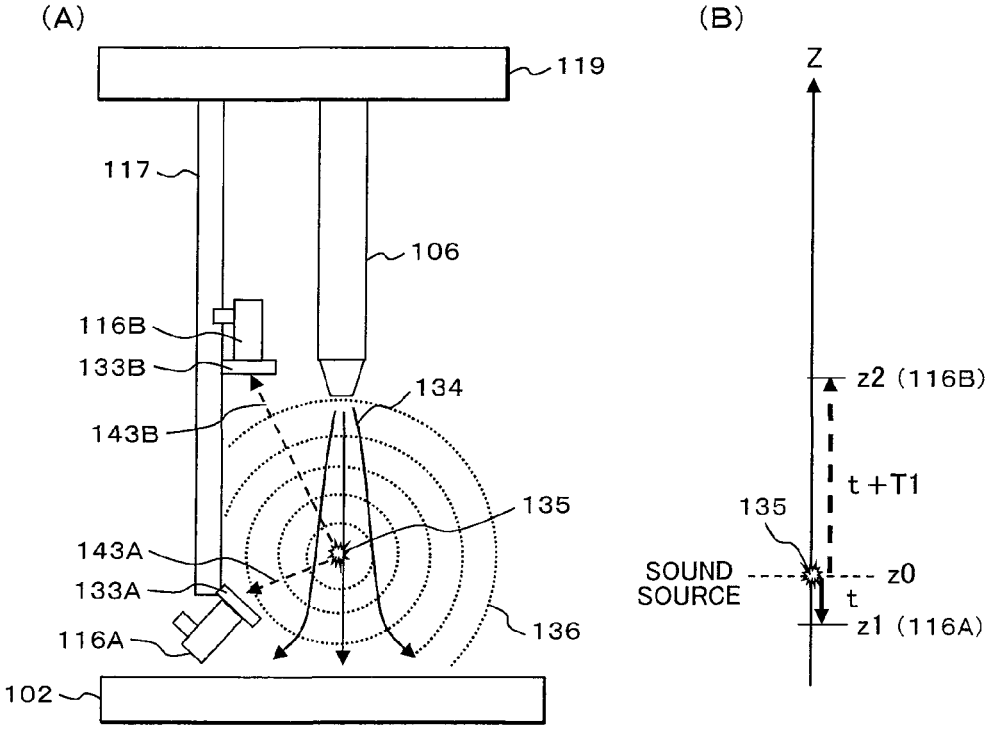
FIG. 18 is an explanatory drawing showing detection concept of a shock wave using two AE sensors, and (A) is an explanatory drawing showing an arrangement example of the two AE sensors for detecting the shock wave, and (B) is an explanatory drawing showing a one-dimensional approximate model of propagation path of the shock wave when the two AE sensors are arranged.

It is assumed that the propagation speed of the shock wave 136 in the water is V (m/s), a coordinate value of the sensor (for example, the AE sensor 116A) existing in a position close to a position of a sound source (the position where the bubble 135 is collapsed, that is, an generation position of the shock wave 136) in a Z direction is z1 (m) (refer to (B) shown in FIG. 18), a coordinate value of the sensor (for example, the AE sensor 116B) existing in a position far from the position of the sound source in the Z direction is z2 (m), the propagation time of the shock wave to the AE sensor existing in the close position is t (s), and a time difference between the detection time of the shock wave of the AE sensor existing in the far position and the detection time of the shock wave of the AE sensor existing in the close position is T1 (s). The one-dimensional approximate model of the shock wave propagation path in the Z direction (an axial direction of the nozzle 106) can be expressed as shown in (B) shown in FIG. 18 and the propagation time of the shock wave from the sound source to the shock wave detection apparatuses, for example, the AE sensors 116A and 116B is expressed by formulas (1) and (2).

$$V\times t=(z0-z1) \quad (1)$$

$$V\times(t+T1)=(z2-z0) \quad (2)$$

t (s) cannot be measured practically and the measurable time is the time difference T1 (s). When the propagation speed V (m/s) of the shock wave in the water is known (for example, the underwater sonic speed is 1500 (m/s)), the coordinate value z0 (m) of the sound source in the Z direction (the position of the sound source in the Z direction) is the generation position of the shock wave and can be calculated from formula (3).

$$z0=(z1+z2)/2-V\times T1/2 \quad (3)$$

Figure 19:
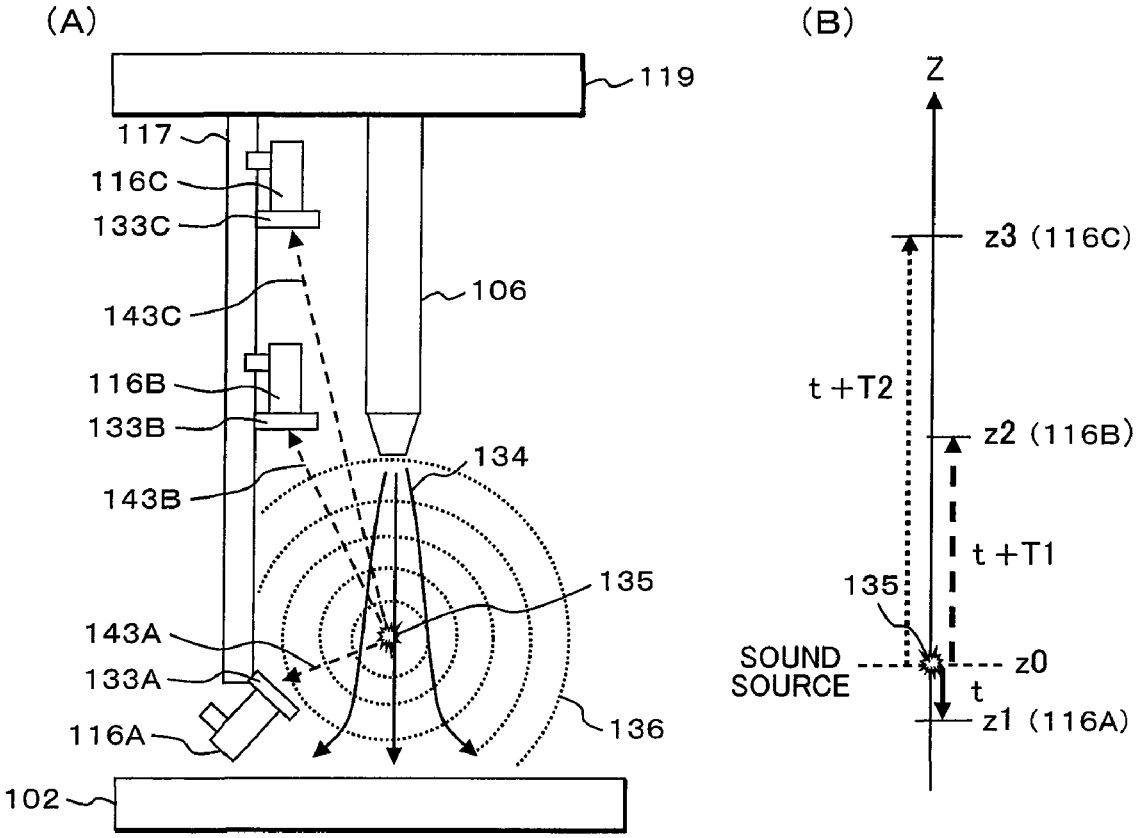
FIG. 19 is an explanatory drawing showing detection concept of a shock wave using three AE sensors, and (A) is an explanatory drawing showing an arrangement example of the three AE sensors for detecting the shock wave, and (B) is an explanatory drawing showing a one-dimensional approximate model of propagation path of the shock wave when the three AE sensors are arranged.

When the propagation speed V (m/s) of the shock wave in the water (underwater sonic speed) is unknown, three shock wave detection apparatuses, for example, the AE sensors 116A, 116B, and 116C are mounted, thus the generation position of the shock wave can be identified. The identification of the generation position of the shock wave in this case is explained by referring to FIG. 19. The AE sensor 116C is mounted to the support member 117. A shock wave conversion plate 133C is mounted to the support member 117 and is attached in contact with the front of the AE sensor 116C (refer to (A) shown in FIG. 19). The AE sensor 116C is disposed in the water and is disposed in a position farther from the surface of the structural member 102 than the AE sensor 116B. The AE sensors 116A, 116B, and 116C are disposed practically on one straight line. The coordinate values z0, z1, and z2 in the Z direction indicate the distance from the surface of the structural member 102 in the vertical direction to the surface.

The shock wave 136 generated due to collapse of the bubble 135 is detected by the AE sensor 116C via the propagation path 143C and shock wave conversion plate 133C. The coordinate value of the sensor (for example, the AE sensor 116A) for detecting the shock wave firstly in the Z direction is assumed as z1, the coordinate value of the sensor (for example, the AE sensor 116B) for detecting the shock wave secondarily in the Z direction as z2, and the coordinate value of the sensor (for example, the AE sensor 116C) for detecting the shock wave thirdly in the Z direction as z3 (refer to (B) shown in FIG. 19). The coordinate value z3 in the Z direction also indicates the distance from the surface in the direction perpendicular to the surface of the structural member 102. The sonic speed of the shock wave is assumed as Vz (m/s), the time when the shock wave generated from the sound source is detected by the closest sensor as t (s), the time difference between the detection time of the shock wave by the sensor secondarily close to the position of the sound source and the detection time of the shock wave by the sensor closest to the position of the sound source as T1 (s), and a time difference between the detection time of the shock wave by the sensor farthest from the position of the sound source and the detection time of the shock wave by the sensor closest to the position of the sound source as T2 (s). The one-dimensional approximate model of the shock wave propagation path at this time can be expressed as shown in (B) shown in FIG. 19 and the propagation time of the shock wave from the sound source to the respective shock wave detection apparatuses, that is, the AE sensors 116A, 116B, and 116C is expressed by formulas (4), (5), and (6).

$$Vz\times t=(z0-z1) \quad (4)$$

$$Vz\times(t+T1)=(z2-z0) \quad (5)$$

$$Vz\times(t+T2)=(z3-z0) \quad (6)$$

t (s) cannot be measured practically and the measurable time is the time differences T1 (s) and T2 (s). The sound source position z0 (m) and the propagation speed Vz [m/s] of the shock wave projected in the Z direction can be calculated based on formulas (7) and (8).

$$z0=\{z1+z2-T1\times(z3-z2)/(T2-T1)\}/2 \quad (7)$$

$$Vz=(z3=z2)/(T2-T1) \quad (8)$$

In this way, the position of the sound source from the surface of the structural member which is a WJP execution object, that is, the generation position of the shock wave is obtained, thus the shock wave generation number (the generation frequency of the shock wave) per unit time at each position in the perpendicular direction to the surface of the structural member 102 which is a WJP execution object can be obtained. For example, in the perpendicular direction to the surface of the structural member 102, the interval from the surface to the end of the nozzle 106 is divided into a plurality of sections with a predetermined width and the generation frequency of the shock wave is obtained in each of the sections.

Figure 20:
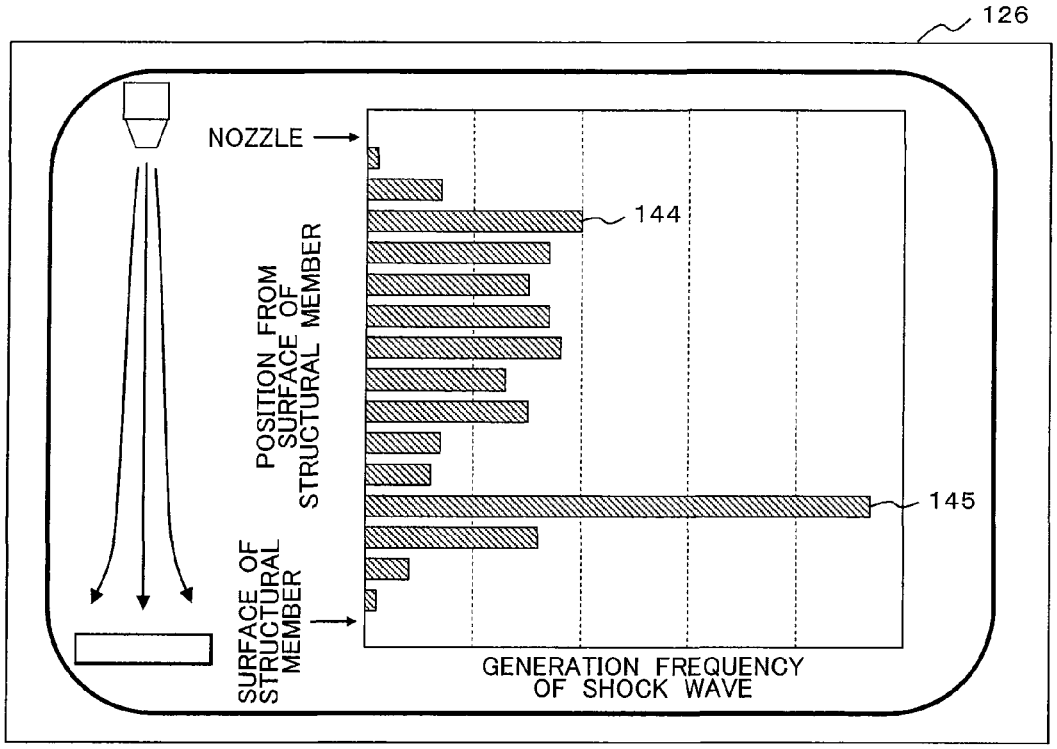
FIG. 20 is an explanatory drawing showing an example of display information showing generation frequency of shock wave generated for each position from a surface of a structural member in a state that stress improvement effect of the structural member is obtained.
Figure 21:
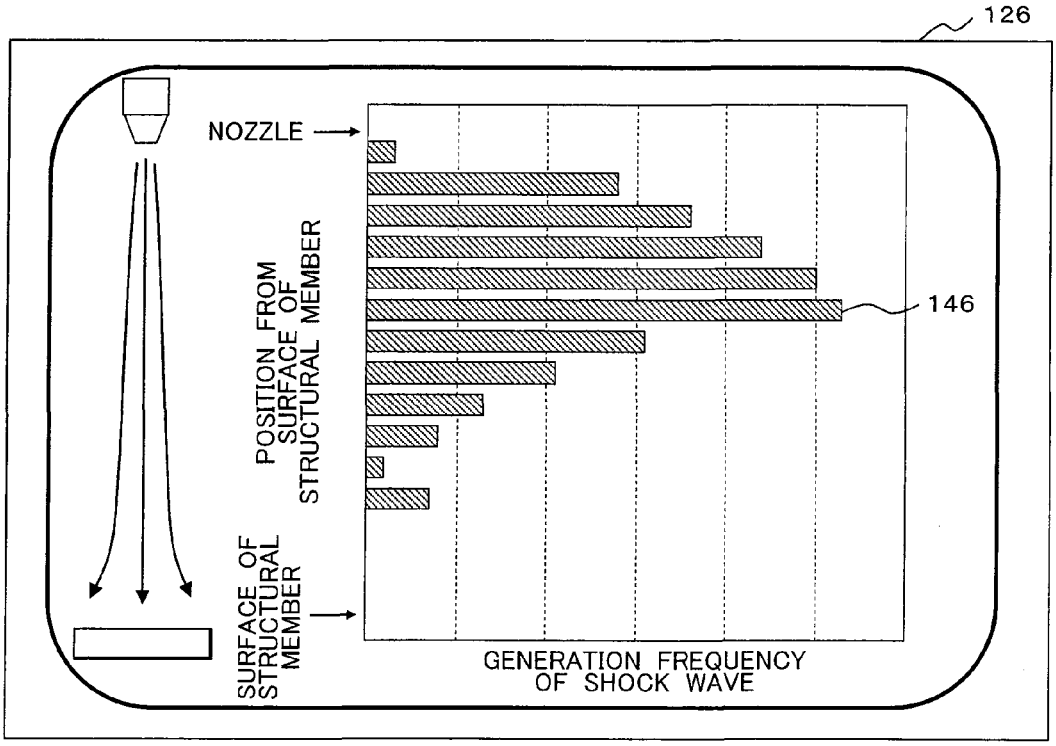
FIG. 21 is an explanatory drawing showing an example of the display information showing generation frequency of shock wave at each position from a surface of a structural member in a state that stress improvement effect of the structural member is insufficient.

In both FIGS. 20 and 21, a relation between the position from the surface and the generation frequency of the shock wave in the perpendicular direction to the surface of the structural member 102 is arranged properly based on the obtained generation position of the shock wave and distribution of generation frequency of the shock wave between the surface and the end of the nozzle 106 in the perpendicular direction to the surface of the structural member 102 is shown. In FIGS. 20 and 21, in the perpendicular direction to the surface of the structural member 102, the interval between the surface of the structural member 102 and the nozzle 106 is divided into 15 positions (sections).

In the distribution example of the shock wave generation frequency shown in FIG. 20, two peaks of an generation frequency peak 144 at the position close to the nozzle 106 and an generation frequency peak 145 at the position close to the surface of the structural member 102 are observed. The position where the generation frequency peak 145 is generated is close to the surface of the structural member 102 and at the generation frequency peak 145, the generation frequency of the shock wave is high. Therefore, in the distribution example of the shock wave generation frequency, the shock wave 136 generated due to collapse of the bubble 135 included in the injected water jet 134 impacts efficiently on the surface of the structural member 102, so that the residual stress existing close to the surface of the structural member 102 is improved sufficiently.

In the distribution example of the shock wave generation frequency shown in FIG. 21, a generation frequency peak 146 at the position close to the nozzle 106 is observed, however, at the position close to the surface of the structural member 102, no generation frequency peak is observed. In the distribution example of the shock wave generation frequency, the position of the generation frequency peak 146 is excessively separated from the surface of the structural member 102, so that the energy of each of the generated shock waves is lowered before each shock wave impacts on the surface of the structural member 102 and the improvement effect of the residual stress existing close to the surface of the structural member 102 cannot be expected.

When the distribution of the shock wave generation frequency having a low shock wave generation frequency close to the surface of the structural member 102 as shown in FIG. 21 is obtained, it is necessary to perform at least one of the processes of (a) bringing the nozzle 106 close to the surface of the structural member 102 and shortening the distance between the nozzle 106 and the structural member 102 (referred to as stand off), (b) increasing the pressure of water to be supplied to the nozzle 106 (increasing the pressure of the water jet injected from the nozzle 106), and (c) increasing the flow rate of water to be supplied to the nozzle 106 (increasing the flow rate of the water jet injected from the nozzle 106) and change of the WJP execution conditions. Further, by repeating the change of the stand off, calculation of the shock wave generation position, counting of shock waves generated at each position in the perpendicular direction to the surface of the structural member 102, and display of the distribution of the shock wave generation frequency in the perpendicular direction to the surface of the structural member 102, the optimum value of the stand off when the injection conditions such as the pressure and flow rate of the injected water jet are fixed can be obtained.

The embodiments of the present invention will be explained below.

Embodiment 1

Figure 1:
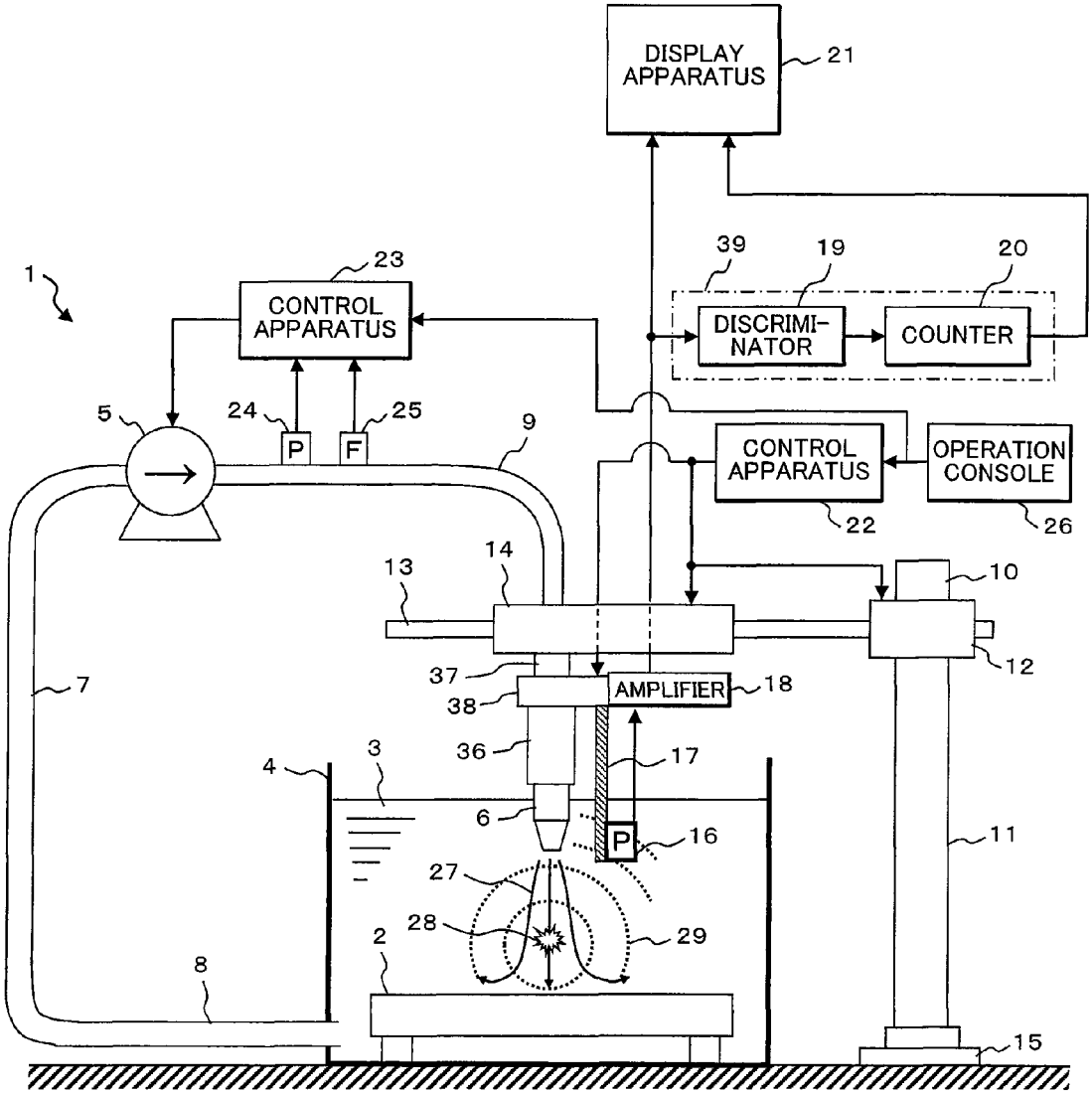
FIG. 1 is a structural diagram showing a water jet peening apparatus used in a water jet peening method according to embodiment 1 which is a preferred one embodiment of the present invention.

The water jet peening method according to embodiment 1 which is a preferred one embodiment of the present invention will be explained by referring to FIGS. 1 and 2.

Before explaining the water jet peening method according to the present embodiment, a water jet peening apparatus (hereinafter, referred to as a WJP apparatus) 1 of the present embodiment used in the present embodiment is explained by referring to FIG. 1. A WJP apparatus 1 is provided with a nozzle 6, a water supply apparatus 7, a nozzle scanning apparatus 10, a pressure sensor (shock wave detection apparatus) 16, a signal processing apparatus 39, and control apparatuses 22 and 23. The signal processing apparatus 39 has a discriminator 19 and a counter (shock wave-counting apparatus) 20. The control apparatus (second control apparatus) 22 is a control apparatus for controlling the scanning of the nozzle scanning apparatus 10 and the control apparatus (first control apparatus) 23 is a control apparatus for controlling a pump 5.

The nozzle scanning apparatus 10 has a support 11, movement apparatuses 12, 14, and 38, a first arm 13, and a second arm 37. The support 11 is attached to a base 15 and is extended vertically. The movement apparatus 12 moving vertically is mounted movably to the support 11. The first arm 13 extending in a X direction in the horizontal direction is mounted to the movement apparatus 12. The movement apparatus 14 moving in the X direction along the first arm 13 is mounted movably to the first arm 13. The second arm 37 extending in a Y direction orthogonal to the X direction in the horizontal direction is mounted on the movement apparatus 14. The movement apparatus 38 is mounted movably to the second arm 37. A support member 36 extending vertically is attached to the movement apparatus 38. The nozzle 6 is attached to an end (lower end) of the support member 36. The base 15 is mounted to the floor to which a water tank (vessel) 4 is mounted.

The water supply apparatus 7 has a high-pressure pump 5, a feed water hose 8, and a high-pressure hose 9. The feed water hose 8 is mounted close to the bottom of the water tank 4 and is connected to the high-pressure pump 5. The high-pressure hose 9 is connected to the high-pressure pump 5 and nozzle 6. The high-pressure hose 5, on the side of the nozzle 6, is attached to the support member 36.

The pressure sensor 16 is installed on the support member 17 attached to the movement apparatus 38. The pressure sensor 16 is connected to an amplifier 18 attached to the movement apparatus 38. The amplifier 18 is connected to the discriminator 19 and a display apparatus 21. The display apparatus 21 is installed on an operation console 26. The counter 20 is connected to the discriminator 19 and display apparatus 21. The control apparatus 22 is connected to the movement apparatuses 12, 14, and 38 and the operation console 26 is connected to the control apparatuses 22 and 23. The control apparatus 23 is connected to the pump 5 and a pressure gauge 24 and a flow meter 25, which are mounted to the high-pressure hose 9, are connected to the control apparatus 23.

The water jet peening method according to the present embodiment using the WJP apparatus 1 is explained below. In the water jet peening method according to the present embodiment, the operation or decision at each step shown in FIG. 2 is executed.

The water tank 4 is filled with the water 3 and a structural member 2 that is a WJP execution object is disposed in the water 3 in the water tank 4. The structural member 2 is a structural member composing a plant, for example, a nuclear plant to be built. The structural member 2 may be a structural member removed from a nuclear plant having experience in operation while the nuclear plant is stopped. In FIG. 1, the structural member 2 is shown in a shape simplified schematically.

The nozzle is moved to a WJP start position (step S1). An operator inputs position information of WJP start, that is, the position information of the jet outlet of the nozzle 6 to the operation console 26. The position information of the nozzle 6 is indicated by each coordinate value in an X direction, Y direction, and Z direction (vertical direction). The control apparatus 22 inputs the position information and drives the movement apparatuses 12, 14, and 38 based on the input position information. The end of the nozzle 6 is positioned to the coordinate value in the Z direction which is input by the movement of the movement apparatus 12, the coordinate value in the X direction which is input by the movement of the movement apparatus 14, and the coordinate value in the Y direction which is input by the movement of the movement apparatus 38. The distance between the nozzle 6 and the structural member 2, that is, the stand off is held at a set distance by the coordinate value in the Z direction. The pressure sensor 16 is disposed in the water 3 on the side of the nozzle 6 from the structural member 2.

After the nozzle 6 is set at the WJP start position, the high-pressure pump is started (step S2). The operator operates the start of the high-pressure pump 5 from the operation console 26, thus a pump start signal is input from the operation console 26 to the control apparatus 23. At this time, the control apparatus 23 starts the high-pressure pump 5. The high-pressure pump 5 is operated under operation condition of an initial value. By the start of the high-pressure pump 5, the water 3 in the water tank 4 is introduced to the high-pressure pump 5 through the feed water hose 8. The control apparatus 23 controls the pressure and flow rate of water discharged from the high-pressure pump 5 based on the measured values of the pressure gauge 24 and flow meter 25. The water 3 is increased in pressure up to the set pressure of the initial value by the high-pressure pump 5 and is supplied to the nozzle 6 at the flow rate of the initial value through the high-pressure hose 9. A high-pressure water jet 27 including a bubble 28 is injected from the nozzle 6 into the water tank 4 by the supply of high-pressure water from the high-pressure pump 5. The bubble 28 in the injected water jet 27 is collapsed in the water 3 and a shock wave 29 is generated. The shock wave 29 impacts on the structural member 2 and is detected by the pressure sensor 16. A shock wave detection signal 40 of the pressure sensor 16 detecting the shock wave 29 is amplified by the amplifier 18 and then is input into the display apparatus 21 and displayed on it (refer to FIGS. 3 and 4). Information of an shock wave generation frequency 42 obtained by the process described later using the shock wave detection signal 40 output from the amplifier 18 is displayed simultaneously on the display apparatus 21, (refer to FIGS. 3 and 4).

Whether the shock wave generation frequency is larger than a first set value of the shock wave generation frequency or not is decided (step S3). The first set value 43 of the shock wave generation frequency indicated by an alternate long and short dash line is displayed on the display apparatus 21. The operator looks at image information displayed on the display apparatus 21, and can thereby easily decide whether a shock wave generation frequency 42 is larger than the first set value 43 or not.

When the shock wave generation frequency 42 is equal to or smaller than the first set value 43, the operation condition of the high-pressure pump is changed (step S4). The operator operates the operation console 26 to change the set value of the operation condition (the discharge pressure the high-pressure pump 5 (or the discharge flow rate of the high-pressure pump 5)). Namely, the set value of the discharge pressure (or the discharge flow rate) is increased. The control apparatus 23 controls the high-pressure pump 5 based on the changed operation condition of the high-pressure pump 5. The water jet 27 is injected at the increased pressure from the high-pressure pump 5. As described later, the shock wave generation frequency 42 is obtained.

When the shock wave generation frequency is decided at the step S3 to be larger than the first set value of the shock wave generation frequency, nozzle scanning is started (step S5). The nozzle 6 is scanned in a set direction. The scanning is performed by inputting the nozzle scanning start position (hereinafter, referred to as scanning start position), the scanning direction (the X direction or Y direction), and the nozzle scanning end position (hereinafter, referred to as scanning end position) to the operation console by the operator. The control apparatus 23 inputs a scanning start signal and information of each of the scanning direction and scanning end position from the operation console 26 and outputs the scanning start signal to the corresponding movement apparatus (the movement apparatus 14 or 38). When the scanning direction input into the operation console 26 by the operator is the X direction, the movement apparatus 14 moves along the first arm 13 and permits the nozzle 6 to move from the scanning start position in the X direction to the scanning end position.

The scanning start signal outputted from the operation console 26 is also inputted into the control apparatus 23. The control apparatus 23 drives the high-pressure pump 5 based on the scanning start signal. Therefore, while the movement apparatus 14 moves and the nozzle 6 moves in the X direction, a high-pressure water jet is injected from the nozzle 6. The shock wave 29 generated due to collapse of the bubble 28 in the injected water jet 27 is impacted sequentially on the surface of the structural member 2 in the scanning direction of the nozzle 6. The nozzle 6 moves along the welding portion and heat-affected zone, extending in the X direction, of the structural member 2 so that by the action of the shock wave 29, the tensile residual stress exiting close to the surface of the welding portion and heat-affected zone is improved to compressive residual stress.

The pressure sensor 16 attached to the movement apparatus 38 also moves in the X direction that is a movement direction of the movement apparatus 14 together with the nozzle 6. The pressure sensor 16 detects the shock wave 29 during moving and outputs shock wave detection signals 40. The shock wave detection signals 40 are amplified by the amplifier 18 and then are inputted into the discriminator 19. The discriminator 19 permit only shock wave detection signals larger than a set value 41 (refer to FIGS. 3 and 4) of the shock wave detection signals 40 among the shock wave detection signals 40 to pass through. The shock wave detection signals 40 outputted from the discriminator 19 is inputted into the counter 20 and is counted by the counter 20. The discriminator 19, when the shock wave detection signals 40 larger than the set value 41 are inputted, automatically decides that the bubbles 28 are collapsed and the shock waves 29 are generated and permits the shock wave detection signals 40 to pass through. The counted value of the shock wave detection signals 40 outputted from the discriminator 19 by the counter 20 is inputted into the display apparatus 21. The counted value per unit time counted by the counter 20 is the shock wave generation frequency 42 and is displayed on the display apparatus 21 (refer to FIGS. 3 and 4).

When the nozzle reaches the scanning end position, the nozzle scanning is stopped (Step S6). When the nozzle 6 reaches the scanning end position in the X direction, the control apparatus 22 outputs a stop signal to the movement apparatus 14. The movement apparatus 14 is stopped by the output of the stop signal and the scanning of the nozzle 6 in the X direction is finished. An encoder (not shown) for detecting the position of the nozzle 6 in the X direction is attached to the movement apparatus 14 and a position signal of the nozzle 6 in the X direction that is outputted from the encoder is inputted into the control apparatus 22. The control apparatus 22 stops the movement of the movement apparatus 14 by the stop signal when the position signal indicates the scanning end position in the X direction.

Whether the shock wave generation frequency is always larger than the first set value during nozzle scanning or not is decided (step S7). The operator looks at the image information displayed on the display apparatus 21, thereby decides whether the shock wave generation frequency 42 is always larger than the first set value 43 (a two-dot chain line) during scanning of the nozzle 6 or not.

Figure 3:
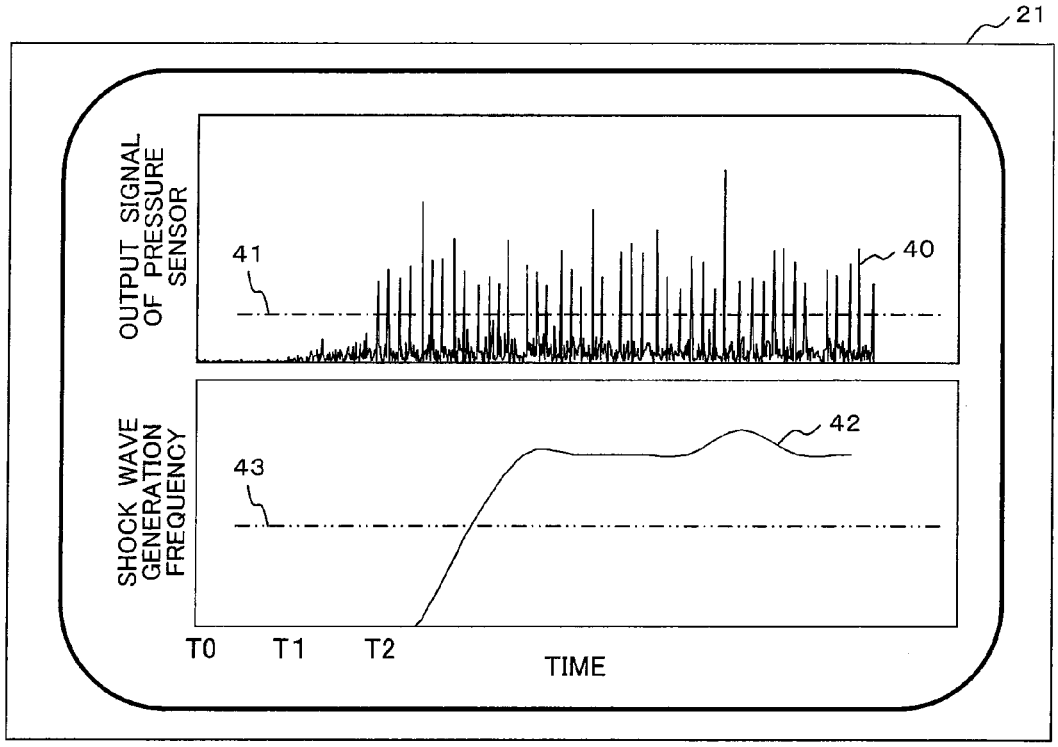
FIG. 3 is an explanatory drawing showing a display example of an output signal of a pressure sensor and generation frequency of shock wave in a state that improvement of residual stress according to embodiment 1 is performed satisfactorily.

When the WJP is executed for the surface of the structural member 2 at the step S5 and the execution of WJP is stopped at the step S6, examples of the shock wave detection signals 40 of the pressure sensor 16 displayed on the display apparatus 21 and the shock wave generation frequency 42 are shown in FIG. 3. The shock wave detection signals 40 are a signal amplified by the amplifier 18. In the display examples shown in FIG. 3, the high-pressure pump 5 is stopped between the time T0 and the time T1 and the high-pressure pump 5 is started between the time T1 and the time T2. After it is confirmed that the shock wave generation frequency 42 is sufficiently larger than the first set value 43, the scanning of the nozzle 6 is started. The shock wave generation frequency 42 shown in FIG. 3 is always larger than the first set value 43 during scanning of the nozzle 6. Therefore, the decision at the step S7 is "Yes" and the high-pressure pump 5 is stopped (step S10). The control apparatus 23 stops the high-pressure pump 5 based on a pump stop instruction inputted from the operation console 26 by the operator. The execution of WJP along one welding portion formed on the structural member 2 is finished.

Figure 4:
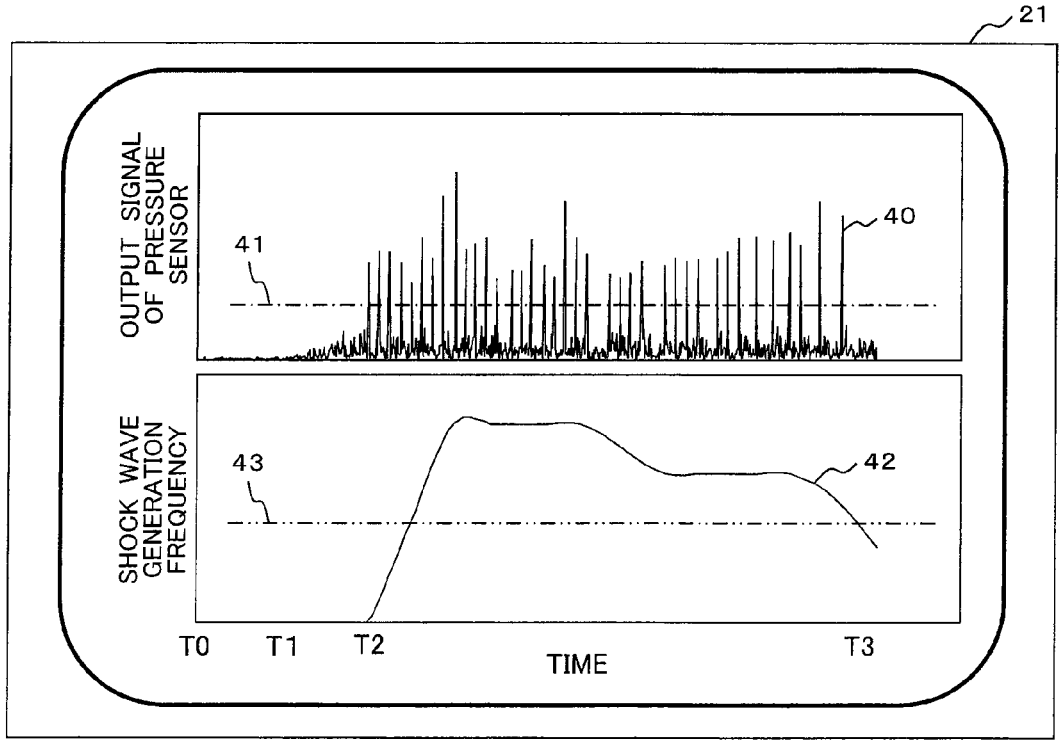
FIG. 4 is an explanatory drawing showing a display example of an output signal of a pressure sensor and generation frequency of shock wave in a state that improvement of residual stress according to embodiment 1 is not sufficient.

After the operations at the steps S8 and S9, the operation of the nozzle 6 at the step S5 is performed, thus the amplified shock wave detection signals 40 of the pressure sensor 16 and the shock wave generation frequency 42, as shown in FIG. 4, are assumed to be displayed on the display apparatus 21. In this display example, during scanning of the nozzle 6, the cavitation power is lowered and after the time T3, the shock wave generation frequency 42 becomes lower than the first set value 43. In this state shown in FIG. 4, the decision at the step S7 is "No".

Hereafter, the operation condition of the high-pressure pump 5 is changed (step S8). The operator operates the operation console 26 to change the operation condition of the high-pressure pump 5 (the set value of the discharge pressure or discharge flow rate of the high-pressure pump 5). And, the nozzle scanning direction is changed to the opposite direction (step S9). The operator operates the operation console 26 to set the scanning end position in a certain direction (for example, the X direction) that is set at the step S5 to the scanning start position and the scanning start position set at Step S5 to the scanning end position.

Thereafter, the scanning at the step S5 is performed. The control apparatus 22 inputs the position information set at the step S9, so that the movement apparatus 14 moves in the opposite direction to the previous one. The nozzle 6 injecting the high-pressure water jet moves from the scanning start position set at the step S9 to the scanning end position. When the nozzle 6 reaches the scanning end position, the scanning of the nozzle 6 is stopped (Step S6). The decision at the step S7 is executed.

After the operations at the steps S8 and S9, the scanning of the nozzle 6 at the step S5 is performed, thus the amplified shock wave detection signals 40 of the pressure sensor 16 and the shock wave generation frequency 42 as shown in FIG. 3 are assumed to be displayed on the display apparatus 21. The shock wave generation frequency 42 shown in FIG. 3 is always larger than the first set value 43 during scanning of the nozzle 6. Therefore, the decision at the step S7 is "Yes" and the high-pressure pump 5 is stopped by the operation at the step S10 as mentioned above (step S10). The execution of WJP along one welding portion formed on the structural member 2 is finished.

When the shock wave generation frequency 42 is lower than the first set value 43, in the welding portion which is the WJP execution object, except the portion part where the shock wave generation frequency 42 is higher than the first set value 43, it is desirable to mainly execute work the WJP for the part where the shock wave generation frequency 42 is lower than the first set value 43. Therefore, at the step S9, it is possible to newly set the scanning start position and scanning end position with emphasis placed on the part where the shock wave generation frequency 42 is lower than the first set value 43 in place of the scanning start position and scanning end position which are set at the step S5 and set re-execution sections of WJP. Both ends of the re-execution sections of WJP include a portion part where the shock wave generation frequency 42 is slightly higher than the first set value 43. By executing again the WJP for the newly set re-execution sections, the shock wave generation frequency 42 in these sections becomes higher than the first set value 43 and the time required for the re-execution of WJP can be shortened.

In the structural member 2, when there exists another welding portion in the X direction and when there exists a welding portion also in the Y direction, at the step S5, the scanning start position and scanning end position are set sequentially and the WJP is executed sequentially for the respective welding portions and het-affected zone. When the execution of the WJP for all the welding portions existing in the structural member 2 is finished, the execution of the WJP for the structural member 2 is finished.

In the present embodiment, while the nozzle 6 injects a high-pressure water jet, and the bubble 28 in the water jet 27 is collapsed, thus the shock wave 29 generated is impacted on the surface of the structural member 2, and the WJP is executed for the structural member 2, the pressure sensor 16 detects the shock wave 29. The shock wave 29 is generated from the collapsed bubbles 28 but not generated from the non-collapsed bubbles 28. Therefore, in the present embodiment, the detection of the shock wave 29 by the pressure sensor 16 results in the detection of the bubble 28 by which the shock wave 29 is generated, that is, the bubble 28 contributing to the execution of WJP. The present embodiment does not detect the non-collapsed bubble 28. The present embodiment counts a detection signal of the shock wave 29 outputted from the pressure sensor 16, thereby obtains the shock wave generation frequency 42. The present embodiment detects the shock wave 29 which is generated when the bubbles are collapsed and contributes to improvement of the residual stress, thereby obtains the shock wave generation frequency 42, so that the improvement effect of the residual stress of a WJP execution object can be confirmed more accurately based on the shock wave generation frequency 42.

In the present embodiment, the pressure sensor 16 is attached to the support member 36 mounted to the movement apparatus 38 instead of the nozzle 6. Therefore, the detection of a shock pulse based on the fluid vibration of high-pressure water including bubbles passing through the jet outlet of the nozzle 6 by the pressure sensor 16 is extremely suppressed. This also contributes to the improvement of confirmation precision of the improvement effect of the residual stress of the WJP execution object.

Particularly, the shock wave generation frequency is displayed on the display apparatus 21, so that the operator can easily confirm the improvement effect of the residual stress of the WJP execution object.

The present embodiment confirms the improvement effect of the residual stress based on the shock wave generation frequency, so that the part where the improvement effect of the residual stress of the WJP execution object is insufficient can be confirmed accurately. Further, when there exists a part where the improvement effect of the residual stress is insufficient, using the WJP apparatus 1, the WJP can be executed again for the part in a shorter period of time.

The present embodiment can accurately confirm the improvement effect of the residual stress of the WJP execution object based on the shock wave generation frequency, so that the evaluation margin for confirming the improvement effect of the residual stress can be reduced. Therefore, in correspondence to the reduction in the margin, the capacity of the high-pressure pump 5 for supplying high-pressure water to the nozzle 6 can be downsized.

When the capacity of the high-pressure pump 5 is not downsized, in correspondence to the reduction in the margin, the moving speed of the nozzle 6 can be increased. Therefore, the WJP execution time can be shortened more.

Embodiment 2

Figure 6:
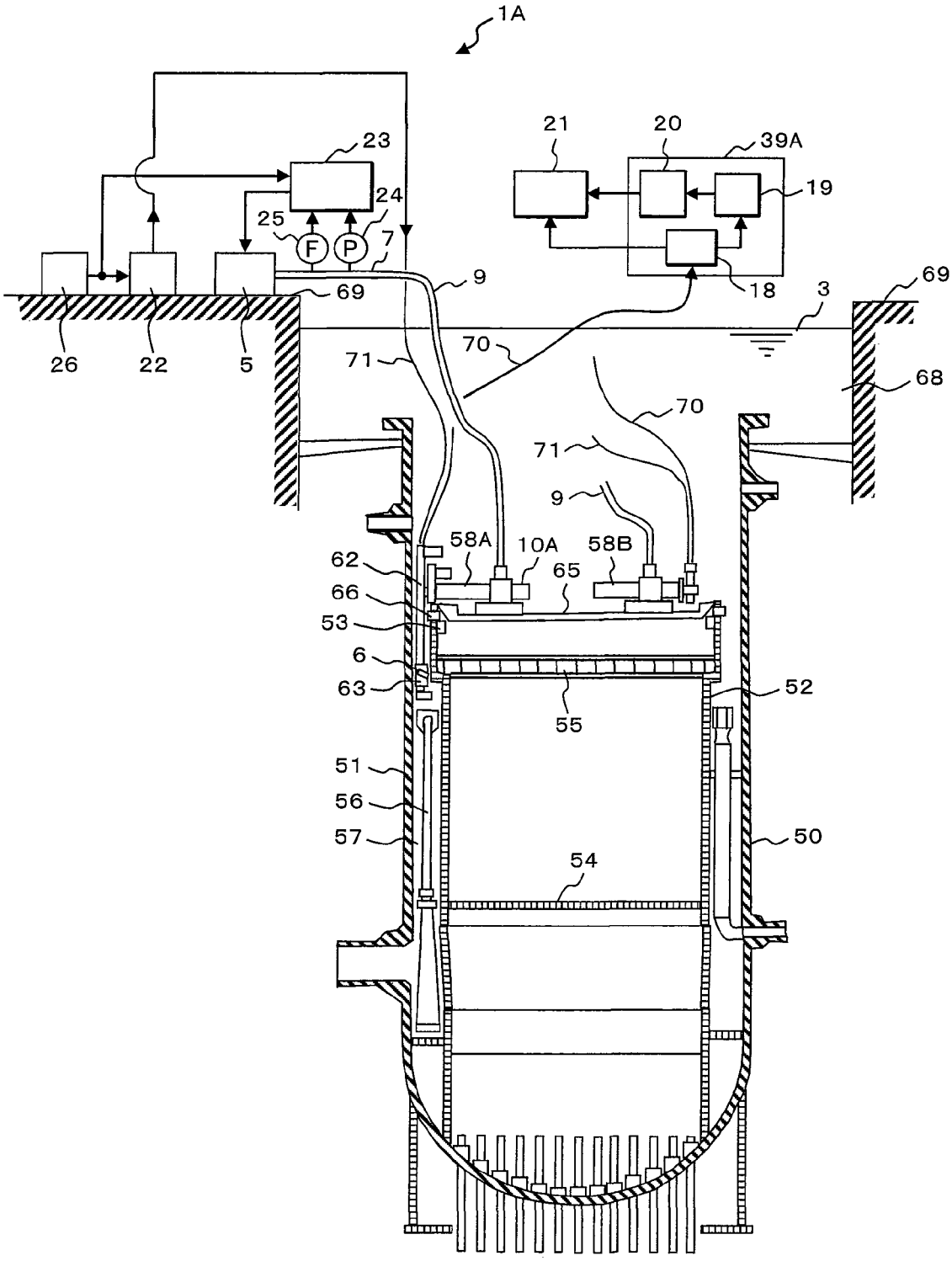
FIG. 6 is a structural diagram showing a water jet peening apparatus used in a water jet peening method according to embodiment 2 which is another embodiment of the present invention.

A water jet peening method according to embodiment 2 which is another embodiment of the present invention is explained by referring to FIG. 6. The water jet peening method according to the present embodiment, for example, is executed for a reactor internal installed in a reactor pressure vessel of a boiling water nuclear plant. The reactor internal is, for example, a core shroud.

The structure of the vicinity of the nuclear reactor of the boiling water nuclear plant is explained by referring to FIG. 6. A nuclear reactor 50 of the boiling water nuclear plant is provided with a reactor pressure vessel 51, a core shroud 52, a core support plate 54, an upper grid plate 55, and jet pumps 56. The core shroud 52, core support plate 54, upper grid plate 55, and jet pumps 56 are installed in the reactor pressure vessel 51. In the core shroud 52 surrounding the core, the core support plate 54 positioned at the lower end of the core is installed and the upper grid plate 55 positioned at the upper end of the core is installed. A plurality of jet pumps 56 are arranged in a circular down corner 57 formed between the reactor pressure vessel 51 and the core shroud 52.

A WJP apparatus 1A used in the water jet peening method according to the present embodiment has a structure that in the WJP apparatus 1 used the nozzle scanning apparatus 10 and signal processing apparatus 39 are replaced with a nozzle scanning apparatus 10A and a signal processing apparatus 39A in the embodiment 1. The other structure of the WJP apparatus 1A is the same as that of the WJP apparatus 1.

Figure 7:
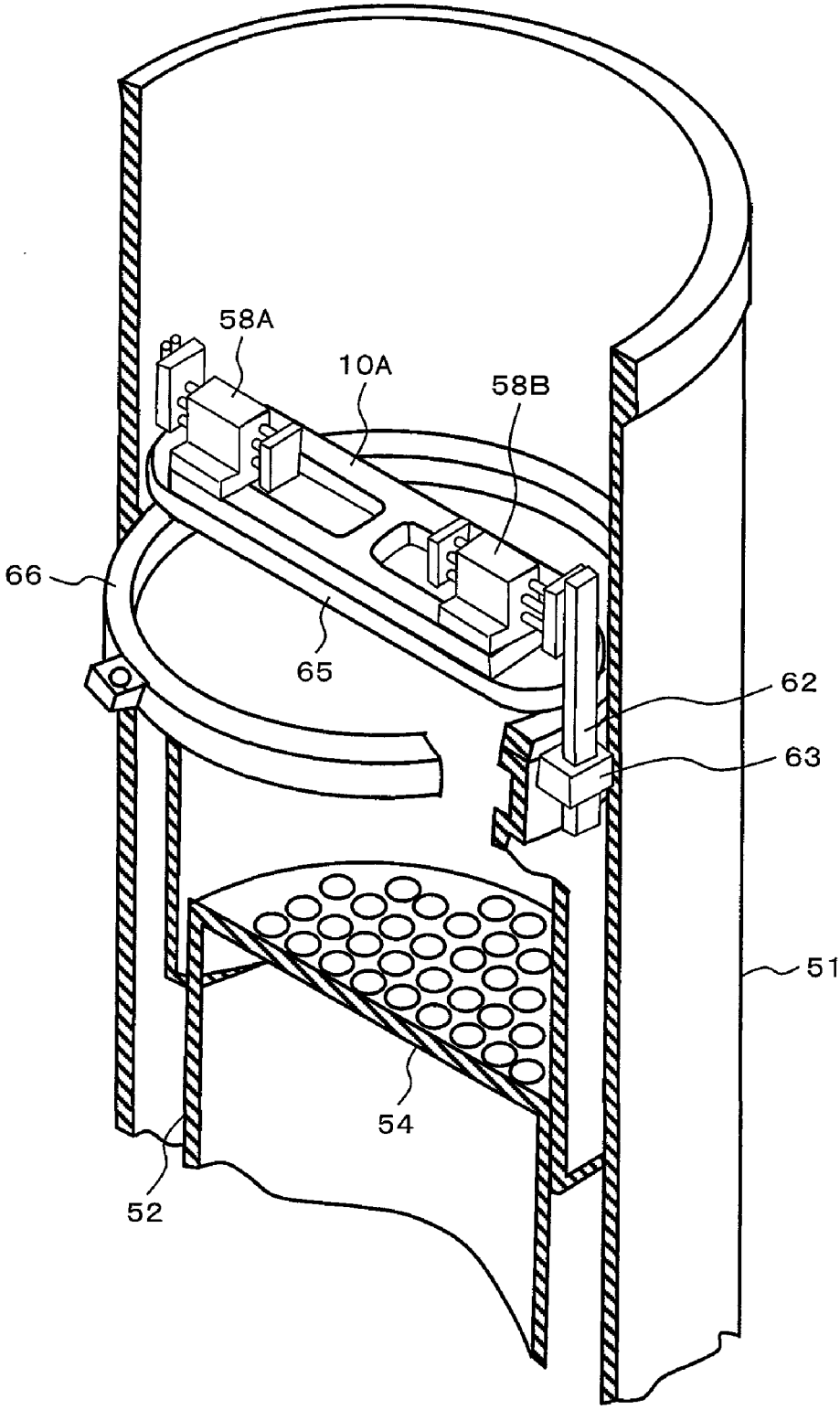
FIG. 7 is a perspective view showing a water jet peening apparatus shown in FIG. 6 in the vicinity of a turn table.
Figure 8:
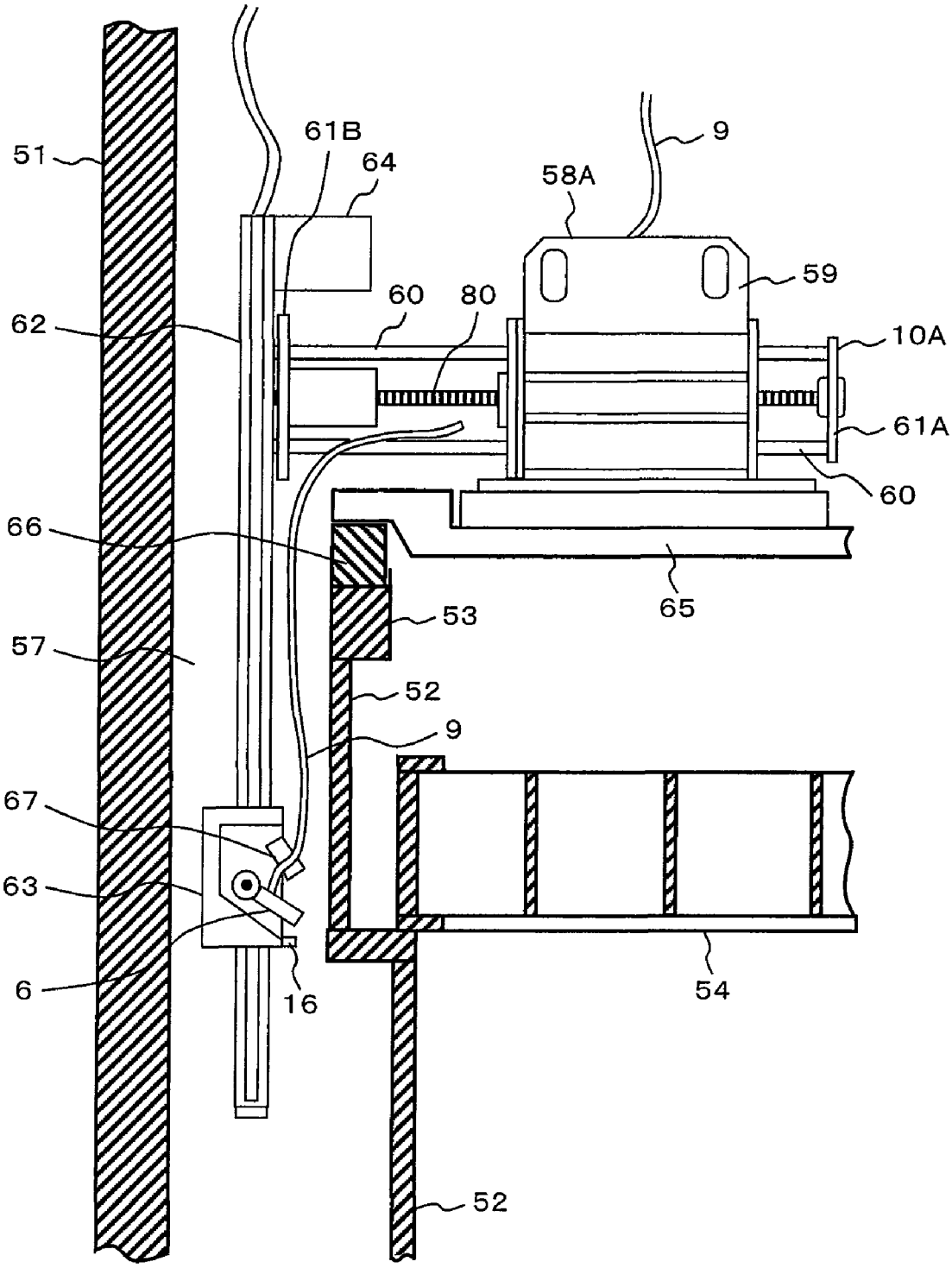
FIG. 8 is an enlarged view a movement apparatus to which a nozzle of a water jet peening apparatus shown in FIG. 6 is mounted.

The nozzle scanning apparatus 10A is explained below. The nozzle scanning apparatus 10A has movement apparatuses 58A and 58B, a post member 62, an elevator 63, and a turn table 65 as shown in FIGS. 6, 7, and 8. The turn table 65 is installed rotatably in a circular guide rail 66 mounted to a top surface of an upper flange 53 of the core shroud 52. Although not shown, in the turn table 65, a plurality of wheels in contact with a top surface of the guide rail 66 are installed. A motor (not shown) for rotating at least one wheel (not shown) is installed in the turn table 65. The movement apparatuses 58A and 58B are installed on the turn table 65.

With respect to the movement apparatuses 58A and 58B having the same structure, the movement apparatus 58A is explained as an example. The movement apparatus 58A has an apparatus body 59, two arms 60, and a ball screw 80 as shown in FIG. 8. The two arms 60 pass through the casing of the apparatus body 59 and are attached slidably to the casing. Both ends of the two arms 60 are connected by connection members 61A and 61B. The ball screw 80 passing through the casing of the apparatus body 59 is attached rotatably to the connection members 61A and 61B. Although not shown, a motor is installed in the casing of the apparatus body 59 and a gear (not shown) attached to the rotary shaft of the motor engages with a gear (not shown) engaged with the ball screw 80. These gears rotate by driving by the motor and the ball screw 80 moves in the radial direction of the reactor pressure vessel 51. A post member 62 extending in the axial direction of the reactor pressure vessel 51 is attached to the connection members 61B. The elevator 63 is attached to the post member 62 so as to be able to move along the post member 62. A motor 64 for moving the elevator 63 vertically is installed at the upper end of the post member 62.

The nozzle 6, the pressure sensor 16, and a monitor camera 67 are mounted to the elevator 63.

In the present embodiment, the WJP is executed for an outside surface at the upper end of the core shroud 52. In the present embodiment, the core shroud 52 is a WJP execution object. After the operation of the boiling water nuclear plant is stopped, an upper cover of the reactor pressure vessel 51 is removed, and the dryer and separator installed in the reactor pressure vessel 51 are removed and transferred outside the reactor pressure vessel 51. These transfers are executed using a ceiling crane (not shown) in the nuclear reactor building where the reactor pressure vessel 51 is installed. When removing and transferring the dryer and separator, a reactor well 68 positioned right above the reactor pressure vessel 51 is filled with the water 3.

The guide rail 66 is moved onto the upper flange 53 using the ceiling crane and is installed on the upper flange 53. The turn table 65 to which the movement apparatuses 58A and 58B are mounted is conveyed by the ceiling crane and are installed on the guide rail 66. The post member 62 where the elevator 63 having the nozzle 6, pressure sensor 16, and monitor camera 67 is mounted is installed in the respective movement apparatuses 58A and 58B before the turn table 65 is conveyed. When the turn table 65 is installed on the guide rail 66, the post members 62 installed in the respective movement apparatuses 58A and 58B are disposed in the down corner 57.

The high-pressure pump 5 and operation console 26 are placed on an operation floor 69 in the nuclear reactor building and the signal processing apparatus 39A, control apparatuses 22 and 23, and display apparatus 21 are installed in the operation console 26. The signal processing apparatus 39A has the amplifier 18, discriminator 19, and counter 20. The operation floor 69 surrounds the nuclear reactor well 68. The two high-pressure hoses 9 connected to the high-pressure pump 5 are respectively attached to the movement apparatuses 58A and 58B and are separately connected to the nozzle 6 mounted to the movement apparatus 58A and the nozzle 6 mounted to the movement apparatus 58B. A signal line 70 connected to the pressure sensor 16 attached to the movement apparatus 58A is connected to the amplifier 18. The amplifier 18 is connected to the discriminator 19 and display apparatus 21. The signal line 70 connected to the pressure sensor 16 attached to the movement apparatus 58B is also connected to the display apparatus 21, and the discriminator 19 of another signal processing apparatus 39A through another amplifier 18. The respective counters 20 of the two signal processing apparatuses 39A are connected to the display apparatus 21. A control signal line 71 connected to the control apparatus 22 is connected to the motors 64 installed in the respective movement apparatuses 58A and 58B, the motor installed in the casing of the apparatus body 59, and the motor for rotating the wheels of the turn table 65 installed in the turn table 65. The respective motors are equipped with an encoder (not shown) and each encoder detects the movement distance of the member moved by the motor, that is, the position of the member after movement.

Figure 2:
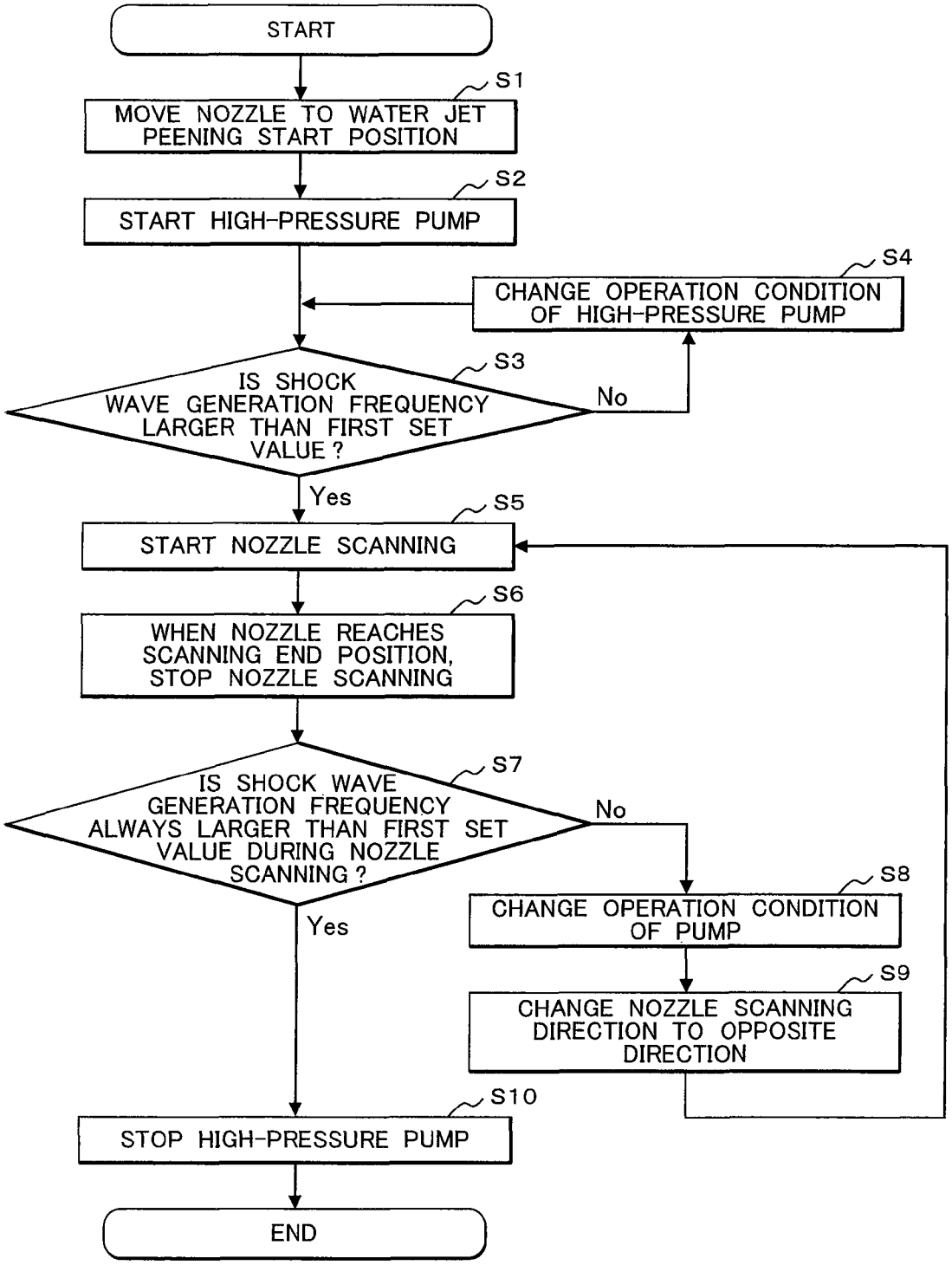
FIG. 2 is a flowchart showing control procedure when a water jet peening apparatus shown in FIG. 1 is used.

Also in the water jet peening method according to the present embodiment, similarly to the embodiment 1, each operation or process shown in FIG. 2 is executed. In the core shroud 52, the welding portions extending in the axial direction exist at a plurality of portions in the peripheral direction of the core shroud 52 and the welding portions extending in the peripheral direction exist at a plurality of portions in the axial direction of the core shroud 52. In the present embodiment, the WJP is executed along the welding portions.

For example, the WJP is assumed to be executed along certain welding portions extending in the peripheral direction of the core shroud 52. In the step S1, each nozzle 6 installed in the movement apparatuses 58A and 58B is moved to the WJP start position. The operator inputs the position information in each of the peripheral direction, axial direction, and radial direction of the core shroud 52 from the operation console 26. The control apparatus 22 drives the three motors installed in the WJP apparatus 1A based on the aforementioned position information and positions the nozzle 6 to the scanning start position designated to face one welding portion aforementioned. The ball screw rotates by the drive of the motor installed in the apparatus body 59 of each of the movement apparatuses 58A and 58B and each of the post members 62 moves in the radial direction of the core shroud 52. By this movement of the post members 62, the distance between the nozzle 6 and the outside surface of the core shroud 52 that is the WJP execution surface, that is, the stand off is set to a set value. The elevator 63 moves in the axial direction of the core shroud 52 along the post members 62 by driving of the motor 64 and the nozzle 6 is positioned to a predetermined position in the axial direction of the core shroud 52.

Thereafter, the operation at the step S2 is executed. The high-pressure pump 5 is driven and pressurized high-pressure water is supplied to the nozzles 6 installed in the movement apparatuses 58A and 58B through the high-pressure hose 9. The high-pressure water is injected toward the outside surface of the core shroud 52 close to the upper grid plate 54 installed, from each of the nozzles 6 at the pressure of the initial value and the flow rate of the initial value. The shock wave generated due to collapse of bubbles included in the injected water jet is detected by the pressure sensor 16. The shock wave generation frequency is obtained by the counter 20 based on the detection signal outputted from the pressure sensor 16 due to the detection of the shock wave. The decision at the step S3 is executed based on the shock wave generation frequency. When the decision is "No", the operation condition of the high-pressure pump is changed at the step S4 and the decision at the step S3 is executed again. When the decision at the step 4 is "Yes", the scanning of the nozzle 6 at the step S5 is started. The nozzles 6 installed in the movement apparatuses 58A and 58B move along the welding portions extending in the peripheral direction of the core shroud 52 by injecting high-pressure water. The movement is executed by rotating the turn table 65 along the guide rail 66. The WJP is executed for the welding portions and heat influenced portions. In the present embodiment, the two nozzles 6 are positioned in the opposite directions of 180°, so that when each of the nozzles 6 moves, for example, at an angle of 190° in the peripheral direction, the operation at the step S6 is performed and the scanning of the nozzles 6 is stopped.

The decision at the step S7 is executed based on the shock wave generation frequency displayed on the display apparatus 21. When the decision is "Yes", the operation of the high-pressure pump 5 is stopped (the step S10). The execution of WJP for one welding portion extending in the peripheral direction of the core shroud 52 is stopped. When the decision at the step S10 is "No", the operations at the steps S8 and S9 are performed and the WJP is executed again for the re-execution section of WJP set in the corresponding welding portion. When the decision at the step S10 after re-execution is "Yes", the operation of the high-pressure pump 5 is stopped.

The WJP is executed similarly for another welding portion formed in the core shroud 52 in the peripheral direction and the welding portion formed in the core shroud 52 in the axial direction.

In the present embodiment, each effect attained in the embodiment 1 can be obtained. Particularly, the present embodiment can accurately confirm the improvement effect of the residual stress of the core shroud 52 that is a WJP execution object.

Embodiment 3

Figure 9:
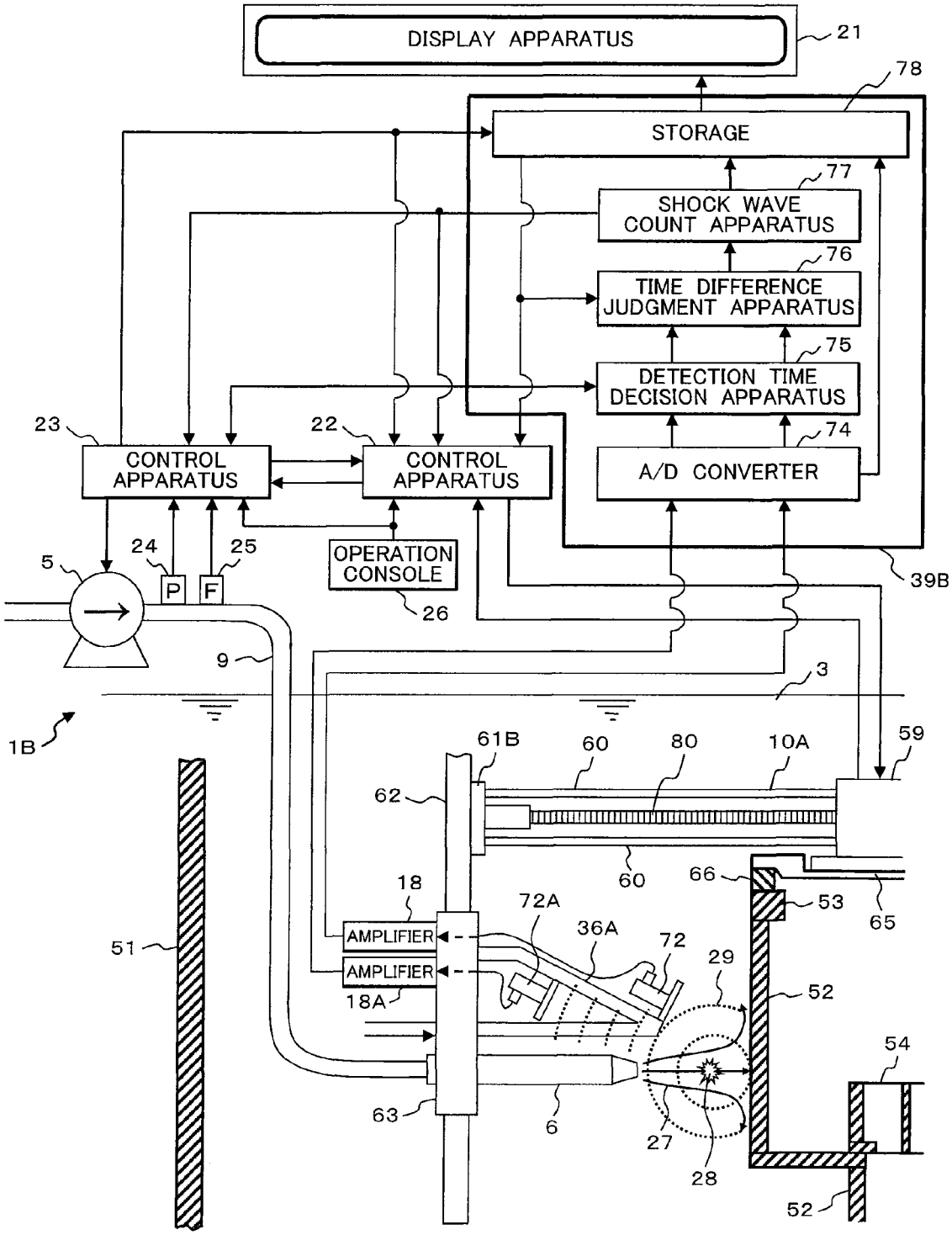
FIG. 9 is a structural diagram showing a water jet peening apparatus used in a water jet peening method according to embodiment 3 which is another embodiment of the present invention.
Figure 10:
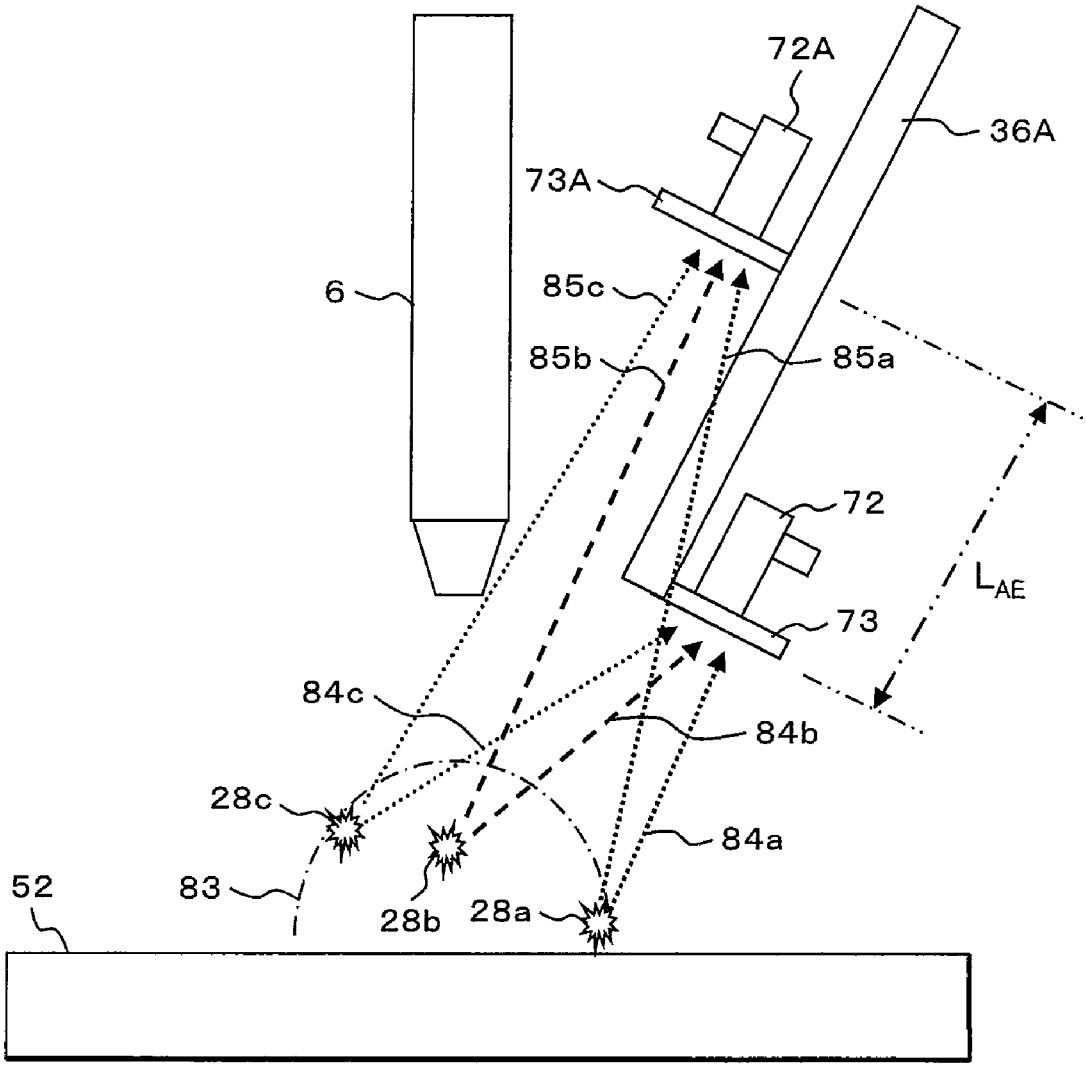
FIG. 10 is an enlarged view showing a water jet peening apparatus shown in FIG. 9 in the close to a nozzle.
Figure 11:
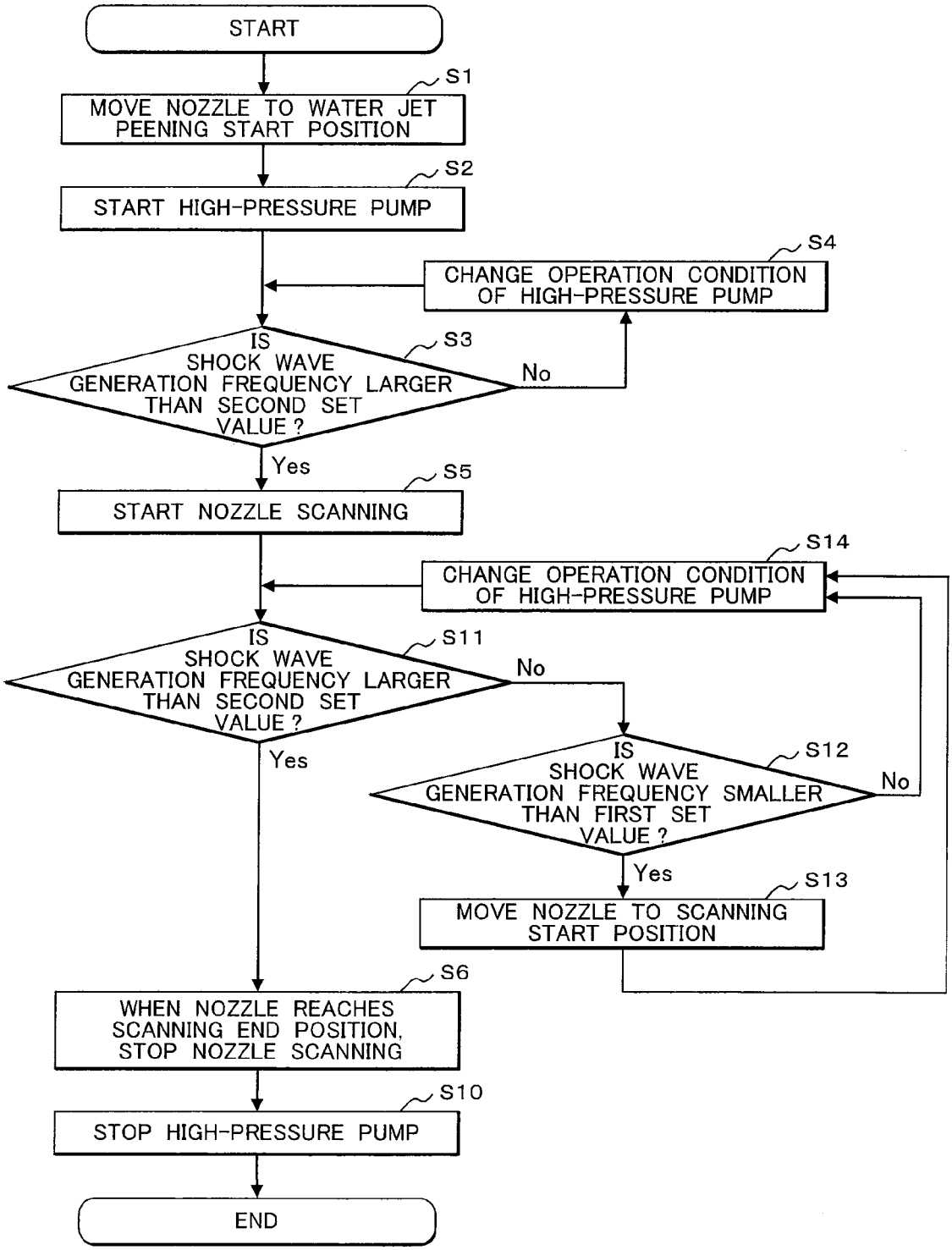
FIG. 11 is a flowchart showing control procedure executed in a water jet peening apparatus shown in FIG. 9.

A water jet peening method according to embodiment 3 which is another embodiment of the present invention is explained by referring to FIGS. 9, 10, and 11.

A WJP apparatus 1B used in the present embodiment is explained by referring to FIG. 9. The WJP apparatus 1B has a structure that the signal processing apparatus 39 is replaced with a signal processing apparatus 39B and the pressure sensor 16 is replaced with AE sensors (shock wave detection apparatuses) 72 and 72A in the WJP apparatus 1A used in the embodiment 2. The other structure of the WJP apparatus 1B is the same as that of the WJP apparatus 1A. For the structure of the WJP apparatus 1B, the portion different from the WJP apparatus 1A is explained.

A support member 36A is extended in the axial direction of the nozzle 6 installed on the elevator 63 and is attached to the elevator 63. Shock wave conversion plates 73 and 73A are installed on the support member 36A at difference positions in the axial direction of the nozzle 6 (refer to FIG. 10). The shock wave conversion plate 73 is positioned on the end side of the nozzle 6 compared with the shock wave conversion plate 73A and the shock wave conversion plate 73A is positioned at a distance of $L_{AE}$ from the shock wave conversion plate 73. The AE sensor 72 is installed in the shock wave conversion plate 73 and the AE sensor 72A is installed in the shock wave conversion plate 73A. The shock wave conversion plates 73 and 73A are positioned on the end side of the nozzle 6 compared with the respective AE sensors installed.

The signal processing apparatus 39B has an analog-digital converter (A-D converter) 74, a detection time decision apparatus 75, a time difference judgment apparatus (shock wave judgment apparatus) 76, a shock wave counting apparatus 77, and a storage 78 (refer to FIG. 9). The A-D converter 74 is connected to the detection time decision apparatus 75 and the detection time decision apparatus 75 is connected to the time difference judgment apparatus 76. The time difference judgment apparatus 76 is connected to the shock wave counting apparatus 77. The storage 78 is connected to the detection time decision apparatus 75, time difference judgment apparatus 76, shock wave counting apparatus 77, and control apparatuses 22 and 23. The signal processing apparatus 39B is shown in a hard image in FIG. 9, though is programmed in the personal computer. The signal processing apparatus 39B is attached to the operation console 26 installed on the operation floor surrounding the reactor well. The high-pressure pump 5 is installed on the operation floor.

The amplifiers 18 and 18A are attached to the elevator 63. The amplifier 18 is connected to the AE sensor 72 and A-D converter 74. The amplifier 18A is connected to the AE sensor 72A and A-D converter 74. The amplifiers 18 and 18A are waterproofed.

Figure 13:
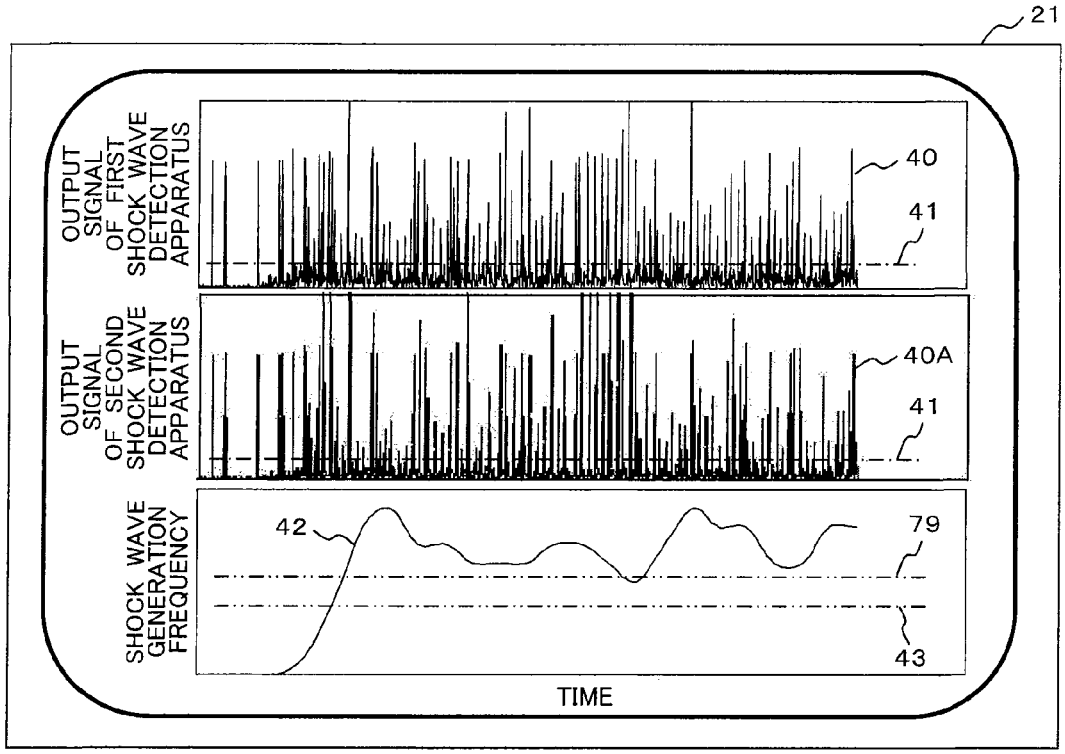
FIG. 13 is an explanatory drawing showing a display example of an output signal of a pressure sensor and generation frequency of shock wave in a state that improvement of residual stress according to embodiment 3 is performed satisfactorily.

The storage 28 stores information of the scanning start position and scanning end position of the WJP for the welding portion formed in a WJP execution object, set value of a shock wave detection signal, first set value 43 and second set value 79 of the shock wave generation frequency (refer to FIG. 13), and normal range (lower limit value and upper limit value) of time difference of shock wave detection between the AE sensor 72 and the AE sensor 72A. The second set value 79 is larger than the first set value 43.

The water jet peening method according to the present embodiment is explained concretely by referring to FIGS. 9 and 11. The WJP execution object of the present embodiment is the core shroud 52. After the operation of the boiling water nuclear plant is stopped, the nozzle scanning apparatus 10A is installed on the upper flange 66 of the core shroud 52 in the reactor pressure vessel 51 filled with the water 3 as described in the embodiment 2. At this time, the respective post members 62 in which the elevator 63 of the movement apparatuses 58A and 58B with the nozzle 6 installed moves are disposed between the reactor pressure vessel 51 and the core shroud 52.

In the present embodiment, steps S1, S3, S5, S6, and S11 to S14 are executed by the control apparatus 22 and steps S2, S4, S10, and S14 are executed by the control apparatus 23.

Before the control at the step S1 is executed, the operator, for the plurality of welding portions extending in the axial direction and the plurality of welding portions extending in the peripheral direction which are formed on the core shroud 52, inputs beforehand the respective scanning start positions and scanning end positions to the operation console 26. Each information of the input scanning start positions and scanning end positions is stored in the storage 78 via the control apparatus 22.

For example, the WJP is assumed to be executed along certain welding portion extending in the peripheral direction of the core shroud 52. In the present embodiment, similarly to Embodiment 2 formed in the core shroud 52, the control at the step S1 is executed by the control apparatus 22 and the control at the step S2 is executed by the control apparatus 23. In the control at the step S1, the control apparatus 22 inputs the information of the scanning start position regarding one welding portion extending in the peripheral direction which is stored in the storage 78.

After the control at Steps S1 and S2 is finished, whether the shock wave generation frequency is larger than the first set value of the shock wave generation frequency or not is decided (step S3). In the present embodiment, the shock wave generation frequency is obtained by the shock wave counting apparatus 77 as described later. The control apparatus 22 decides whether the shock wave generation frequency inputted from the shock wave counting apparatus 77 is larger than the second set value 79 (refer to FIG. 13) of the shock wave generation frequency inputted from the storage 78 or not. When the decision result is "No", the control apparatus 22 outputs an operation condition change signal to the control apparatus 23. Thereafter, the operation condition of the high-pressure pump is changed (step S4). When the operation condition change signal is input, the control apparatus 23 changes the operation condition of the high-pressure pump 5 (the set value of the discharge pressure or discharge flow rate of the high-pressure pump 5). The control apparatus 23 controls the high-pressure pump 5 based on the changed operation condition. The high-pressure pump 5 discharge water increased in pressure. The water jet 27 is injected from the high-pressure pump 5 at the increased pressure and as describe later, the shock wave generation frequency 42 is obtained.

The control apparatus 22 executes the control at the step S5 when deciding "Yes" at the decision at the step S3 based on the inputted shock wave generation frequency. When executing the control at the step S5, the control apparatus 22 inputs the information of the scanning end position regarding one welding portion formed on the core shroud 52 from the storage 78. The nozzle 6 is positioned already to the scanning start position and the control apparatus 22 outputs a scanning start signal to the motor for rotating the wheels of the turn table 65 installed in the WJP apparatus 1A. The motor is driven, and the turn table 65 is rotated, and the nozzle 6 injecting the high-pressure water jet 27 moves up to the scanning end position along the welding portion extending in the peripheral direction.

The water jet 27 is injected from the nozzle 6 toward the outside surface of the core shroud 52. A part of a plurality of bubbles 28 included in the injected water jet is collapsed and the shock waves 29 are generated. The shock waves 29 impact on the corresponding welding portion and the heat-affected zone formed in the core shroud 52. Therefore, the tensile residual stress existing close to the surface of the welding portion and heat-affected zone is improved to compressive residual stress. The AE sensors 72 and 72A moving in the peripheral direction together with the nozzle 6 detect the shock waves 29 propagating in the water 3 and output a plurality of shock wave detection signals. Concretely, the AE sensor 72 detects a sound wave generated in the shock wave conversion plates 73 due to impact of the shock waves 29 and the AE sensor 72A detects a sound wave generated in the shock wave conversion plates 73A due to impact of the shock waves 29. The shock wave detection signals outputted from the AE sensors 72 and 72A are amplified by the amplifiers 18 and 18A and are input into the A-D converter 74. The A-D converter 74 converts each of the shock wave detection signals to digital signals and outputs them to the display apparatus 21 and detection time decision apparatus 75.

When a shock wave generated due to collapse of one bubble is received by the AE sensors 72 and 72A, a time difference is generated in the detection of the shock wave between the AE sensors. The reason is explained by referring to FIG. 10. When a bubble 28*a* is collapsed and a shock wave is generated, the propagation path of the shock wave to the AE sensor 72 is indicated by 84*a* and the propagation path of the shock wave to the AE sensor 72A is indicated by 85*a*. The shock wave is propagated in the water 3 at the sound speed (≈1500 m/s), so that the difference of the detection time of the shock wave caused between the AE sensor 72 and the AE sensor 72A is caused based on a difference of length between the propagation path 84*a* and the propagation path 85*a*.

Here, the range of collapse of a bubble is assumed as the range indicated by an alternate long and short dash line 83 (refer to FIG. 10). The AE sensor 72 and the AE sensor 72A are separated from each other at a distance of $L_{AE}$, so that even if at different positions within the range inside the alternate long and short dash line 83, a plurality of bubbles, for example, the bubbles 28*a*, 28*b*, and 28*c* are collapsed and shock waves are generated respectively, a difference appears in the detection time of each shock wave between the AE sensor 72 and the AE sensor 72A. The propagation paths of the shock waves generated due to collapse of the bubbles 28*b* and 28*c* to the AE sensor 72 are indicated by 84*b* and 84*c* and the propagation paths of the shock waves to the AE sensor 72A are indicated by 85*b* and 85*c*. Each shock wave is propagated in the water at the sound speed, so that the differences in the detection time are included within a predetermined range. On the other hand, electromagnetic noise is propagated at a speed close to speed of light. Therefore, when the AE sensors 72 and 72A detect electromagnetic noise, the AE sensors output simultaneously an output signal for the electromagnetic noise. Thus, when there is no difference in the detection time between the AE sensors 72 and 72A, it is judged that an output signal due to electromagnetic noise is output. When the difference in the detection time between the AE sensors 72 and 72A is almost equal to the time required for the shock waves to propagate at the distance $L_{AE}$ between the AE sensors and is within the range of a preset normal time difference, it is judged that the shock waves are received.

Figure 12:
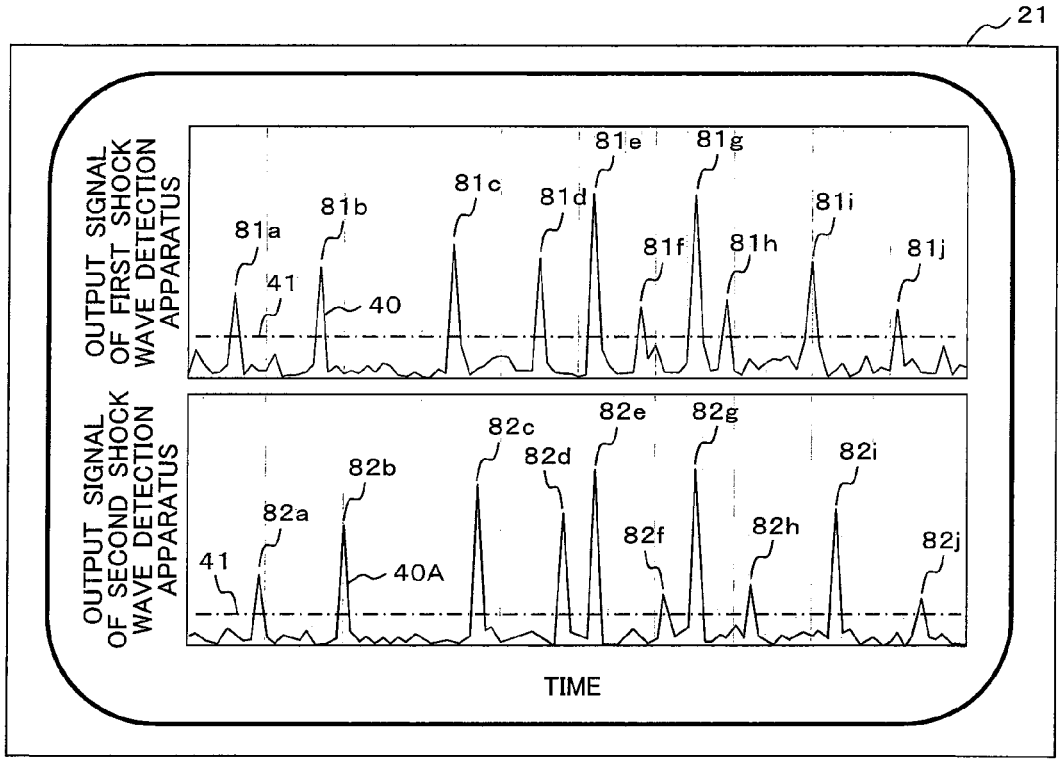
FIG. 12 is an explanatory drawing showing an example of output signals of two AE sensors during execution of water jet peening in embodiment 3.

An example of each shock wave detection signal outputted from the AE sensor 72 (the first shock wave detection apparatus) and the AE sensor 72A (the second shock wave detection apparatus) during execution of WJP is shown in FIG. 12. In FIG. 12, the vertical axis indicates intensity of the shock wave detection signal and the horizontal axis indicates the time. In FIG. 12, the time in the horizontal axis is enlarged compared with FIGS. 13 and 14 described later. FIG. 12 shows a state that each shock wave detection signal outputted from the A-D converter 74 to the display apparatus 21 is displayed on the display apparatus 21.

The detection time decision apparatus 75 selects a shock wave detection signal having a larger intensity than the set value 41 of the shock wave detection signal inputted from the storage 78 among the shock wave detection signals inputted from the A-D converter 74. The detection time decision apparatus 75 decides the detection time of the selected shock wave detection signal. In FIG. 12, shock wave detection signals 81*a* to 81*j* are selected from the shock wave detection signals outputted from the AE sensor 72 and shock wave detection signals 82*a* to 82*j* are shock wave detection signals that are selected from the shock wave detection signals outputted from the AE sensor 72A. The selected shock wave detection signals are outputted together with the decided time information from the detection time decision apparatus 75 to the time difference judgment apparatus 76.

The time difference judgment apparatus 76 calculates a difference between the detection time of the shock wave detection signal from the AE sensor 72 detecting the shock wave generated due to collapse of one bubble and the detection time of the shock wave detection signal from the AE sensor 72A. The time difference judgment apparatus 76 decides whether the calculated time difference exists within the normal range (the lower limit value and upper limit value) of the time difference inputted from the storage 78 and judges that the shock wave is detected when the calculated time difference exists within the normal range. For example, in FIG. 12, the shock wave detection signal 81*a* and shock wave detection signal 82*a*, and the shock wave detection signal 81*b* and shock wave detection signal 82*b* exist within the normal range of the time difference, so that the time difference judgment apparatus 76 judges that the signals are generated respectively from the same shock wave. However, the shock wave detection signal 81*e* and shock wave detection signal 82*e*, and the shock wave detection signal 81*g* and shock wave detection signal 82*g* are detected almost simultaneously, so that the time difference judgment apparatus 76 judges that the signals are not generated due to detection of the shock waves but they are noise. The time difference judgment apparatus 76 outputs a shock wave judgment signal when deciding that the shock waves are detected.

The shock wave counting apparatus 77 counts inputted shock wave judgment signals. The counting of shock wave judgment signals is equivalent to the counting of shock waves. The counted value of shock wave judgment signals per unit time is the shock wave generation frequency. The obtained shock wave generation frequency is stored in the storage 78 and is input into the control apparatus 22. The shock wave generation frequency stored in the storage 78 is sequentially displayed on the display apparatus 21. The shock wave detection signal 40 from the AE sensor 72, the shock wave detection signal 40A from the AE sensor 72A, the set value 41 of the shock wave detection signal, the shock wave generation frequency 42, and the first set value 43 and second set value 79 of the shock wave generation frequency are displayed on the display apparatus 21 (refer to FIGS. 13 and 14).

Whether the shock wave generation frequency is larger than the second set value of the shock wave generation frequency or not is decided (step S11). The control apparatus 22 decides whether the inputted shock wave generation frequency is larger than the second set value 79 inputted from the storage 78 or not. The decision is made while the nozzle 6 moves from the scanning start position toward the scanning end position along one welding portion formed on the core shroud 52 in the peripheral direction. When the decision at the step S11 executed by the control apparatus 22 is always "Yes", the scanning of the nozzle is finished at the point of time when the nozzle reaches the scanning end position (step S6). The control apparatus 22 outputs a drive stop signal to the motor when deciding that the nozzle 6 reaches the scanning end position of one welding portion extending in the peripheral direction based on an output signal from the encoder installed on the motor for rotating the turn table 65, and stops the rotation of the turn table 65.

The high-pressure pump is stopped (step S10). The drive stop signal outputted from the control apparatus 22 is inputted into the control apparatus 23. The control apparatus 23 stops the high-pressure pump 5 when inputting the drive stop signal. By doing this, the WJP execution work along the one welding portion extending in the peripheral direction of the core shroud 52 is finished. By the execution of WJP, the tensile residual stress existing in the vicinity of the surface of the welding portion and heat-affected zone is improved to compressive residual stress. This can be confirmed from the fact that the shock wave generation frequency is larger than the second set value 79 that is larger than the first set value 43 through the length of the welding portion in the peripheral direction. When there exists a part where the shock wave generation frequency is lower than the first set value 43, it means that in the portion, the improvement effect of the tensile residual stress is insufficient.

When the decision result at the step S11 by the control apparatus 22 is "No", it is decided that the shock wave generation frequency is smaller than the first set value of the shock wave generation frequency (step S12). The control apparatus 22 decides whether the inputted shock wave generation frequency is smaller than the first set value 43 inputted from the storage 78 or not. When the decision is "No", the operation condition of the high-pressure pump is changed (step S14). When the decision result at the step S12 is "No", the control apparatus 22 outputs an operation condition change signal of the high-pressure pump 5 to the control apparatus 23. The control apparatus 23 changes the operation condition of the high-pressure pump 5 (the set value of the discharge pressure or the set value of the discharge flow rate of the high-pressure pump 5) when inputting the operation condition change signal. Namely, the control apparatus 23 increases the set value of the discharge pressure (or the set value of the discharge flow rate) by predetermined range set. The control apparatus 23 controls the high-pressure pump 5 based on the changed operation condition. By the control, the pressure of the water jet injected from the nozzle 6 is increased by being pressurized by the high-pressure pump 5 and the improvement effect of the tensile residual stress close to the surface of the welding portion is increased by the shock wave (refer to FIG. 13). The change of the operation condition of the high-pressure pump 5 and the control for the high-pressure pump 5 based on the changed operation condition are executed by scanning the nozzle 6. The state that the shock wave generation frequency is smaller than the second set value 79 and larger than the first set value 43 indicates that the power of cavitation is being weakened. However, unless the shock wave generation frequency becomes smaller than the first set value, a predetermined improvement effect of the residual stress of the core shroud 52 is generated.

Figure 14:
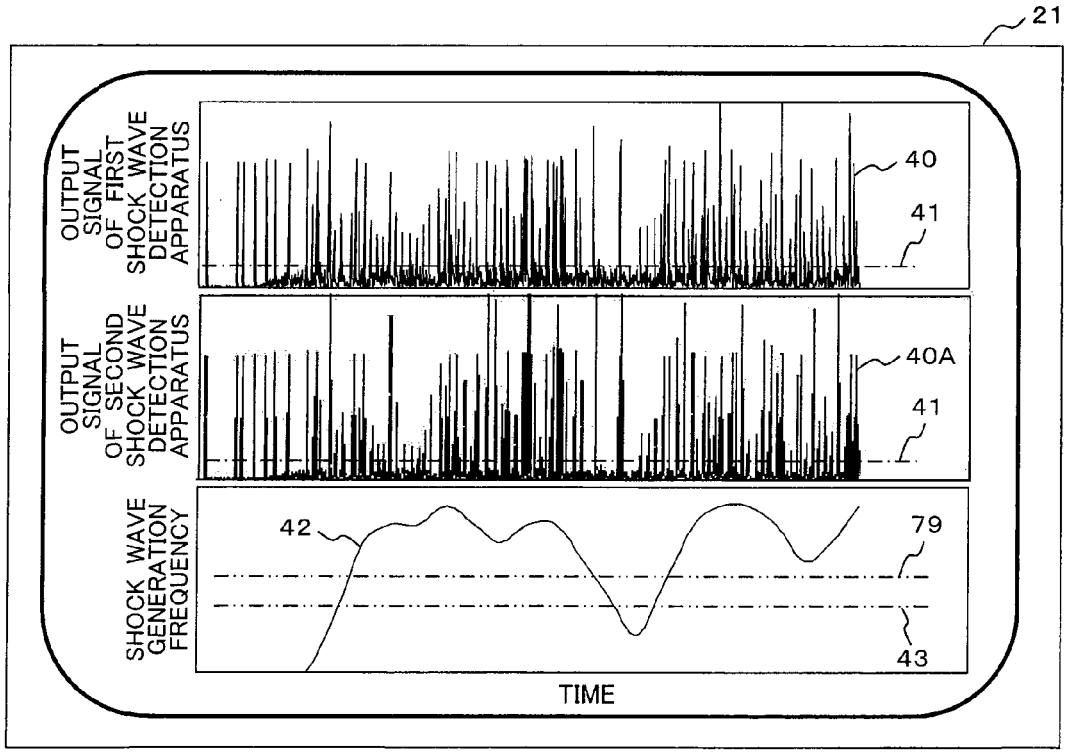
FIG. 14 is an explanatory drawing showing a display example of an output signal of a pressure sensor and generation frequency of shock wave in a state that improvement of residual stress according to embodiment 3 is not sufficient.

When the decision at the step S12 is "Yes", the nozzle is moved to the scanning start position (step S13). When the decision at the step S12 becomes "Yes", the shock wave generation frequency becomes lower than the first set value 43 as shown in FIG. 14. The control apparatus 22 moves the nozzle 6 to the scanning start position when the decision at the step S12 becomes "Yes". At the time of the movement, the control apparatus 22 sets the scanning start position where the nozzle 6 is to be returned to the position at the point of time slightly earlier than the position of the nozzle 6 when the shock wave generation frequency becomes the first set value 43. The movement of the nozzle 6 is executed by outputting a drive command to a drive apparatus (for example, a motor) for rotating the turn table 65, which is one of the movement apparatuses of the nozzle scanning apparatus 10A, by the control apparatus 22 and the nozzle 6 is returned to the set scanning start position. The drive command outputted from the control apparatus 22 is inputted into the control apparatus 23. At this time, the control apparatus 23 changes the operation condition of the high-pressure pump 5 as the aforementioned operation at the step S14 and controls the high-pressure pump 5 based on the changed operation condition.

The control apparatus 23 controls the high-pressure pump 5 based on the changed operation condition and then outputs a nozzle scanning start signal to the control apparatus 22. The control apparatus 22, by input of the nozzle scanning start signal, moves the corresponding movement apparatus of the nozzle scanning apparatus 10A, for example, the turn table 65. The nozzle 6 injecting high-pressure water jet starts to move from the scanning start position and the execution of WJP to the welding portion of the core shroud 52 is resumed. When the control apparatus 22 decides "Yes" at the step S11 and executes the control at the step S6 and the control apparatus 23 executed the control at the step S10, the execution of WJP is finished.

The present embodiment can obtain each effect attained in embodiment 1. The present embodiment has two AE sensors and obtains the difference in the detection time of the shock wave detection signals outputted from the AE sensors, so that when executing the WJP in a high noise environment, the improvement effect of the residual stress can be monitored without being influenced by noise.

The present embodiment executes the decision at the step S12, that is, the decision of whether the shock wave generation frequency is smaller than the first set value 43 or not when the decision at the step S11 is "No", that is, when the shock wave generation frequency is smaller than the second set value 79 which is larger than the first set value 43, so that the probability that the shock wave generation frequency becomes smaller than the first set value 43 is reduced. Therefore, the probability of the state that the improvement effect of the tensile residual stress of the core shroud (the WJP execution object) 52 is insufficient is reduced.

The control apparatuses 22 and 23 may be unified into one control apparatus.

In Embodiments 1 and 2, the decision at the step S7 and the control at the step S8 may be changed to the decisions at the steps S11 and S12 and the control at the step S14 that are executed in the present embodiment.

The control at the step S14 by the control apparatus 23 may be changed to the control of the scanning speed of the nozzle 6 by the control apparatus 22. Namely, the control apparatus 22 controls the corresponding movement apparatus, by which the nozzle 6 is scanned, of the nozzle scanning apparatus so as to reduce the scanning speed of the nozzle 6.

Embodiment 4

Figure 15:
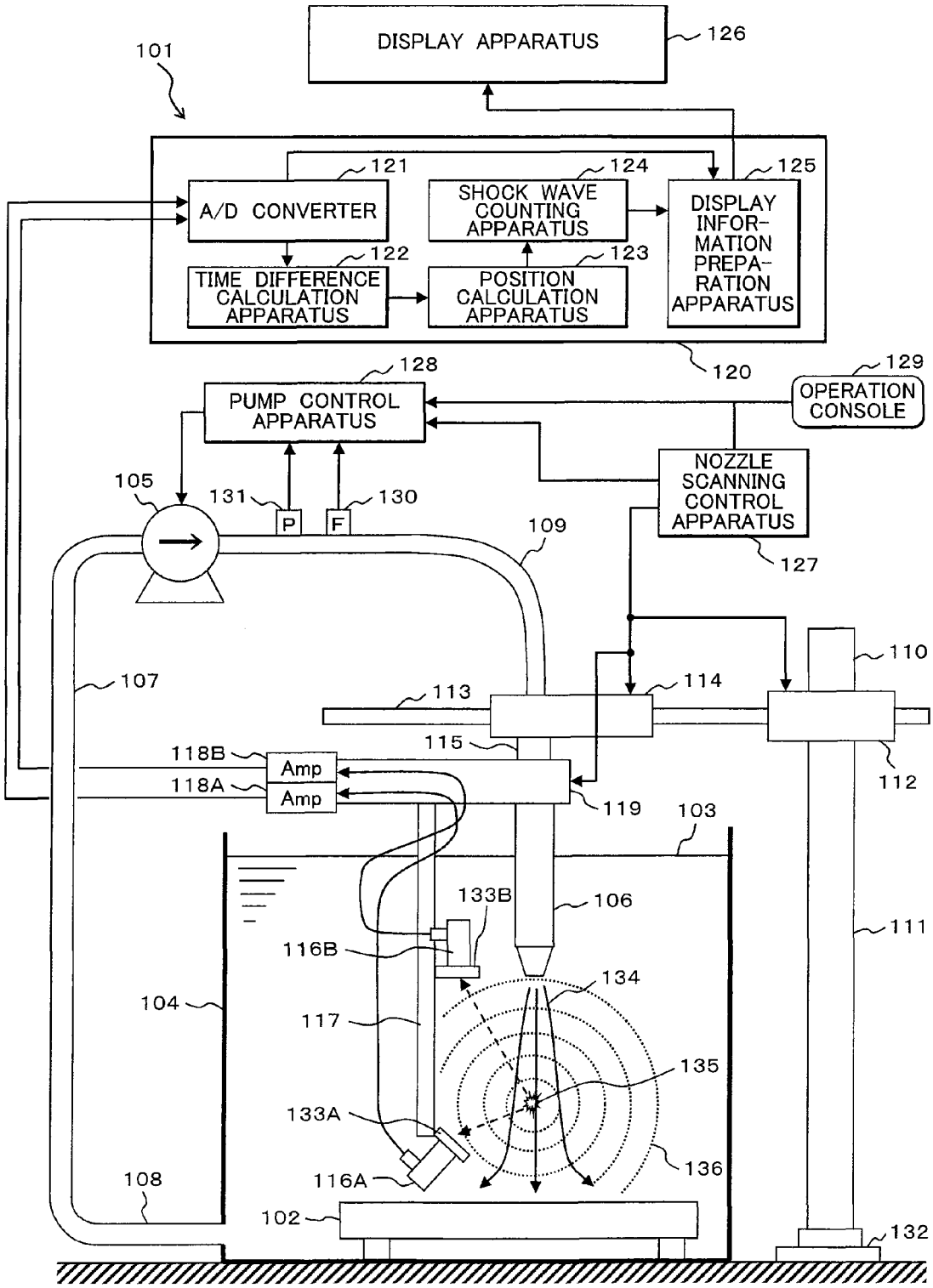
FIG. 15 is a structural diagram showing a water jet peening apparatus used in a water jet peening method according to embodiment 4 which is another embodiment of the present invention.
Figure 16:
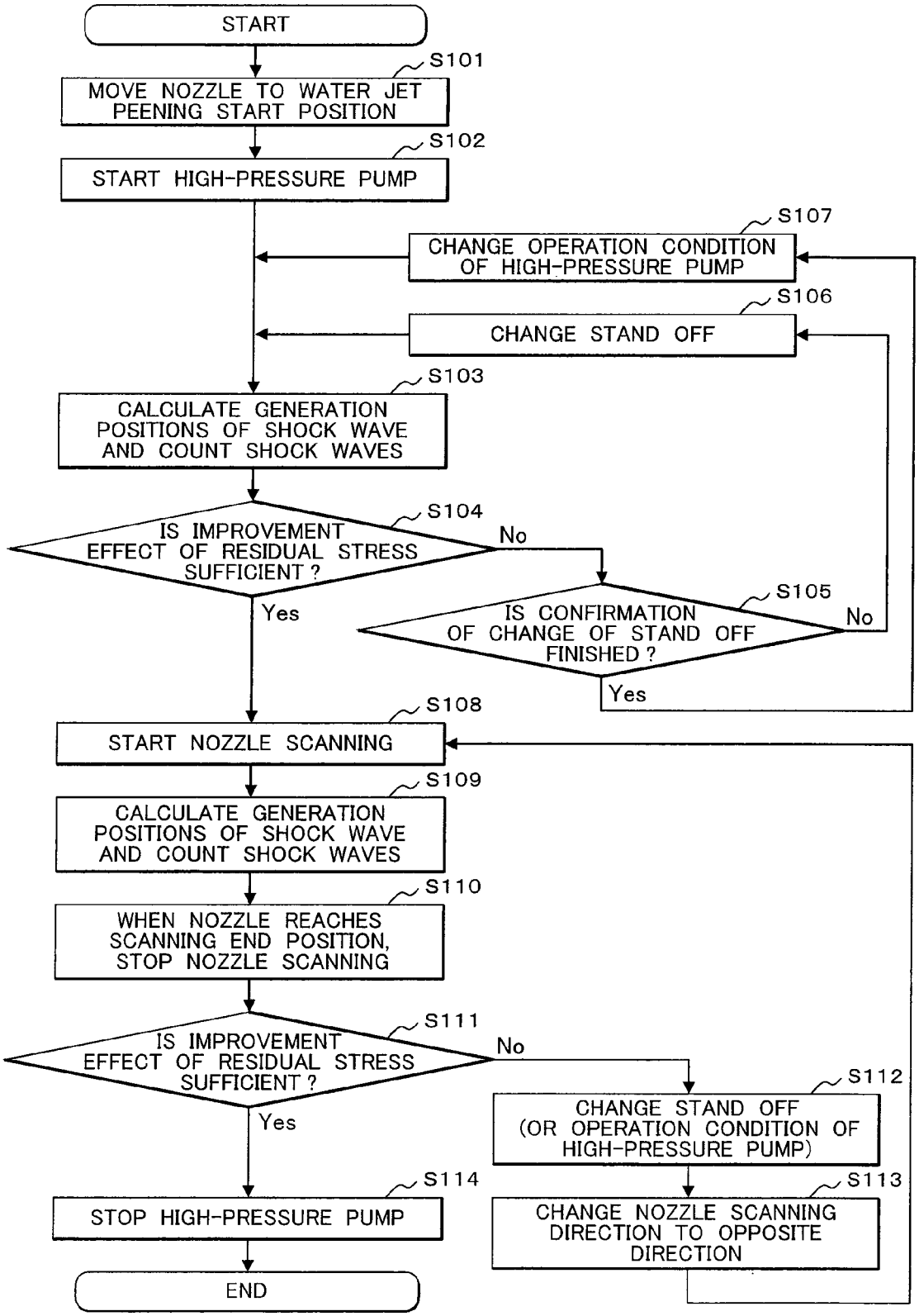
FIG. 16 is a flowchart showing control and decision procedures when the water jet peening apparatus shown in FIG. 15 is used.

A water jet peening method according to embodiment 4 which is another embodiment of the present invention is explained by referring to FIGS. 15 and 16.

Before explaining the water jet peening method according to the present embodiment, a WJP apparatus 101 used in the present embodiment is explained by referring to FIG. 15. The WJP apparatus 101 is provided with a nozzle 106, a water supply apparatus 107, a nozzle scanning apparatus 110, AE sensors (shock wave detection apparatuses) 116A and 116B, a signal processing apparatus 120, a nozzle scanning control apparatus 127, and a pump control apparatus 128.

The nozzle scanning apparatus 110 has a support 111, movement apparatuses 112, 114, and 119, a first arm 113, and a second arm 115. The support 111 is attached to a base 132 and is extended vertically. The movement apparatus 112 moving vertically is mounted movably to the support 111. The first arm 113 extending in the X direction in the horizontal direction is mounted to the movement apparatus 112. The movement apparatus 114 moving in the X direction along the first arm 113 is mounted movably to the first arm 113. The second arm 115 extending in the Y direction orthogonal to the X direction in the horizontal direction is mounted on the movement apparatus 114. The movement apparatus 119 is mounted movably to the second arm 115 and the nozzle 106 is attached to the movement apparatus 119. The base 132 is mounted to the floor to which a water tank (vessel) 104 is mounted.

The water supply apparatus 107 has a high-pressure pump 105, a feed water hose 108, and a high-pressure hose 109. The feed water hose 108 is mounted close to the bottom of the water tank 104 and is connected to the high-pressure pump 105. The high-pressure hose 109 is connected to the high-pressure pump 105 and nozzle 106.

The signal processing apparatus 120 has an A-D converter 121, a time difference calculation apparatus 122, a position calculation apparatus 123, a shock wave counting apparatus 124, and a display information preparation apparatus 125. The time difference calculation apparatus 122 is connected to the A-D converter 121 and the position calculation apparatus 123. The shock wave counting apparatus 124 connected to the position calculation apparatus 123 is connected to the display information preparation apparatus 125. To the display information preparation apparatus 125, the A-D converter 121 and a display apparatus 126 are connected.

The AE sensors 116A and 116B that are a shock wave detection apparatus are mounted to the support member 117 that is attached to the movement apparatus 119 and is extended downward. The AE sensor 116B is disposed close to an end of the nozzle 106 in the axial direction of the nozzle 106. The AE sensor 116A is separated from the end of the nozzle 106 in the axial direction and is disposed at the position farther from the AE sensor 116B with the movement apparatus 119 as a reference position. Shock wave conversion plates 133A and 133B are installed on the support member 117 and are mounted in contact with the respective fronts of the AE sensors 116A and 116B. Amplifiers 118A and 118B are attached to the movement apparatus 119. The AE sensor 116A is connected to the amplifier 118A and the AE sensor 116B is connected to the amplifier 118B. The amplifiers 118A and 118B are connected to the A-D converter 121.

The operation console 129 is connected to the nozzle scanning control apparatus 127 and pump control apparatus 128. The signal processing apparatus 120 and display apparatus 126 are installed in the operation console 129. The nozzle scanning control apparatus 127 is connected to the movement apparatuses 112, 114, and 119 and the pump control apparatus 128 is connected to the high-pressure pump 105. A pressure gauge 131 and a flow meter 130 attached to the high-pressure hose 109 are connected to the pump control apparatus 128.

The water jet peening method according to the present embodiment using the WJP apparatus 101 is explained below. In the water jet peening method according to the present embodiment, the operation or process at each step shown in FIG. 16 is executed.

The water tank 104 is filled with water 103 and a structural member 102 that is a WJP execution object is disposed in the water 103 in the water tank 104. The structural member 102 is a structural member composing a plant, for example, a nuclear power generation plant to be built. Or, the structural member 102 is a structural member of a nuclear plant having experience in operation and for the structural member, and the WJP may be executed using the WJP apparatus 101 in a pool filled with water positioned in a radiation controlled area of the nuclear plant. In FIG. 15, the structural member 102 is shown in a shape simplified schematically.

The nozzle is moved to the WJP start position (step S101). An operator inputs WJP start position information, that is, the position information of a jet outlet of the nozzle 106 to the operation console 129. The position information of the nozzle 106 is indicated by each coordinate value in the X direction, Y direction, and Z direction (vertical direction). The nozzle scanning control apparatus 127 drives the respective movement apparatuses 112, 114, and 119 based on the input position information. The end of the nozzle 106 is positioned to the coordinate value in the Z direction by the movement of the movement apparatus 112, the coordinate value in the X direction by the movement of the movement apparatus 114, and the coordinate value in the Y direction by the movement of the movement apparatus 119. The distance between the nozzle 106 and the structural member 102, that is, the stand off is held at a set distance by the coordinate value in the Z direction. The AE sensor 116A is arranged in the water nearer the structural member 102 than the AE sensor 116B.

After the nozzle 106 is set at the WJP start position, the high-pressure pump is started (step S102). A pump start signal is inputted from the operation console 129 to the pump control apparatus 128 by the operation of the operator. At this time, the pump control apparatus 128 starts the high-pressure pump 105. The high-pressure pump 105 is operated under the operation condition of the initial value. The water 103 in the water tank 104 is introduced to the high-pressure pump 105 through the feed water hose 108 by the start of the high-pressure pump 105. The pump control apparatus 128 controls the pressure and flow rate of water discharged from the high-pressure pump 105 based on the measured values of the pressure gauge 131 and flow meter 130.

The water 103 discharged from the high-pressure pump 105 is supplied to the nozzle 106 through the high-pressure hose 109 at the pressure and flow rate of the initial values and is injected from the nozzle 106 into the water 103 in the water tank 104 as the high-pressure water jet 134. The bubble 35 included in the injected water jet 134 is collapsed in the water 103, thus the shock wave 136 is generated. The shock wave 136 impacts on the structural member 102 and is detected by the AE sensors 116A and 116B.

Figure 17:
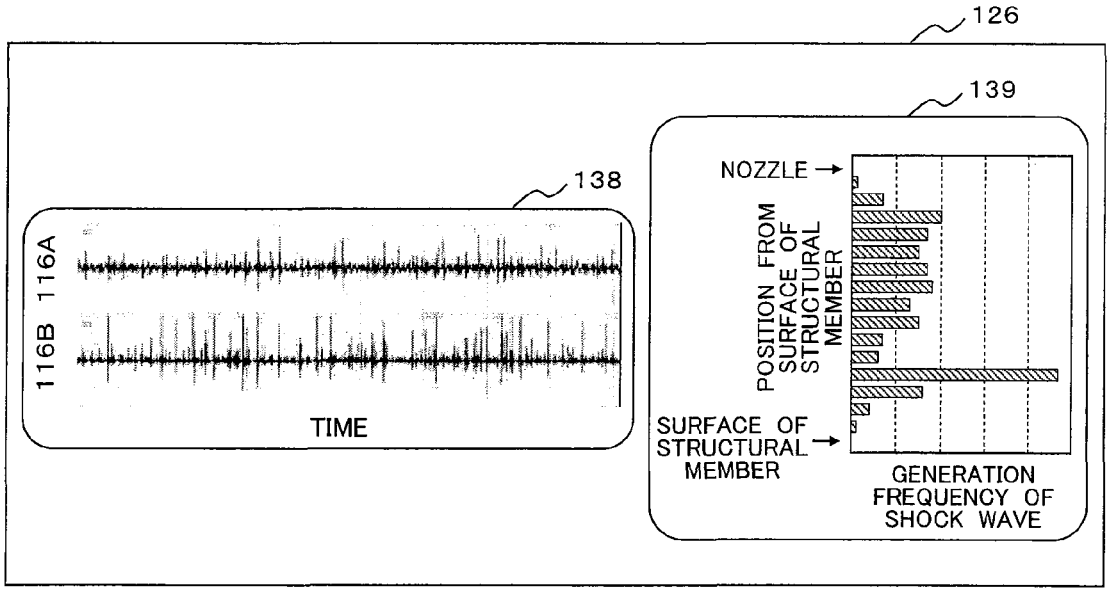
FIG. 17 is an explanatory drawing showing an example of the display information displayed on a display apparatus shown in FIG. 15.

The respective shock wave detection signals outputted from the AE sensors 116A and 116B detecting the shock wave 136 are amplified by the amplifiers 118A and 118B and then are inputted into the A-D converter 121. The A-D converter 121 converts the respective shock wave detection signals that are an analog signal to a digital signal and outputs them to the time difference calculation apparatus 122 and display information preparation apparatus 125. The display information preparation apparatus 125 prepares shock wave detection signal display information for each of the AE sensors 116A and 116B based on the respective shock wave detection signals. The shock wave detection signal display information is displayed on a display unit 138 of the display apparatus 126 (refer to FIG. 17). In FIG. 17, "116A" indicates a shock wave detection signal outputted from the AE sensor 116A and "116B" indicates a shock wave detection signal outputted from the AE sensor 116B. In the shock wave detection signals, sharp waveform having a high pulse height generating unperiodically indicates the shock wave 136 generated when the bubble 135 is collapsed. The display information preparation apparatus 125 permits the respective shock wave detection signals outputted from the A-D converter 121 to be stored in the storage (not shown) of the signal processing apparatus 120.

The generation position of the shock wave is calculated and the shock wave is counted (step S103). The time difference calculation apparatus 122 calculates a time difference T1 between the detection time of a certain shock wave by the AE sensor 116B and the detection time of the shock wave by the AE sensor 116A based on the input respective shock wave detection signals. The position calculation apparatus 123 substitutes time difference T1, the coordinate value z1 (m) of the AE sensor 116A in the Z direction, the coordinate value z2 (m) of the AE sensor 116B in the Z direction, and shock wave propagation speed V (m/s) in the water 103 (for example, the underwater sonic speed is 1500 (m/s)) into formula (3) and calculates the shock wave generation position z0 (refer to (B) shown in FIG. 18). The coordinate values z1 (m) and z2 (m) and the shock wave propagation speed V (m/s) in the water are known values. The coordinate values z1 (m) and z2 (m) can be identified based on the coordinate value of the jet outlet of the nozzle 106 in the Z direction which is inputted from the operation console 129 by the operator at the step S101. The generation position of the shock wave can be obtained for all the shock waves generated.

The shock wave counting apparatus 124 counts the generation number of shock waves by using the information of the generation position of each shock wave calculated by the position calculation apparatus 123, for the respective positions (sections) when the interval from the surface of the structural member 102 to the end of the nozzle 106 is divided and set at a predetermined width in the perpendicular direction to the surface of the structural member 102 for which the WJP is executed. The above predetermined width is, for example, 10 mm and each position (section) is set every 10 mm between the surface of the structural member 102 for which the WJP is executed and the end of the nozzle 106. The generation number of each shock wave (the each shock wave generation frequency) per unit time that is obtained at each position is inputted from the shock wave counting apparatus 124 to the display information preparation apparatus 125. Although the measurement width of the generation position of the shock wave is set at 10 mm, since the margin of the appropriate stand off range of WJP is wide, a sufficient stress improvement effect can be evaluated for an adjustment width of about 10 mm.

The display information preparation apparatus 125 prepares display information indicating the shock wave generation frequency at each position in the perpendicular direction to the surface of the structural member 102 for which the WJP is executed. The display information indicates the distribution of the shock wave generation frequency in the perpendicular direction to the surface of the structural member 102 and is displayed on a display portion 139 of the display apparatus 126 (refer to FIG. 17). The display information preparation apparatus 125 permits the above storage to store the information of the generation position of each shock wave, the generation frequency of the shock wave at each position, and the distribution of the shock wave generation frequency.

Whether there is an improvement effect of the residual stress for the WJP execution object or not is decided (step S104). The operator looks at the information (the distribution of the shock wave generation frequency in the perpendicular direction to the surface of the structural member 102) displayed on the display portion 139 of the display apparatus 126, thereby can decide whether the tensile residual stress existing in the structural member 102 is improved to compressive residual stress or not. When the distribution of the shock wave generation frequency displayed on the display portion 139 has the distribution shown in FIG. 20, the decision at the step S104 becomes "Yes", that is, "there is a sufficient improvement effect of the residual stress". In the of the distribution of the shock wave generation frequency shown in FIG. 20, there exists the peak 145 of the shock wave generation frequency close to the structural member 102 and the shock wave generation frequency at the generation frequency peak 145 becomes large. When the distribution of the shock wave generation frequency has a distribution that there exists the peak 146 of the shock wave generation frequency at the position close to the nozzle 106 as shown in FIG. 21, the decision at the step S104 becomes "No", that is, "the improvement effect of the residual stress is insufficient".

When the decision at the step S104 is "No", whether the confirmation of the change of the stand off is finished or not is decided (step S105). The operator decides whether the confirmation of the change of the stand off is finished or not. When the decision is "No", the stand off is changed (step S106). The operator inputs the changed coordinate value in the Z direction from the operation console 129 to change the stand off, for example, shorten the stand off. The nozzle scanning control apparatus 127 moves down the movement apparatus 112 based on the changed coordinate value in the Z direction and the end of the nozzle 106 is positioned to a predetermined position in the Z direction.

Thereafter, the water jet 134 is injected from the nozzle 106 and the process at the step S103 is executed by the signal processing apparatus 120. When the decision at the step S104 is "No" and the decision at the step S105 is "Yes", the operator judges that the condition for attaining the improvement effect of the residual stress cannot be found only by the change of the stand off. At this time, the operation condition of the high-pressure pump is changed (step S107). The operator operates the operation console 129 to change the operation condition of the high-pressure pump 105 (the set value of the discharge pressure of the high-pressure pump 105 (or the set value of discharge flow rate)). For example, the set value of the discharge pressure (or the discharge flow rate) is increased. The pump control apparatus 128 controls the high-pressure pump 105 based on the changed operation condition. Water increased in pressure by the high-pressure pump 105 is injected from the nozzle 106. When the process at the step S103 is executed and the decision at the step S104 becomes "Yes", the preparation for execution of the WJP is completed.

When the decision at the step S104 becomes "Yes", scanning of the nozzle is started (step S108). The nozzle 106 is scanned in a set direction. This scanning is executed by inputting nozzle a scanning start position (hereinafter, referred to as a scanning start position), a scanning direction (the X direction or the Y direction), and a nozzle scanning end position (hereinafter, referred to as a scanning end position) to the operation console 129 by the operator. The nozzle scanning control apparatus 127 outputs a scanning start signal to the corresponding movement apparatus (the movement apparatus 114 or the movement apparatus 119) when inputting the information from the operation console 129. For example, when the scanning direction inputted into the operation console 129 by the operator is the X direction, the movement apparatus 114 moves along the first arm 113 and permits the nozzle 106 to move from the scanning start position in the X direction to the scanning end position.

The scanning start signal outputted from the nozzle scanning control apparatus 127 is also inputted into the pump control apparatus 128. The pump control apparatus 128 drives the high-pressure pump 105 based on the scanning start signal. Therefore, while the nozzle 106 moves in the X direction due to the movement of the movement apparatus 114, the high-pressure water jet 134 is injected from the nozzle 106 toward the structural member 102. While the nozzle 106 moves in the X direction, the shock wave 136 generated due to collapse of the bubble 135 in the injected water jet 134 is impacted sequentially on the surface of the structural member 2. The nozzle 106 moves along one welding portion existing in the structural member 102 and extending in the X direction, so that by the shock wave 136, the tensile residual stress exiting close to the surface of the welding portion and heat heat-affected zone is improved to compressive residual stress.

The AE sensors 116A and 116B also move in the X direction together with the nozzle 106. The AE sensors 116A and 116B respectively detect the shock wave 136 during moving and output shock wave detection signals. These shock wave detection signals, described previously, are amplified by the amplifiers 118A and 118B and then are input into the A-D converter 121. The display information preparation apparatus 125 prepares shock wave detection signal display information for each of the AE sensors 116A and 116B based on a digital signal of each shock wave detection signal outputted from the A-D converter 121. The shock wave detection signal display information is displayed on the display portion 138 of the display apparatus 126 (refer to FIG. 17).

Furthermore, while the nozzle 106 injecting the water jet 134 moves, the generation position of the shock wave is calculated and the shock wave is counted (step S109). The process at the step S109 is executed by the time difference calculation apparatus 122, position calculation apparatus 123, shock wave counting apparatus 124, and display information preparation apparatus 125 of the signal processing apparatus 120 and the process is the same as the process at the step S103. The display information preparation apparatus 125 prepares display information indicating the shock wave generation frequency at each of the respective positions in the perpendicular direction to the surface of the structural member 102. This display information is displayed on the display portion 139 of the display apparatus 126.

When the nozzle reaches the scanning end position, the nozzle scanning is stopped (step S110). When the nozzle 106 reaches the aforementioned scanning end position in the X direction, the nozzle scanning control apparatus 127 outputs a stop signal to the movement apparatus 114. The movement apparatus 114 is stopped by the output of the stop signal and the scanning of the nozzle 106 in the X direction is finished. The nozzle scanning control apparatus 127 inputs an output signal of an encoder (not shown) installed on the movement apparatus 114 and decides that the nozzle 106 reaches the scanning end position in the X direction based on the output signal.

Whether there is an improvement effect of the residual stress for the WJP execution object or not is decided (step S111). The decision at the step S111 is executed similarly to the decision at Step S104. The operator looks at the information (the distribution of the shock wave generation frequency in the perpendicular direction to the surface of the structural member 102) displayed on the display portion 139 of the display apparatus 126, thereby decides whether the tensile residual stress existing in the structural member 102 is improved to compressive residual stress or not. When the decision at the step S111 becomes "Yes", the high-pressure pump 105 is stopped (step S114). The pump control apparatus 128 stops the high-pressure pump 105 based on the pump stop instruction inputted from the operation console 129 by the operator. By doing this, the execution of WJP along one welding portion formed on the structural member 102 is finished.

When the decision at the step S111 is "No", the stand off (or the operation condition of the high-pressure pump) is changed (step S112). The operator operates the operation console 129 to change the coordinate value of the nozzle 106 in the Z direction (or the operation condition of the high-pressure pump 105 (the set value of the discharge pressure or discharge flow rate of the high-pressure pump 105)). And, the nozzle scanning direction is changed to the opposite direction (step S113). The operator operates the operation console 126 to set the scanning end position in a certain direction (for example, the X direction) that is set at the step S108 to the scanning start position and the scanning start position set at the step S108 to the scanning end position.

Thereafter, the scanning at the step S108 is executed. The nozzle scanning control apparatus 127 moves the movement apparatus 114 in the opposite direction to the previous one based on the position information set at the step S113. The nozzle 106 injecting the high-pressure water jet moves from the scanning start position set at the step S113 to the scanning end position. When the nozzle 106 reaches the scanning end position, the scanning of the nozzle 106 is stopped (step S110). The operator looks at the distribution of the shock wave generation frequency displayed on the display portion 139 of the display apparatus 126 and executes the decision at the step S111. When this decision is "Yes", as mentioned above, the high-pressure pump 105 is stopped by the operation at the step S114.

In the structural member 102, when there exists another welding portion in the X direction and when there exists a welding portion also in the Y direction, the scanning start position and scanning end position are set sequentially at the step S108, for the respective welding portions and heat-affected zone and the WJP is executed sequentially. When the execution of the WJP for all the welding portions existing in the structural member 102 is finished, the execution of the WJP for the structural member 102 is finished.

In the present embodiment, while the nozzle 106 injects the high-pressure water jet 134, thus the shock wave 136 generated by collapsing the bubble 135 in the water jet 134 is impacted on the surface of the structural member 102, and the WJP is executed for the structural member 102, the AE sensors 116A and 116B detect the shock wave 136. The shock wave 136 is generated from the collapsed bubble 135 but not generated from the non-collapsed bubble 135. Therefore, in the present embodiment, the AE sensors 116A and 116B detect the bubble 135 generating the shock wave 136, that is, the bubble 135 contributing to the execution of WJP. The AE sensors 116A and 116B do not detect the non-collapsed bubble 135. The collapsed bubble 135 contributing to the execution of WJP is detected, thus the improvement effect of the residual stress of the structural member 102 can be confirmed more accurately.

Particularly, in the present embodiment, the generation position of each shock wave 136 in the perpendicular direction to the surface of the structural member 102 for which the WJP is executed is obtained based on the time difference T1 of the detection time of the shock wave 136 between the AE sensors 116A and 116B, and furthermore, the generation number of the shock waves is counted using the information of the generation position of each shock wave at the respective positions when the interval from the surface of the structural member 102 to the end of the nozzle 106 is divided in the perpendicular direction and set. Therefore, the shock wave generation frequency 136 can be obtained at the respective positions set in the perpendicular direction and the distribution of the shock wave generation frequency in the perpendicular direction can be confirmed. Consequently, the improvement effect of the residual stress existing in the structural member 102 can be confirmed more accurately based on the position in the perpendicular direction where the peak of the shock wave generation frequency is generated and the shock wave generation frequency at the peak position. If the peak position of the shock wave generation frequency exists near the structural member 102 and the shock wave generation frequency at the peak position is the set value or larger, in the structural member 102, there exists an improvement effect of the residual stress.

In the present embodiment, the improvement effect of the residual stress existing in the structural member 102 can be confirmed more accurately, so that when the improvement effect is insufficient, the operation condition of the stand off or high-pressure pump 105 is changed and the WJP can be re-executed immediately.

In the present embodiment, even while the nozzle 106 is scanned by injecting the water jet 134, the execution effect of WJP in the structural member 102 can be confirmed more accurately.

In the present embodiment, the AE sensors 116A and 116B are attached to the support member 117 mounted to the movement apparatus 119 instead of the nozzle 106. Therefore, the detection of an elastic wave by the AE sensors 116A and 116B based on the fluid vibration of high-pressure water including bubbles passing through the jet outlet of the nozzle 106 is extremely suppressed. This also contributes to more precise confirmation of the improvement effect of the residual stress in the WJP execution object.

Particularly, since the information of the distribution of the shock wave generation frequency in the perpendicular direction to the surface of the structural member 102 is displayed on the display apparatus 126, the operator can easily confirm the improvement effect of the residual stress in the WJP execution object.

The present embodiment can accurately confirm the improvement effect of the residual stress in the WJP execution object based on the shock wave generation frequency, so that the evaluation margin for confirming the improvement effect of the residual stress can be reduced. Therefore, in correspondence to the reduction in the margin, the capacity of the high-pressure pump 105 for feeding high-pressure water to the nozzle 106 can be downsized.

When the capacity of the high-pressure pump 105 is not downsized, the moving speed of the nozzle 106 can be increased in correspondence to the reduction in the margin. Therefore, the WJP execution time can be shortened more.

The nozzle scanning control apparatus 127 and pump control apparatus 128 may be unified to one control apparatus. The AE sensors 116A and 116B may be replaced with any of a pressure sensor, an acceleration sensor, and an underwater microphone.

Embodiment 5

Figure 22:
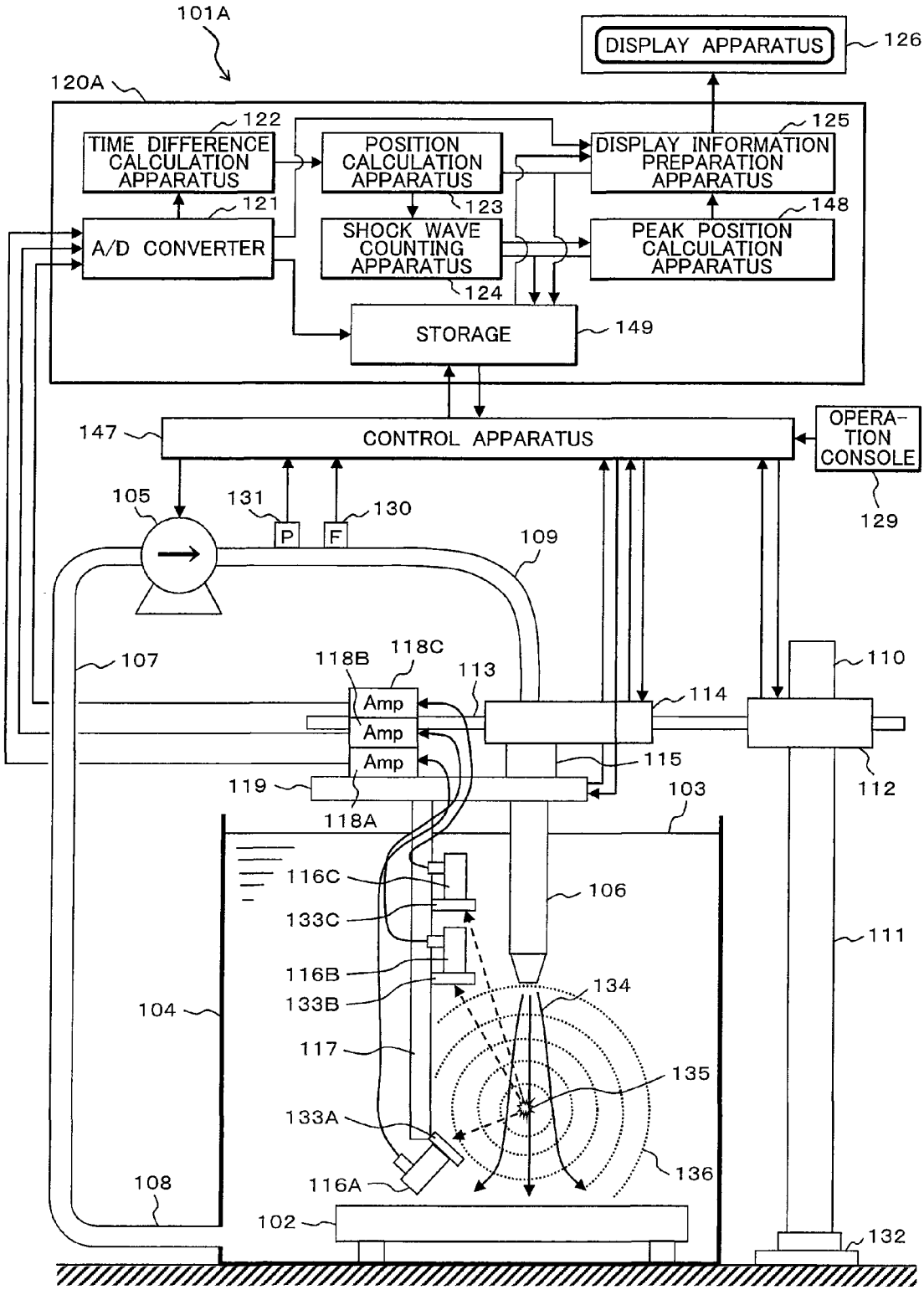
FIG. 22 is a structural diagram showing a water jet peening apparatus used in a water jet peening method according to embodiment 5 which is another embodiment of the present invention.
Figure 23:
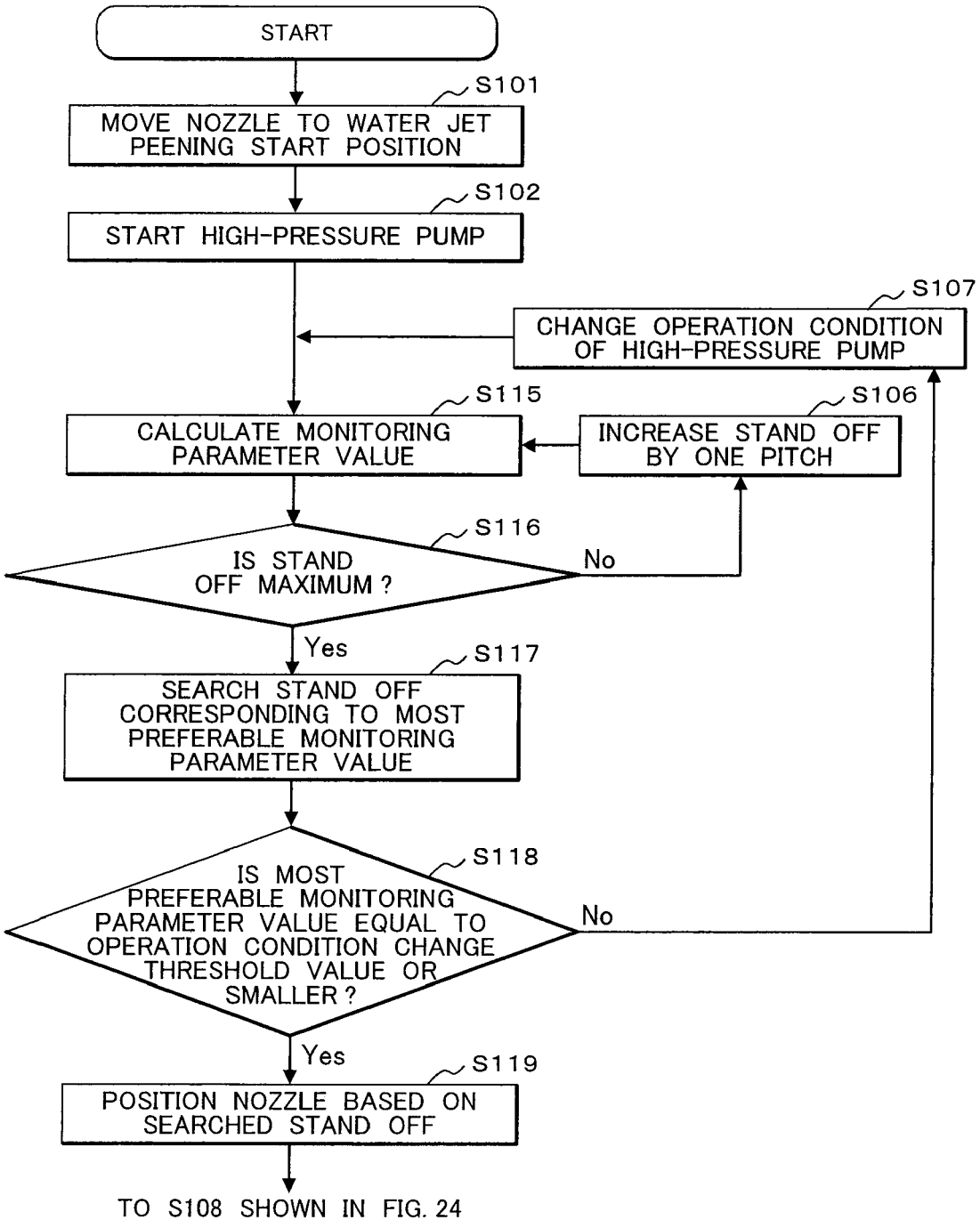
FIG. 23 is a flowchart showing a part of control and decision procedures when a water jet peening apparatus shown in FIG. 22 is used.
Figure 24:
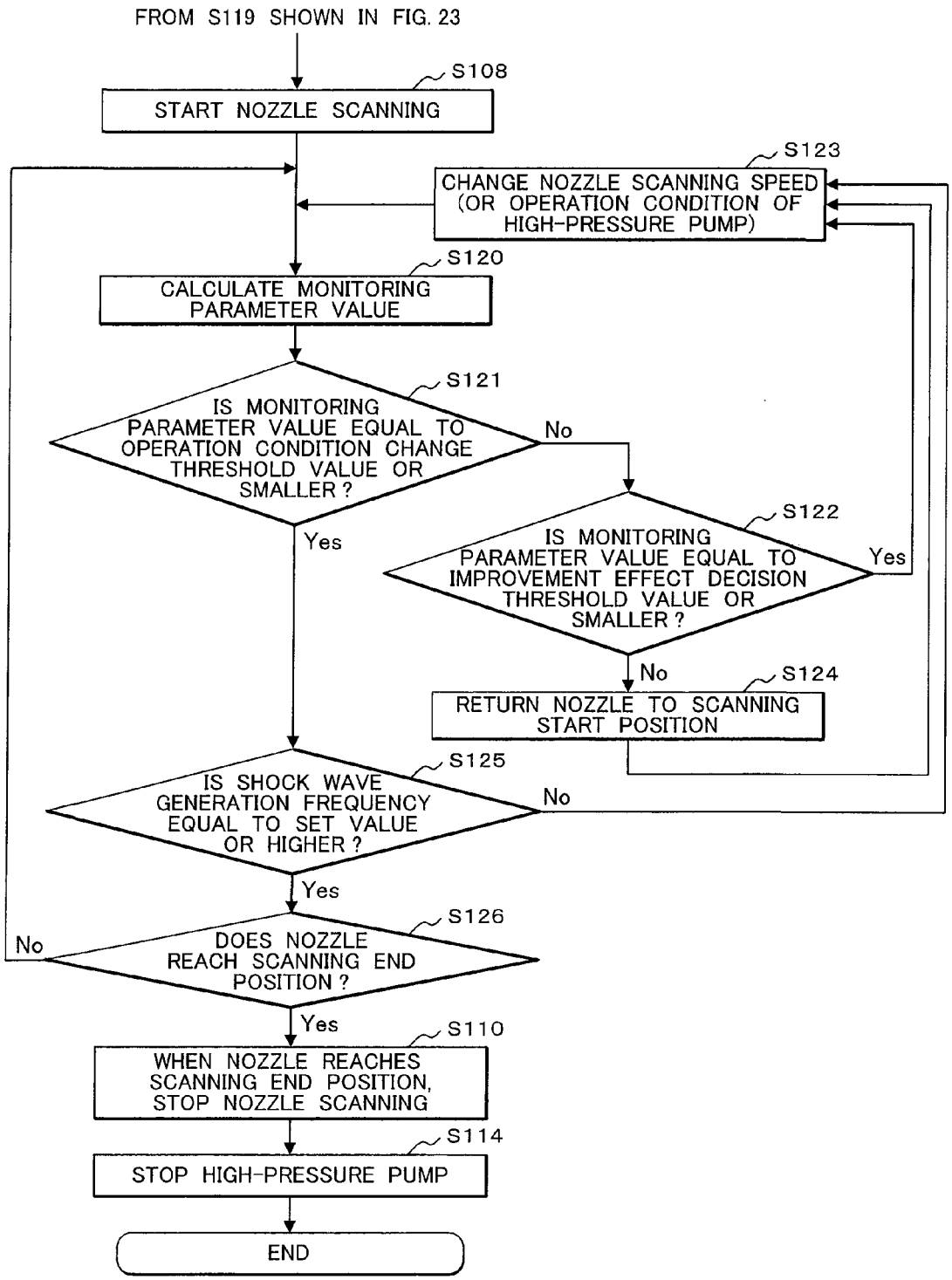
FIG. 24 is a flowchart showing remaining part of control and decision procedures when a water jet peening apparatus shown in FIG. 22 is used.

A water jet peening method according to embodiment 5 which is another embodiment of the present invention is explained by referring to FIGS. 22, 23, and 24.

Before explaining the water jet peening method according to the present embodiment, a WJP apparatus 101A used in the present embodiment is explained by referring to FIG. 22. In the WJP apparatus 101A, the signal processing apparatus 120 is replaced with a signal processing apparatus 120A in the WJP apparatus 101 used in embodiment 4 and the high-pressure pump 105 and nozzle scanning apparatus 110 are controlled automatically. In the present embodiment, one control apparatus 147 to which the nozzle scanning control apparatus 127 and pump control apparatus 128 which are used in embodiment 4 are unified is installed and three AE sensors and three amplifiers are installed. The other structure of the WJP apparatus 101A is the same as that of the WJP apparatus 101.

In the WJP apparatus 101A, a structure different from that of the WJP apparatus 101 is explained. The signal processing apparatus 120A has a structure that a peak position calculation apparatus 148 is added to the signal processing apparatus 120. The peak position calculation apparatus 148 is connected to the shock wave counting apparatus 124 and display information preparation apparatus 125. A storage 149 of the signal processing apparatus 120A is connected to the A-D converter 121, position calculation apparatus 123, shock wave counting apparatus 124, peak position calculation apparatus 148, and display information preparation apparatus 125.

The AE sensors 116A, 116B, and 116C are attached to the support member 117. The shock wave conversion plate 133C installed on the support member 117 is mounted in contact with the front of the AE sensor 116C. The AE sensor 116C is arranged at the position nearer the movement apparatus 119 than the AE sensor 116B. The AE sensors 116A, 116B, and 116C are connected separately to the amplifiers 118A, 118B, and 118C that are installed on the movement apparatus 119 and the amplifiers 118A, 118B, and 118C are connected to the A-D converter 121.

The control apparatus 147 is connected to the operation console 129 and storage 149. The control apparatus 147 is connected to the high-pressure pump 105, movement apparatuses 112, 114, and 119, flow meter 130, and pressure gauge 131. The control apparatus 147 stores beforehand a threshold value for changing the operation condition of the high-pressure pump 105 (hereinafter, referred to as a operation condition change threshold value), a threshold value for deciding the improvement effect of the residual stress (hereinafter, referred to as a improvement effect decision threshold value), maximum and minimum values of the stand off, and change pitch thereof in a storage (not shown) of the control apparatus 147. These values are inputted from the operation console 129 to the control apparatus 147 by the operator. The operation condition change threshold value and improvement effect decision threshold value are also stored in the storage 149 from the control apparatus 147.

In the water jet peening method according to the present embodiment, the control apparatus 147 executes the control or decision at each of the steps S101, S102, S106 to S108, S110, S114 to S119, and S121 to S126. The water jet peening method according to the present embodiment executed using the WJP apparatus 101A is explained based on the steps described in FIGS. 23 and 24.

The structure member 102 of the nuclear plant is installed in the water tank 104 filled with the water 103 and is disposed in the water 103. The structure member 102 is a structural member composing a plant, for example, a nuclear plant to be built. And, the WJP may be executed using the WJP apparatus 101A for the structural member 102 of a nuclear plant having experience in operation, in a pool filled with water positioned in the radiation controlled area of the nuclear plant. Before the control at the step S101 is executed, the operator inputs beforehand the scanning start position and scanning end position to the operation console 129 for the plurality of welding portions extending in the X direction (or the Y direction) which are formed in the structural member 102 installed in the water tank 104. Each information of the scanning start position and scanning end position that are input is stored in the storage of the control apparatus 147.

On the assumption that the WJP is executed for a certain welding portion extending, for example, in the X direction that is formed in the structural member 102, the method is explained. The control apparatus 147 starts the control at the step S101 when the operator inputs a WJP start instruction to the operation console 129. The movement apparatuses 112, 114, and 119 are driven by the control at the step S101 and the jet outlet of the nozzle 106 is positioned to the WJP start position for the welding portion extending in the X direction. At this time, the end of the nozzle 106 is separated from the surface of the structural member 102 subject to execution work of the WJP so as to minimize the stand off.

The control apparatus 147 executes the control at the step S102. The high-pressure pump 105 is driven and the high-pressure water jet 134 is injected from the nozzle 106. The respective shock waves 136 generated due to collapse of the respective bubbles 135 included in the water jet 134 are detected by the AE sensors 116A, 116B, and 116C.

After the high-pressure water jet 134 is injected from the nozzle 106, the signal processing apparatus 120A calculates a monitoring parameter (step S115). The monitoring parameter in the present embodiment is the peak position of the shock wave generation frequency and the operation condition change threshold value and improvement effect decision threshold value of the present embodiment are respectively the threshold value for the peak position of the shock wave generation frequency. The process contents at the step S115 is explained below in detail.

Figure 25:
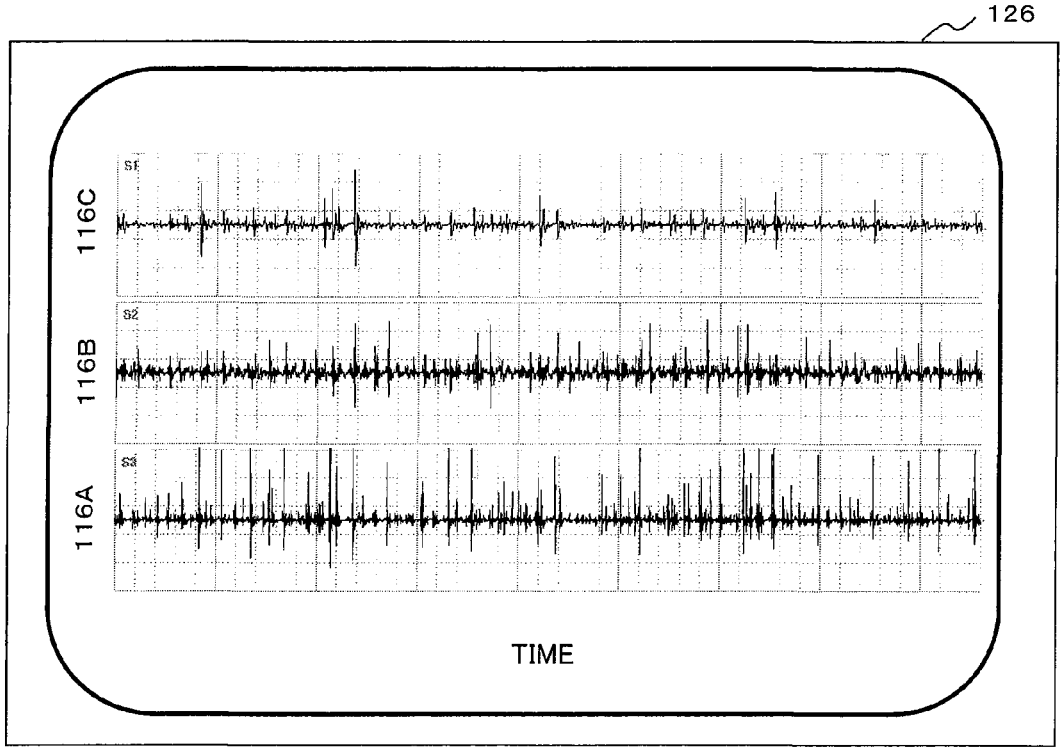
FIG. 25 is an explanatory drawing showing waveforms of shock waves detected by three AE sensors shown in FIG. 22.

The respective shock wave detection signals outputted from the AE sensors 116A, 116B, and 116C detecting the shock wave 136 are amplified by the amplifiers 118A, 118B, and 118C and then are inputted into the A-D converter 121. The A-D converter 121 converts the respective shock wave detection signals that are an analog signal to a digital signal and outputs the respective shock wave detection signals converted to a digital signal to the display information preparation apparatus 125. The display information preparation apparatus 125 prepares shock wave detection signal display information for each of the AE sensors 116A, 116B, and 116C based on the respective shock wave detection signals. The shock wave detection signal display information is displayed on the display apparatus 126 (refer to FIG. 25). In FIG. 25, "116A" indicates a shock wave detection signal outputted from the AE sensor 116A, and "116B" indicates a shock wave detection signal outputted from the AE sensor 116B, and "116D" indicates a shock wave detection signal outputted from the AE sensor 116C. In the shock wave detection signals, sharp waveform having a high pulse height generating unperiodically indicates the shock wave 136 generated when the bubble 135 is collapsed. The respective shock wave detection signals that are outputted from the A-D converter 121 and are converted to a digital signal are stored in the storage 149.

Figure 26:
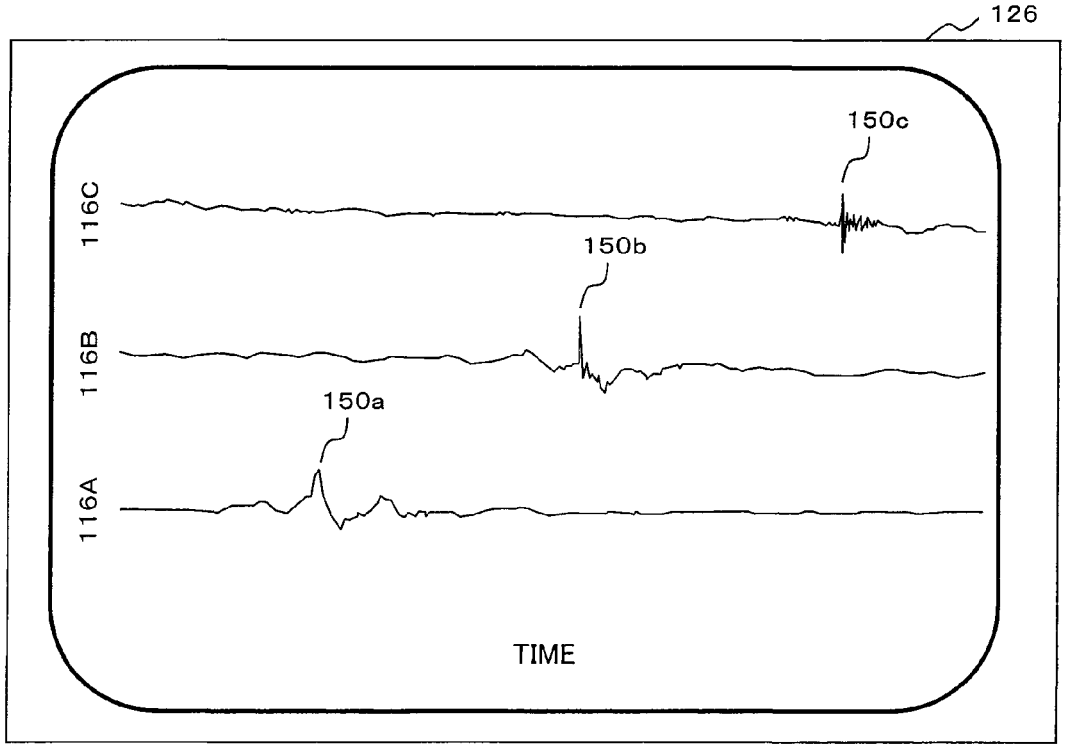
FIG. 26 is an enlarged view of waveform of each shock wave shown in FIG. 25.

FIG. 26 shows the portion of the sharp waveform having a high pulse height shown in FIG. 25 with the horizontal axis (the time axis) enlarged. A waveform 150*a* shown in FIG. 26 is included in the shock wave detection signal outputted from the AE sensor 116A when one shock wave 136 is detected. A waveform 150*b* is included in the shock wave detection signal outputted from the AE sensor 116B when the same one shock wave 136 is detected. A waveform 150*c* is included in the shock wave detection signal outputted from the AE sensor 116C when the same one shock wave 136 is detected. A time difference appears in the detection time between the waveforms 150*a*, 150*b*, and 150*c*, so that, as described later, the generation position of the one shock wave 136 can be identified.

The time difference calculation apparatus 122, based on the respective shock wave detection signals outputted from the A-D converter 121, calculates the time difference T1 between the detection time of a certain shock wave by the AE sensor 116B and the detection time of the certain shock wave by the AE sensor 116A (the time difference between the waveform 150*b* and the waveform 150*a*) and the time difference T2 between the detection time of the certain shock wave by the AE sensor 116C and the detection time of the certain shock wave by the AE sensor 116A (the time difference between the waveform 150*c* and the waveform 150*a*). The position calculation apparatus 123 substitutes the time differences T1 and T2, the coordinate value z1 (m) of the AE sensor 116A in the Z direction, the coordinate value z2 (m) of the AE sensor 116B in the Z direction, and the coordinate value z3 (m) of the AE sensor 116C in the Z direction into formula (7), and calculates the shock wave generation position z0 (refer to (B) shown in FIG. 19). The shock wave propagation speed Vz in the water 103 can be obtained by substituting the time differences T1 and T2 and the coordinate values Z2 and z3 into formula (8).

The shock wave counting apparatus 124 counts the generation number of shock waves by using the information of the generation position of each shock wave calculated by the position calculation apparatus 123, for the respective positions (sections) set in the perpendicular direction to the surface of the structural member 102 for which the WJP is executed. The peak position calculation apparatus 148 obtains a position where the shock wave generation frequency is maximized (hereinafter, referred to as a peak position) based on the generation number of each shock wave (each shock wave generation frequency) per unit time, which are obtained by the shock wave counting apparatus 124, at the respective positions that are set. Each information of the shock wave generation position calculated by the position calculation apparatus 123, the shock wave generation frequency, which are obtained by the shock wave counting apparatus 124, at the respective positions set, and at least one position where the shock wave generation frequency obtained by the peak position calculation apparatus 148 has the peak is stored in the storage 149.

Figure 27:
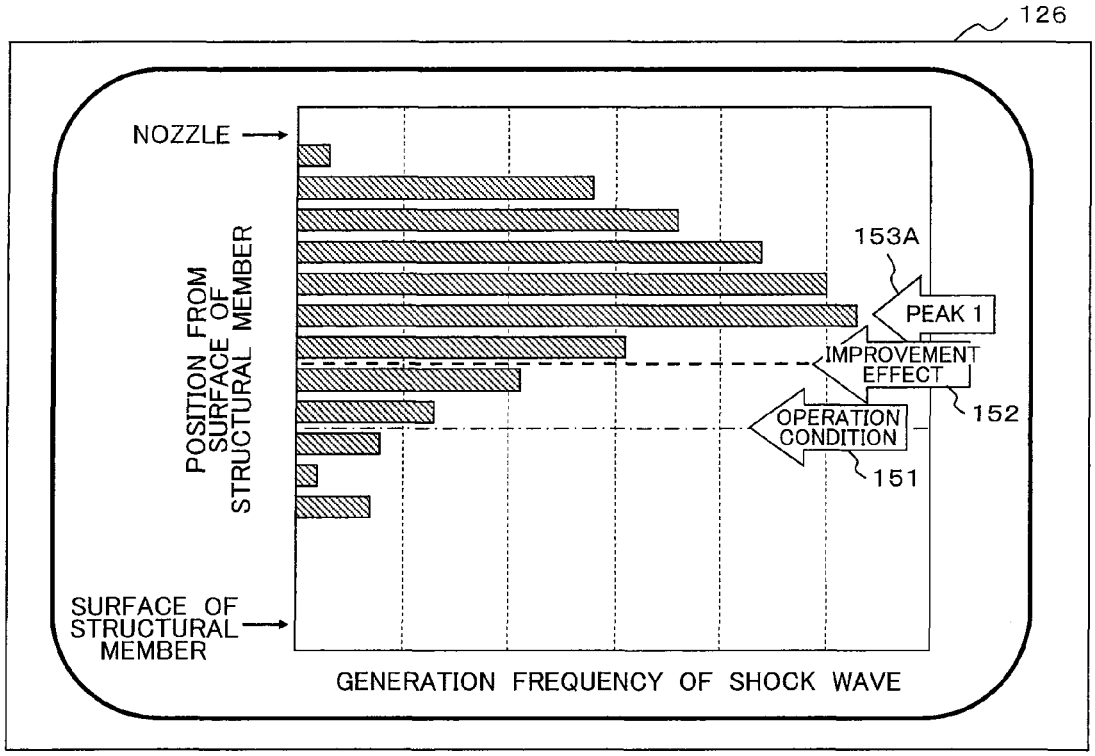
FIG. 27 is an explanatory drawing showing an example of display information showing generation frequency distribution, which is prepared by a display information preparation apparatus shown in FIG. 22, of shock wave in a state that stress improvement effect is insufficient.
Figure 28:
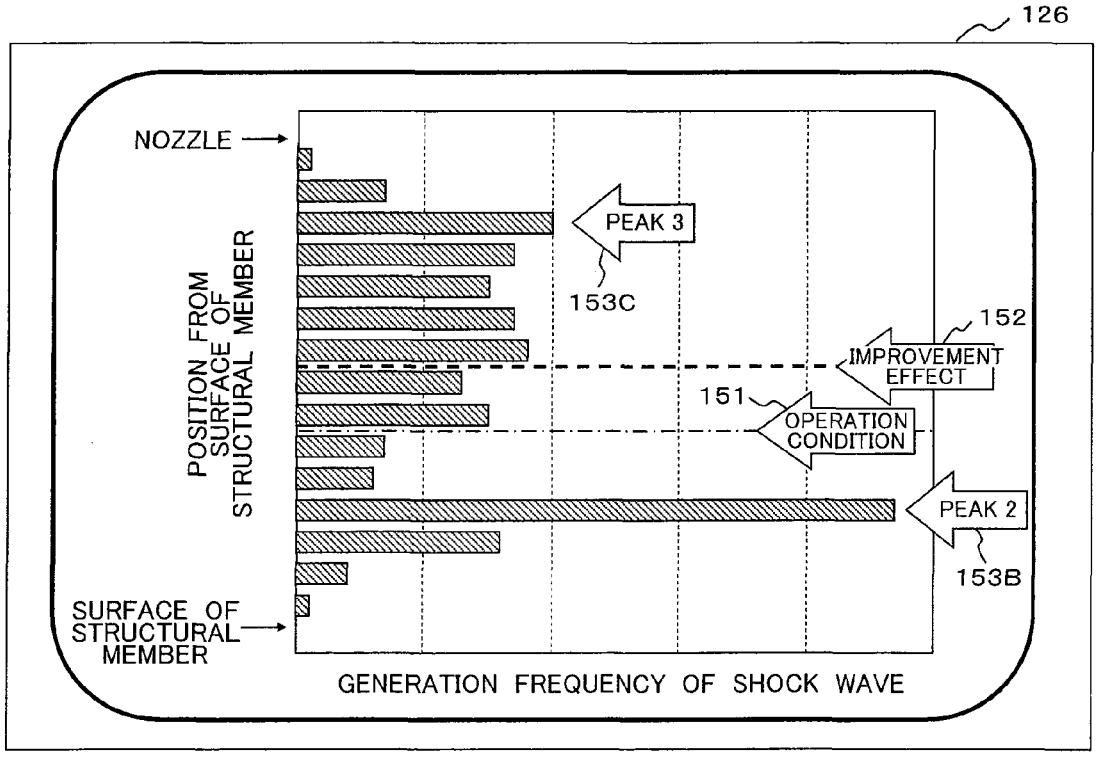
FIG. 28 is an explanatory drawing showing an example of display information showing generation frequency distribution, which is prepared by a display information preparation apparatus shown in FIG. 22, of shock wave in a state that stress improvement effect is obtained.

The display information preparation apparatus 125 prepares display information of the distribution of the shock wave generation frequency in the perpendicular direction to the surface of the structural member 102 for which the WJP is executed based on each information of the shock wave generation frequency at the respective positions set, the operation condition change threshold value and improvement effect decision threshold value, and the peak position obtained by the peak position calculation apparatus 148 fetched from the storage 149. The display information is displayed on the display apparatus 126 and is stored in the storage 149. An example of the display information displayed on the display apparatus 126 is shown in FIGS. 27 and 28. In the display information examples, an operation condition change threshold value 151 and an improvement effect decision threshold value 152 are included. The operation condition change threshold value 151 and improvement effect decision threshold value 152 used in the present embodiment correspond to the peak position of the shock wave generation frequency that is a monitoring parameter. Furthermore, the display information examples shown in FIGS. 27 and 28 include display symbols of the peak position of the shock wave generation frequency indicated by 153A, 153B, and 153C. The operator looks at the information displayed on the display apparatus 126, thereby can confirm the improvement effect of the residual stress in the structural member 102.

After the injection of the water jet 134 from the nozzle 106 at the step S102 is continued for a predetermined period of time, the control apparatus 147 decides whether the stand off is maximum or not (step S116). When this decision is "No", the stand off is increased by one pitch (step S106). The control apparatus 147 outputs a one-pitch increase command to the movement apparatus 112 based on the stored change pitch of the stand off. The movement apparatus 112 moves based on the one-pitch increase command and the end of the nozzle 106 is separated from the surface of the structural member 102 by one change pitch. The end of the nozzle 106 is intermittently separated from the surface of the structural member 102 until the stand off is maximized. Whenever the end of the nozzle 106 is separated from the surface of the structural member 102, the process at the step S115 is performed by the signal processing apparatus 120A. Each information obtained by the A-D converter 121, position calculation apparatus 123, shock wave counting apparatus 124, and peak position calculation apparatus 148 is stored in the storage 149 in correspondence to the stand off value.

When the decision at the step S116 is "Yes", the stand off when the monitoring parameter value becomes a most desirable value is searched (step S117). The most desirable monitoring parameter value, in the present embodiment, is the peak position of the shock wave generation frequency existing closest to the surface of the structural member 102. The control apparatus 147 searches the stand off (optimum stand off) corresponding to a most desirable monitoring parameter value, that is, a peak position of a most desirable shock wave generation frequency (a peak position of a shock wave generation frequency existing closest to the surface of the structural member 102) from the storage 149. Whether the most desirable monitoring parameter value is smaller than a operation condition change threshold value or not is decided (step S118). Whether the peak position of the shock wave generation frequency obtained by the peak position calculation apparatus 148 is smaller than the operation condition change threshold value or not is decided by the control apparatus 147. When this decision result is "No", "although the stress improvement effect is increased sufficiently, if the injection is continued under the condition, there are possibilities that the stress improvement effect may be changed to an insufficient state" is decided and the operation condition of the high-pressure pump is changed (step S107). The control apparatus 147 changes the set value of the operation condition of the high-pressure pump 105 (the discharge pressure of the high-pressure pump 105 (or discharge flow rate of the high-pressure pump 105)). The change of the set value is executed, for example, by adding an increase of one pitch to the current set value of the discharge pressure based on an increase of one pitch of the discharge pressure stored in the storage 149 and the value with the increase of one pitch added becomes a new set value. Thereafter, the process at the step S115 is performed and when the decision at the step S116 becomes "Yes", the steps S117 and S118 are executed.

When the decision at the step S118 becomes "Yes", the nozzle is positioned based on the searched stand off (step S119). The control apparatus 147 controls the movement apparatus 112 based on the searched stand off and positions the end of the nozzle 106 so as to separate from the surface of the structural member 102 by the searched stand off. Thereafter, the nozzle scanning is started (step S108). After the positioning of the end of the nozzle 106 is finished, the control apparatus 147 outputs the scanning start signal to the movement apparatus 114, for example, to execute work the WJP for the welding portion extending in the X direction. The movement apparatus 114 moves along the first arm 113 and the nozzle 106 is permitted to move from the scanning start position up to the scanning end position. The control apparatus 147 outputs the scanning start signal also to the high-pressure pump 105 to drive the high-pressure pump 105. Therefore, the nozzle 106 is moved in the X direction by injecting the water jet 134 toward the structural member 102. While the nozzle 106 moves in the X direction, the shock waves 136 generated due to collapse of the bubble 135 in the injected water jet 134 sequentially impact of the surface of the welding portion of the structural member 102. The tensile residual stress existing close to the surface of the welding portion and heat-affected zone is improved to compressive residual stress by the shock wave 136.

The AE sensors 116A, 116B, and 116C moving together with the nozzle 106 respectively detect the shock wave 129 thereof propagating in the water 103 and output a plurality of shock wave detection signals. Concretely, the AE sensor 116A detects a sound wave generated in the shock wave conversion plate 133A due to impact of the shock wave 136 and outputs a shock wave detection signal. The AE sensors 116B and 116C similarly output the shock wave detection signal.

While the nozzle 106 moves by injecting the water jet 134, the monitoring parameter value is calculated by the signal processing apparatus 120A (step S120). The process at the step S120 is the same as the process at the step S115, so that a detailed explanation is omitted. The respective shock wave detection signals outputted from the AE sensors 116A, 116B, and 116C are amplified by the amplifiers 118A, 118B, and 118C and then are input into the A-D converter 121. The time difference calculation apparatus 122 calculates the time differences T1 and T2 based on the respective shock wave detection signals converted to a digital signal. The position calculation apparatus 123 calculates the generation position of the shock wave similarly to the step S115 using the time differences T1 and T2. The shock wave counting apparatus 124 counts the generation number of shock waves by using the information of the calculated generation position of each shock wave, for the respective positions (sections) set in the perpendicular direction to the surface of the structural member 102 for which the WJP is executed. The peak position calculation apparatus 148 obtains the peak position of the shock wave generation frequency based on the generation frequency of each shock wave at the respective set positions. The display information preparation apparatus 125 prepares the display information of the distribution of the shock wave generation frequency similarly to the step S115 and outputs it to the display apparatus 126.

Whether the monitoring parameter value is the operation condition change threshold value or smaller or not is decided (step S121). While the nozzle 106 moves toward the scanning end position by injecting the water jet 134, the control apparatus 147 reads the newest peak position value from the storage 140 and decides whether the peak position value is the operation condition change threshold value or smaller or not is decided. For example, when the control apparatus 147 reads the peak position 153A shown in FIG. 27 from the storage 149, since the peak position 153A is larger than the operation condition change threshold value, the decision at the step S121 becomes "No". In this case, whether the monitoring parameter value is the improvement effect decision threshold value or smaller or not is decided (step S122). The decision at the step S122 made by the control apparatus 147 becomes "No" because the peak position 153A is larger than the improvement effect decision threshold value. The nozzle moves to the scanning start position (step S124). When the decision at the step S122 becomes "No", in the scanning process of the nozzle 106, it indicates that there is a part in the structural member 102 where the improvement effect of the residual stress is insufficient, that is, there is a part where the tensile residual stress is not sufficiently improved to compressive residual stress. Therefore, the nozzle 106 must be returned to the scanning start position for the welding portion subjected to the execution of WJP. The control apparatus 147 outputs a return command to the movement apparatus 114 when the decision at the step S122 becomes "No". The movement apparatus 114 inputting the command moves in the opposite direction and the nozzle 106 is returned to the scanning start position for the corresponding welding portion. After the nozzle 106 is returned to the scanning start position, the nozzle scanning speed (or the operation condition of the high-pressure pump) is changed (step S123). The control apparatus 147 outputs a deceleration command to the movement apparatus 114. The movement apparatus 114 moves so as to decrease the scanning speed of the nozzle 106 based on the deceleration instruction. Therefore, the number of shock waves impacting on the structural member 102 increases and the improvement effect of the residual stress existing in the structural member 102 increases. The control apparatus 147 may increase the discharge pressure of water (or the discharge flow rate of water) from the high-pressure pump 105 instead of the deceleration of the scanning speed of the nozzle 106. By doing this, the improvement effect of the residual stress of the structural member 102 increases.

At the step S124, the nozzle 106 is returned to the position slightly forward from the position at the point of time when the decision at the step S122 becomes "No" (the position where the peak position of the shock wave generation frequency is larger than the improvement effect decision threshold value) instead of the scanning start position of the nozzle 106, and the scanning speed of the nozzle 106 is decreased from this position, thus the WJP may be resumed.

When the decision at the step S122 is "Yes", the control at the step S123 is executed by the control apparatus 147.

When the scanning speed of the nozzle 106 is decreased, the signal processing apparatus 120A executes the process at the step S120. It is assumed that when executing the decision at the step S121, the control apparatus 147, for example, reads the peak positions 153B and 153C shown in FIG. 28 from the storage 149. These peak positions are a peak position that the shock wave generation frequency becomes a maximum. When there exist a plurality of peak positions, if the peak position closet to the structural member 102, that is, the peak position 153B shows the operation condition change threshold value or smaller, the decision at the step S121 becomes "Yes". Therefore, the decision at the step S121 by the control apparatus 147 becomes "Yes". If there exists a peak position of the shock wave showing the operation condition change threshold value or smaller, it means that many shock waves are generated close to the surface of the structural member 102 and the improvement effect of the residual stress of the structural member 102 is high.

When the decision at the step S121 is "Yes", whether the shock wave generation frequency is the set value or higher is decided (step S125). The control apparatus 147 decides whether the shock wave generation frequency at the peak position of the shock wave generation frequency which is stored in the storage 149 is the set value or higher. The set value is a set value of the shock wave generation frequency (hereinafter, referred to as a first set value of the shock wave generation frequency) for changing the operation condition of the high-pressure pump 105 which is larger than a set value of the shock wave generation frequency (hereinafter, referred to as a second set value of the shock wave generation frequency) for deciding the improvement effect of the residual stress. The shock wave generation frequency at the peak position of the shock wave generation frequency is obtained by counting the generation number of shock waves at the respective positions set in the perpendicular direction to the surface of the structural member 102 by the shock wave counting apparatus 124.

At the step S125, it is possible to use the generation frequency of shock waves generated between the position of the improvement effect decision threshold value 152 and the surface of the structural member 102 instead of the shock wave generation frequency at the peak position of the shock wave generation frequency and compare the shock wave generation frequency with the first set value of the shock wave generation frequency corresponding to it. The generation frequency of the shock wave generated between the position of the improvement effect decision threshold value 152 and the surface of the structural member 102 is obtained by counting the generation number of shock waves generated between the position of the improvement effect decision threshold value 152 and the surface of the structural member 102 by the shock wave counter 124.

Figure 29:
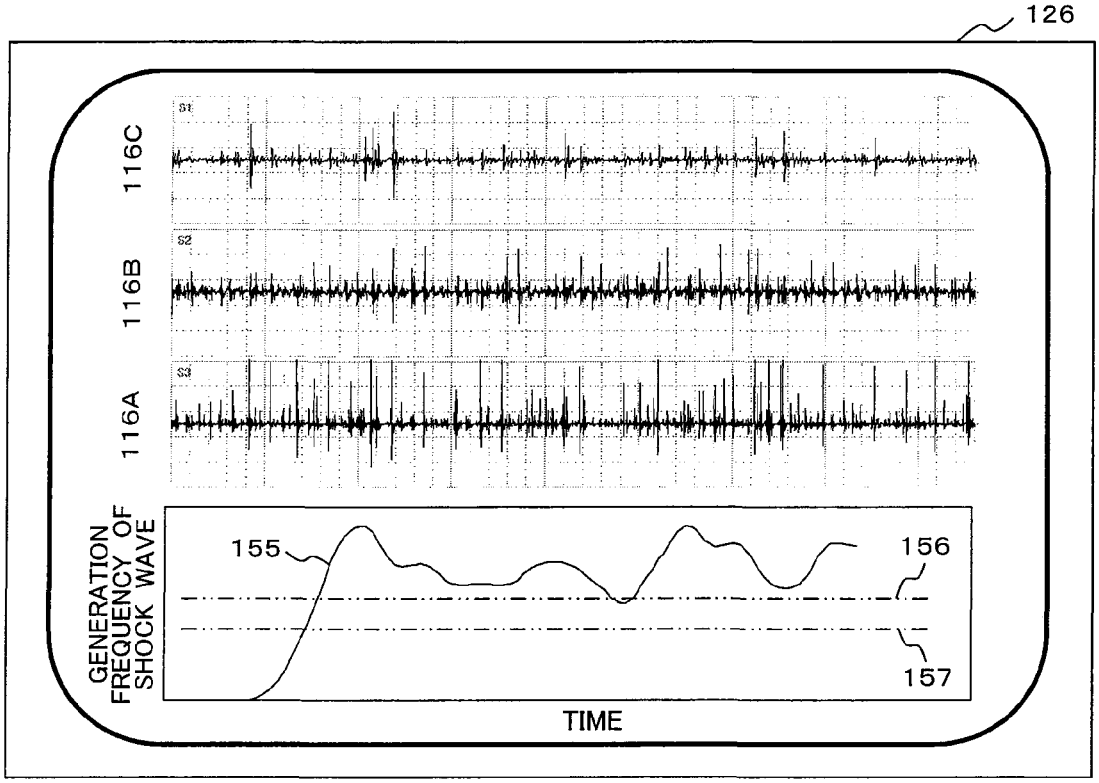
FIG. 29 is an explanatory drawing showing changes in generation frequency of shock wave when a water jet peening method according to embodiment 4 is executed.

As shown in FIG. 29, when a shock wave generation frequency 155 at the peak position of the shock wave generation frequency becomes smaller than a first set value 156 of the shock wave generation frequency, the decision at the step S125 becomes "No". The decision at the step S125 is executed while the nozzle 106 moves toward the scanning end position. A numeral 157 shown in FIG. 29 indicates the second value of the shock wave generation frequency. When the decision at the step S125 becomes "No", "although the stress improvement effect is increased sufficiently, if the injection is continued under the condition, there are possibilities that the stress improvement effect may be changed to an insufficient state" is decided, and the control at the step S123 is executed, and the moving speed of the movement apparatus 114 is decreased. The discharge pressure (or the discharge flow rate) of the high-pressure pump 105 may be increased instead of the decrease in the moving speed. By slowing the moving speed of the movement apparatus 114, that is, the scanning speed of the nozzle 106, the generation number of shock waves per a unit movement distance of the nozzle 106 is increased and substantially, it is equivalent to the increase in the shock wave generation frequency.

When the decision result at the step S125 is "Yes", the control apparatus 147 decides whether the nozzle reaches the scanning end position or not (step S126). When the decision at the step S126 is "No", it is decided that the nozzle scanning is continued and the decision or control at the step S121 and the subsequent steps is executed by the control apparatus 147. When the nozzle reaches the scanning end position and the decision at the step S126 becomes "Yes", the control at the step S110 is executed.

When the nozzle reaches the scanning end position, the nozzle scanning is stopped (step S110). The control apparatus 147 outputs a drive stop signal to the motor when deciding that the nozzle 106 reaches the scanning end position of one welding portion extending in the X direction based on an output signal from an encoder installed on a motor (not shown) for moving the movement apparatus 114, stops the movement of the movement apparatus 114, and stops the scanning of the nozzle 106.

The high-pressure pump is stopped (step S114). The drive stop signal outputted from the control apparatus 147 is inputted into to the high-pressure pump 105 and the high-pressure pump 105 is stopped. By doing this, the WJP execution for the structural member 102 along one welding portion in the X direction is finished. The tensile residual stress exiting close to the surface of the welding portion and heat-affected zone is improved to compressive residual stress by the WJP execution.

When there exists another welding portion in the structural member 102, as mentioned above, the WJP is executed for the welding portion.

In the present embodiment, the effects attained in embodiment 4 can be obtained. The present embodiment, not by the operator but by the control apparatus 147, can automatically control the respective movement apparatuses and high-pressure pump 105 of the WJP apparatus 101A, so that the burden imposed on the operator during the execution of WJP is lightened. Furthermore, in the present embodiment, since the improvement effect of the residual stress existing in the structural member 102 can be confirmed more accurately, the stand off is changed slightly, thus the residual stress can be improved. Therefore, the stand off is set to an optimum value and the WJP can be executed.

Embodiment 6

Figure 30:
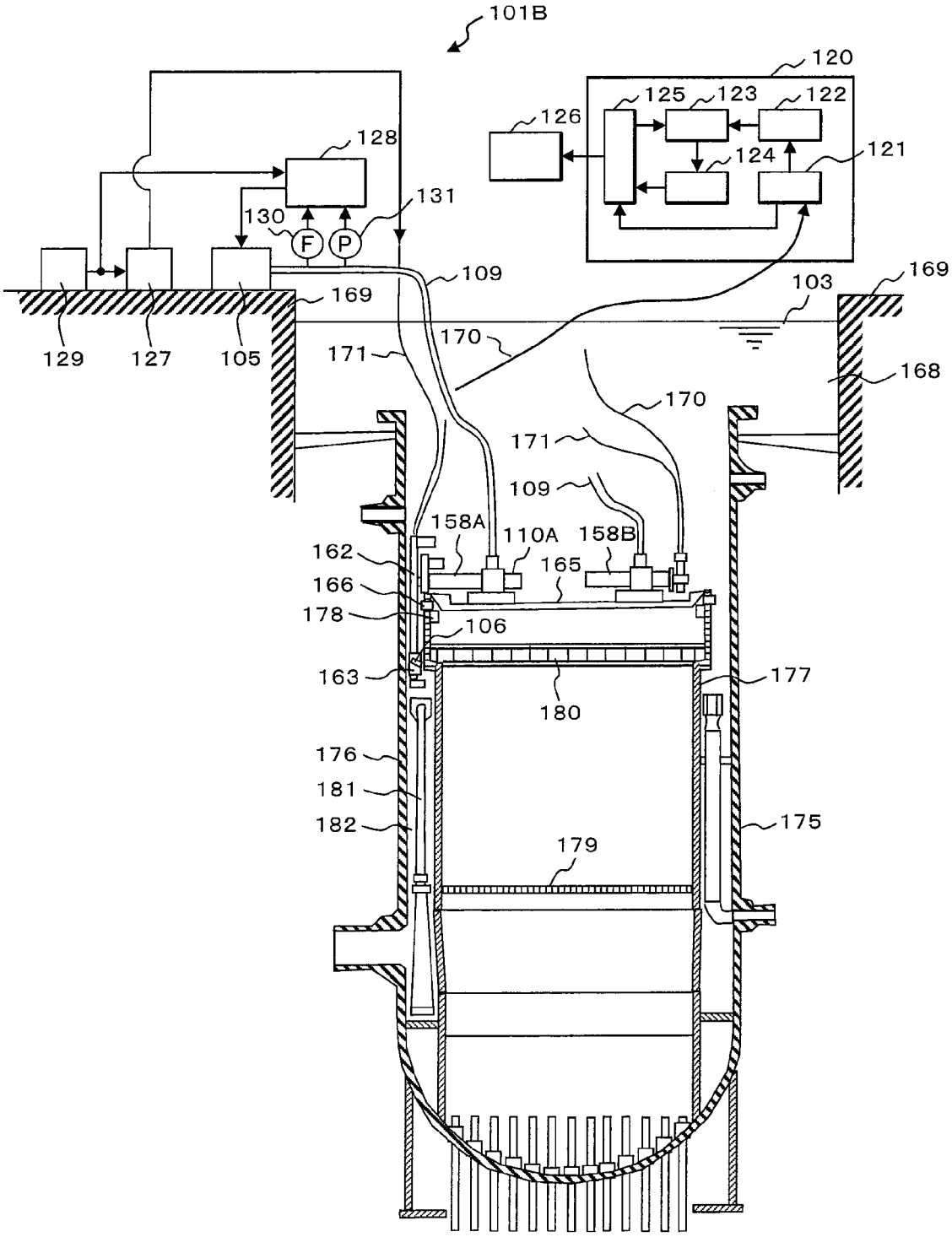
FIG. 30 is a structural diagram showing a water jet peening apparatus used in a water jet peening method according to embodiment 6 which is another embodiment of the present invention.

A water jet peening method according to embodiment 6 which is another embodiment of the present invention is explained by referring to FIGS. 30. 31, 32, and 33. The water jet peening method according to the present embodiment is executed, for example, for an object of the reactor internal installed in the reactor pressure vessel of a boiling water nuclear plant. The reactor internal is, for example, the core shroud.

The structure of the vicinity of the nuclear reactor of the boiling water nuclear plant is explained by referring to FIG. 30. A nuclear reactor 175 of the boiling water nuclear plant is provided with a reactor pressure vessel (hereinafter, referred to as RPV) 176, a core shroud 177, a core support plate 179, an upper grid plate 180, and a jet pumps 181. The core shroud 177, core support plate 179, upper grid plate 180, and jet pumps 181 are installed in the RPV 176. In the core shroud 177 surrounding the core, the core support plate 179 positioned at the lower end of the core is installed and the upper grid plate 180 positioned at the upper end of the core is installed. A plurality of jet pumps 181 are arranged in a circular down corner 182 formed between the RPV 176 and the core shroud 177.

A WJP apparatus 101B used in the water jet peening method according to the present embodiment, has a structure that the nozzle scanning apparatus 110 is replaced with a nozzle scanning apparatus 110A in the WJP apparatus 101 used in the embodiment 4. The other structure of the WJP apparatus 101B is the same as that of the WJP apparatus 101.

Figure 31:
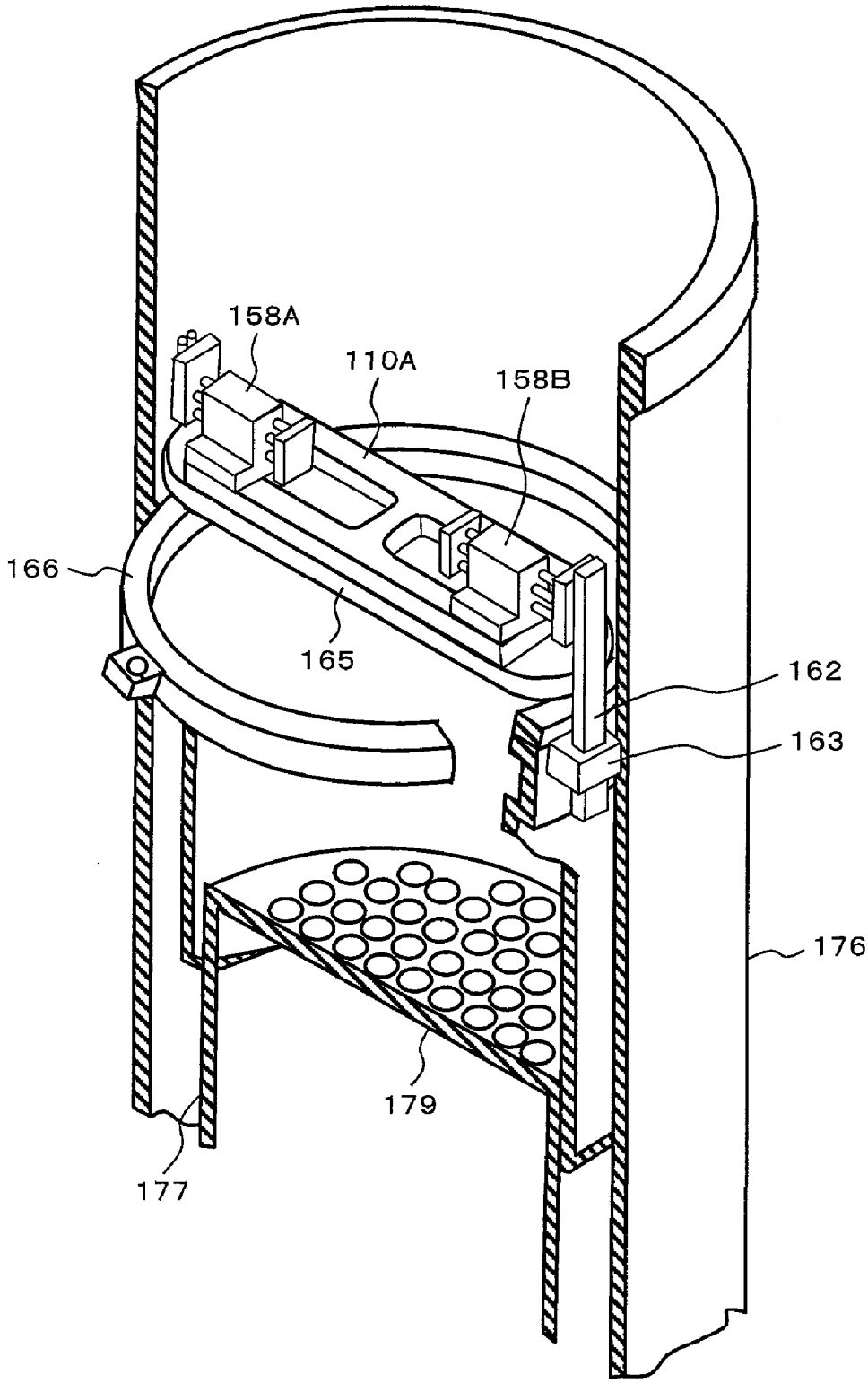
FIG. 31 is a perspective view showing a water jet peening apparatus shown in FIG. 30 in the close to a turn table.
Figure 32:
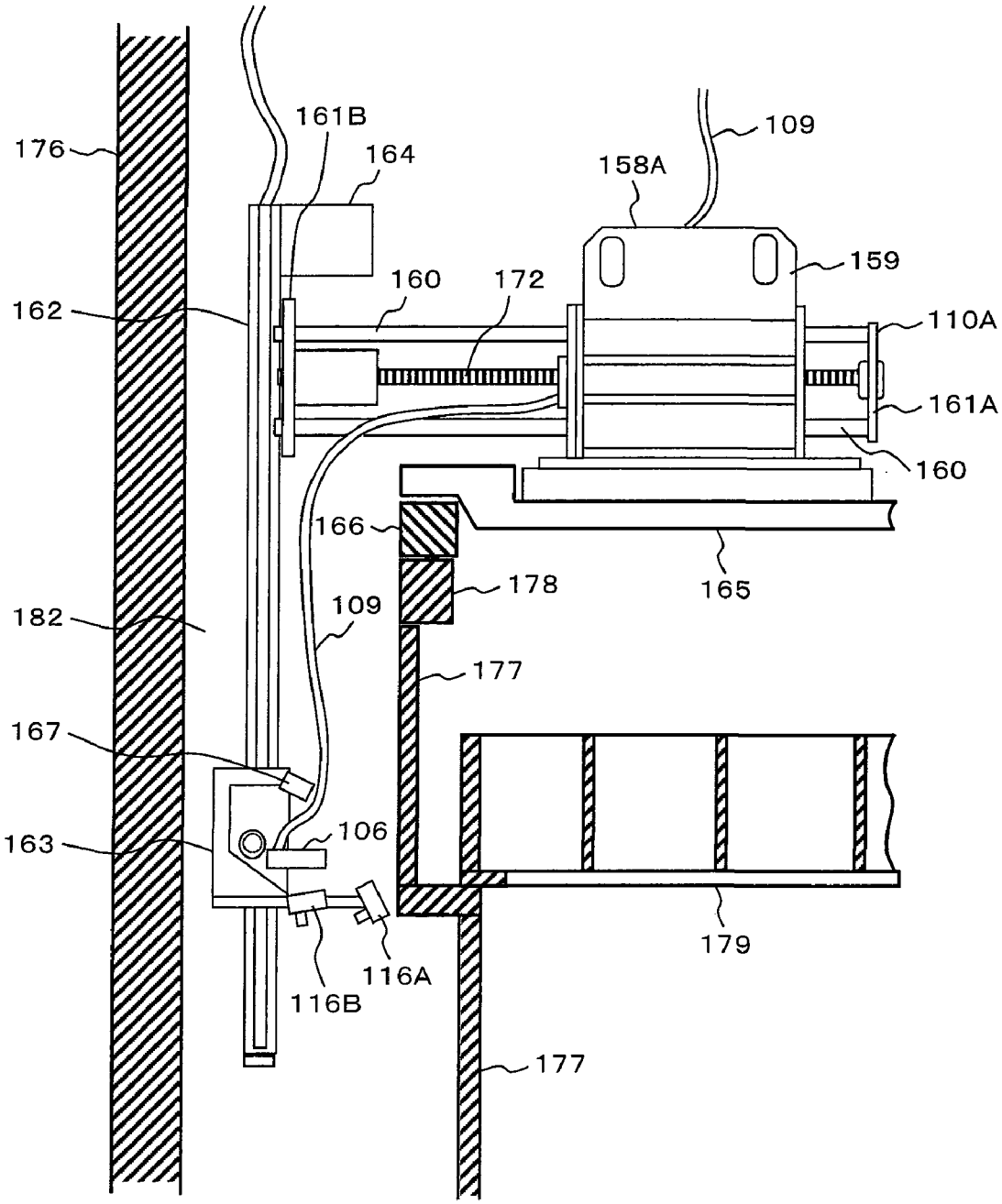
FIG. 32 is an enlarged view showing a movement apparatus to which a nozzle of a water jet peening apparatus shown in FIG. 30 is mounted.

The nozzle scanning apparatus 110A is explained below. The nozzle scanning apparatus 110A has movement apparatuses 158A and 158B, a post member 162, an elevator 163, and a turn table 165 as shown in FIGS. 30, 31, and 32. The turn table 165 is installed rotatably in a circular guide rail 166 installed on a top surface of an upper flange 178 of the core shroud 177. Although not shown, in the turn table 165, a plurality of wheels in contact with a top surface of the guide rail 166 are installed. A motor (not shown) for rotating at least one wheel (not shown) is installed in the turn table 165. The movement apparatuses 158A and 158B are installed on the turn table 165.

With respect to the movement apparatuses 158A and 158B having the same structure, the movement apparatus 158A is explained as an example. The movement apparatus 158A has an apparatus body 159, two arms 160, and a ball screw 172 as shown in FIG. 32. The two arms 160 pass through a casing of the apparatus body 159 and are attached slidably to the casing. Both ends of the two arms 160 are connected by connection members 161A and 161B. The ball screw 172 passing through the casing of the apparatus body 159 is attached rotatably to the connection members 161A and 161B. In the casing of the apparatus body 159, although not shown, a motor is installed and a gear (not shown) attached to a rotary shaft of the motor engages with a gear (not shown) engaged with the ball screw 172. The gears rotate by driving the motor and the ball screw 172 moves in the radial direction of the RPV 176. The post member 162 extending in an axial direction of the RPV 176 is attached to the connection member 161B. The elevator 163 is attached to the post member 162 so as to be able to move along the post member 162. A motor 164 for moving the elevator 163 vertically is installed at an upper end of the post member 162.

A nozzle 106, AE sensors 116A and 116B, and a monitor camera 167 are installed on the elevator 163.

In the present embodiment, the WJP is executed for an outside surface at an upper end of the core shroud 177. In the present embodiment, the core shroud 177 is a WJP execution object. After the operation of the boiling water nuclear plant is stopped, an upper cover (not shown) of the RPV 176 is removed, and the dryer and separator installed in the RPV 176 are removed and transferred outside the RPV 176. The transfer is executed using a ceiling crane (not shown) in the nuclear reactor building where the RPV 176 is installed. When removing and transferring the dryer and separator, a nuclear reactor well 168 positioned right above the RPV 176 is filled with the water 103.

The guide rail 166 is moved onto an upper flange 178 using the ceiling crane and is installed on the upper flange 178. The turn table 165 where the movement apparatuses 158A and 158B are installed is conveyed by the ceiling crane and are installed on the guide rail 166. The post member 162 with the elevator 163 mounted is installed in the respective movement apparatuses 158A and 158B before the turn table 65 is conveyed. When the turn table 165 is installed on the guide rail 166, the post members 162 installed in the respective movement apparatus s 158A and 158B are disposed in the down corner 182.

A high-pressure pump 105 and operation console 129 are placed on an operation floor 169 in the nuclear reactor building and a signal processing apparatus 120, nozzle scanning control apparatus 127, pump control apparatus 128, and display apparatus 126 are installed on the operation console 129. The operation floor 169 surrounds the nuclear reactor well 168. The two high-pressure hoses 109 connected to the high-pressure pump 105 are respectively attached to the movement apparatuses 158A and 158B and are separately connected to the nozzle 106 installed on the movement apparatus 158A and the nozzle 106 installed on the movement apparatus 158B.

Figure 33:
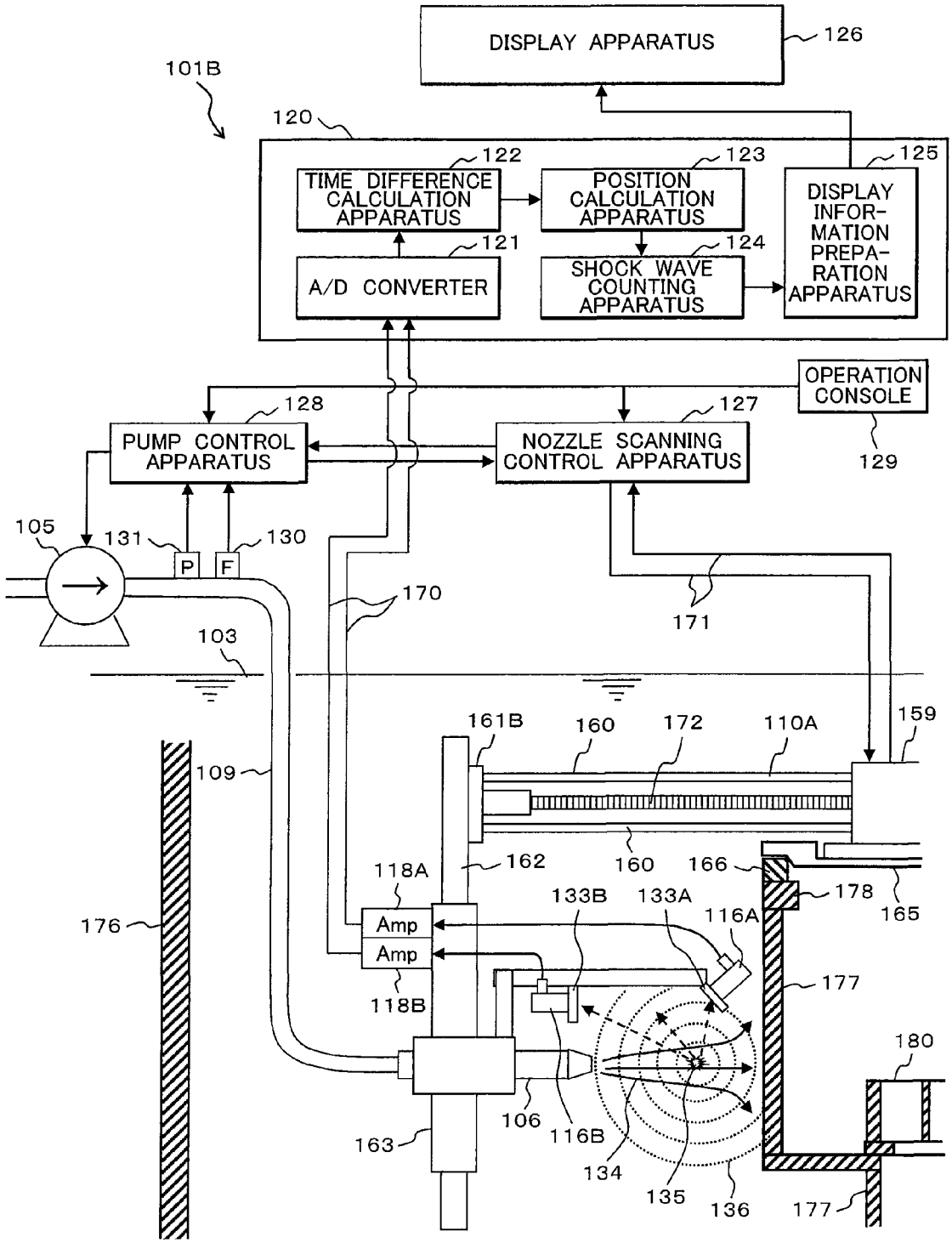
FIG. 33 is an enlarged view showing a water jet peening apparatus shown in FIG. 30 in the close to the nozzle.

In the movement apparatus 158A, the waterproofed amplifiers 118A and 118B are installed on the elevator 163 (refer to FIG. 33). The AE sensors 116A and 116B installed on the elevator 163 of the movement apparatus 158A are connected separately to the amplifiers 118A and 118B. Two signal lines 170 separately connected to the amplifiers 118A and 118B are connected to the A-D converter 121 of one signal processing apparatus 120. The display information preparation apparatus 125 of the signal processing apparatus 120 is connected to the display apparatus 126.

Also in the movement apparatus 158B, the waterproofed amplifiers 118A and 118B are installed on the elevator 163. The AE sensors 116A and 116B installed on the elevator 63 of the movement apparatus 158B are connected separately to the amplifiers 118A and 118B. The two signal lines 170 separately connected to the amplifiers 118A and 118B are connected to the A-D converter 121 of another signal processing apparatus 120. The display information preparation apparatus 125 of the signal processing apparatus 120 is connected to another display apparatus 126.

Control signal lines 171 connected to the nozzle scanning control apparatus 127 are separately connected to motors 164 respectively installed on the movement apparatuses 158A and 158B, a motor installed in the casing of the apparatus body 159, and a motor for rotating the wheels of the turn table 165 installed in the turn table 165. Each of the motors is equipped with an encoder (not shown) and each encoder detects the movement distance of the member moved by the motor, that is, the position of the member after movement.

Also in the water jet peening method according to the present embodiment each operation or process shown in FIG. 16 is executed similarly to the embodiment 4. In the core shroud 177, the welding portions extending in the axial direction exist at a plurality of portions in the peripheral direction of the core shroud 177 and the welding portions extending in the peripheral direction exist at a plurality of portions in the axial direction of the core shroud 177. In the present embodiment, the WJP is executed along these welding portions.

For example, it is assumed that the WJP is executed along certain welding portion extending in the peripheral direction of the core shroud 177. At the step S101, each nozzle 106 installed in the movement apparatuses 158A and 158B is moved to the WJP start position. The operator inputs the position information in each of the peripheral direction, axial direction, and radial direction of the core shroud 177 from the operation console 129. The control apparatus 127 drives the three motors installed in the WJP apparatus 101B based on the aforementioned position information and positions the nozzle 106 to the scanning start position designated to face one welding portion aforementioned. The ball screw 172 rotates by the drive of the motor installed in the apparatus body 159 of each of the movement apparatuses 158A and 158B and each of the post members 162 moves in the radial direction of the core shroud 177. By the movement of the post members 162, the distance between the nozzle 106 and the outside surface of the core shroud 177 that is the WJP execution surface, that is, the stand off is set to a set value. The elevator 163 moves in the axial direction of the core shroud 177 along the post members 162 by driving of the motor 164 and the nozzle 106 is positioned to a predetermined position in the axial direction of the core shroud 177.

Thereafter, the operation at the step S102 is executed. The high-pressure pump 105 is driven by a command from the pump control apparatus 28 and pressurized high-pressure water is supplied to the nozzles 106 installed in the movement apparatuses 158A and 158B through the high-pressure hose 109. The high-pressure water is injected toward the outside surface of the welding portion of the core shroud 177 close to the upper grid plate 180 from each of the nozzles 106 at the pressure and flow rate of the initial values. The shock wave 136 generated due to collapse of the bubble 135 included in the injected water jet 134 is detected by the AE sensors 116A and 116B. The shock wave detection signals respectively outputted from the AE sensors 116A and 116B by the detection of the shock wave is input into the A-D converter 121. In each of the signal processing apparatuses 120, the process at Step S103 is executed similarly to the embodiment 4. The display information, which is prepared by the display information preparation, indicating the shock wave generation frequency at the respective positions in the perpendicular direction to the surface of the structural member 102 is displayed on the display apparatus 126.

The decision at the step S104 is executed by the operator similarly to Embodiment 4. When the decision at the step S104 is "No", "the improvement effect of the residual stress is insufficient" is decided and the decision at the step S105 is executed. When this decision is "No", the change of the stand off at the step S106 is executed. The operator inputs the changed coordinate value of the RPV 176 in the radial direction from the operation console 129 to change the stand off, that is, to shorten the stand off. The nozzle scanning control apparatus 127 drives the motor installed in the apparatus body 159 based on the coordinate value in the radial direction, thereby rotates the ball screw 172. By doing this, the nozzle 106 is moved in the radial direction of the RPV and positioned in the radial direction.

When the decision at the step S105 is "Yes", the discharge pressure (or the discharge flow rate) of the high-pressure pump 105 is increased at the step S107.

At the step S103, the generation number of shock waves is counted by using the information of the generation position of each shock wave calculated, for the respective positions (sections) set in the perpendicular direction to the outside surface of the core shroud 177 for which the WJP is executed and display information of distribution of the shock wave generation position is prepared in the perpendicular direction to the outside surface of the core shroud 177. The display information is displayed on the display apparatus 126. When the decision at the step S104 becomes "Yes", the nozzle scanning is started (step S108).

Each of the nozzles 106 installed on the movement apparatuses 158A and 158B moves along the certain welding portion extending in the peripheral direction of the core shroud 177 by injecting high-pressure water. The movement is executed by rotating the turn table 165 along the guide rail 166 under the control by the nozzle scanning control apparatus 127. The WJP is executed for the welding portion and heat-affected zone. In the present embodiment, the two nozzles 106 are positioned in the opposite directions of 180°, so that when the nozzles 106 move, for example, at an angle of 190° in the peripheral direction, the control at the step S110 is executed and the scanning of the nozzles 106 is stopped. While the nozzles 106 are scanned in the peripheral direction of the core shroud 177, the process at the step S109 is performed by the respective signal processing apparatuses 120.

The decision at the step S111 is executed based on the display information of the distribution of the shock wave generation frequency obtained by the process at the step S109 and displayed on the display apparatus 126. When the decision at the step S111 is "No", "the improvement effect of the residual stress is insufficient" is decided and the control at the step S112 is executed by the nozzle scanning control apparatus 127 based on the stand off (or the operation condition of the high-pressure pump 105) which is changed from the operation console 129 by the operator. And, the nozzle scanning direction is changed to the opposite direction (step S113). The operator operates the operation console 129 to set the scanning end position in a certain direction (for example, the peripheral direction) that is set at the step S108 to the scanning start position and the scanning start position set at the step S108 to the scanning end position. Thereafter, the scanning at the step S108 is executed in the opposite direction. When the nozzle 106 reaches the scanning end position, the scanning of the nozzle 106 is stopped (step S110).

Even for another welding portion formed on the core shroud 177 in the peripheral direction and a welding portion formed on the core shroud 177 in the axial direction, the WJP is executed similarly.

The present embodiment can obtain the respective effects attained in Embodiment 4.

Embodiment 7

Figure 34:
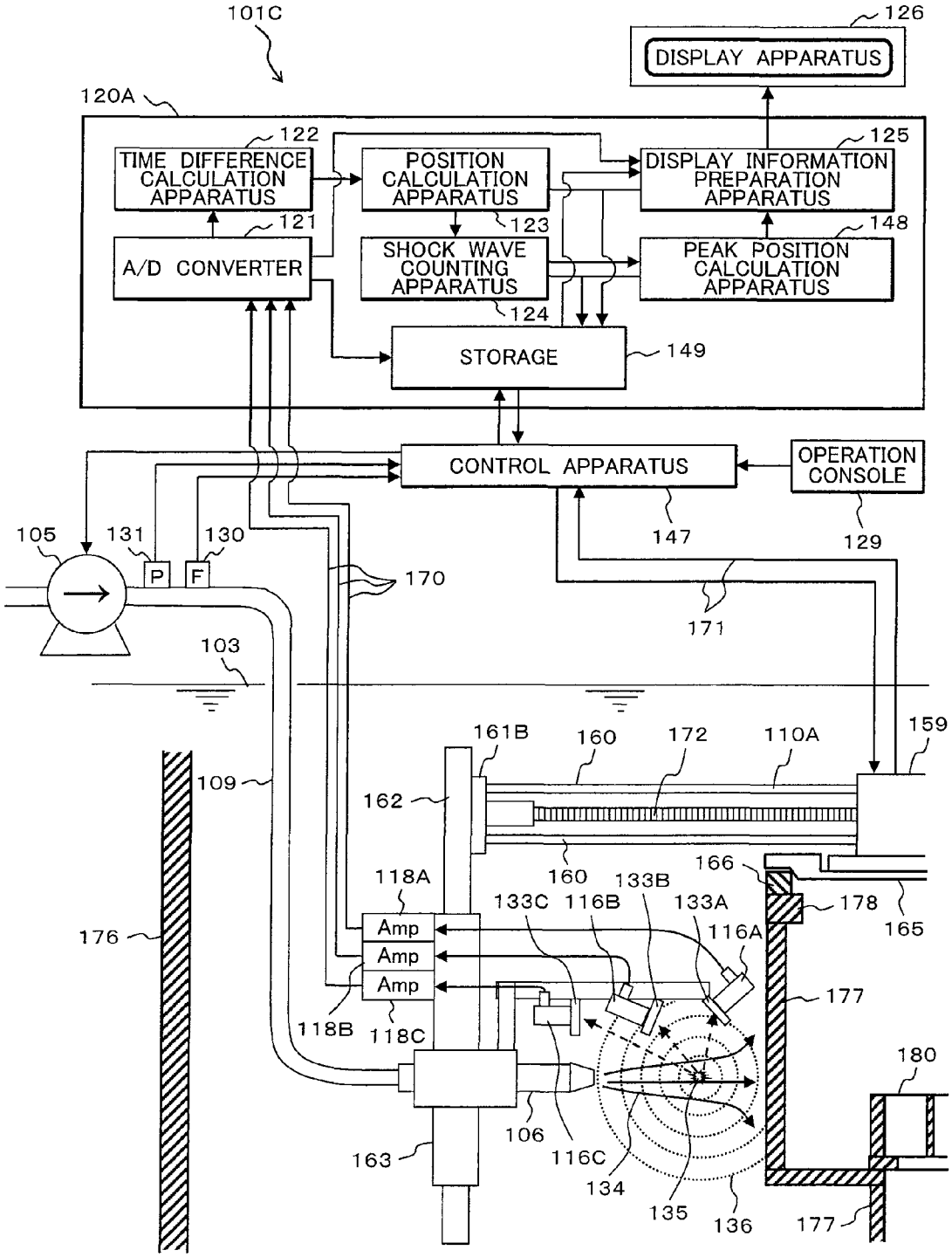
FIG. 34 is a structural diagram showing a water jet peening apparatus used in a water jet peening method according to embodiment 7 which is another embodiment of the present invention.

A water jet peening method according to embodiment 7 which is another embodiment of the present invention is explained by referring to FIG. 34. The water jet peening method according to the present embodiment is executed, for example, for an object of the reactor internal installed in the RPV of a boiling water nuclear plant. The reactor internal is, for example, the core shroud.

A WJP apparatus 101C used in the water jet peening method according to the present embodiment has a structure that the nozzle scanning control apparatus 127 and pump control apparatus 128 are replaced with the signal processing apparatus 120A and control apparatus 147 used in the embodiment 5 in the WJP apparatus 101B used in the embodiment 6. The other structure of the WJP apparatus 101C is the same as that of the WJP apparatus 101B. The control apparatus 147 executes the control or decision at each of the steps S101, S102, S106 to S108, S110, S114, S116 to S119, and S121 to S126 similarly to the embodiment 5.

The control apparatus 147 stores beforehand the operation condition change threshold value, the improvement effect decision threshold value, the maximum value and minimum value of the stand off, and the change pitch thereof in a storage of the control apparatus 147 similarly to the embodiment 5.

Even in the water jet peening method according to the present embodiment, each control or process shown in FIGS. 23 and 24 is executed similarly to the embodiment 5. In the present embodiment, the WJP is executed along the plurality of welding portions formed in the core shroud 177. For example, the WJP is executed along the welding portions extending in the peripheral direction of the core shroud 177.

In the step S101, the control apparatus 147 controls the movement apparatuses 158A and 158B and positions each of the nozzles 106 installed on both movement apparatuses to a predetermined position similarly to the embodiment 6. At the step S102, the high-pressure pump 105 is driven and the high-pressure water jet 134 is injected from the respective nozzles 106. At the step S115, similarly the embodiment 5, the AE sensors 116A, 116B, and 116C respectively detect the shock wave 136 and the peak position of the shock wave generation frequency is obtained by the respective signal processing apparatuses 120A. The decision at the step S116, the search at the step S117, the decision at the step S118, and the control at the steps S106 and S119 are executed by the control apparatus 147 similarly to the embodiment 5. The control at the steps S106 and S119 is executed by driving the motor installed in each apparatus body 159 of the movement apparatuses 158A and 158B and rotating the ball screw 172.

After the control at the step S119 is executed, the nozzle scanning is started (step S108). The control apparatus 147 outputs a scanning start signal to the nozzle scanning apparatus 110A to execute the WJP for one welding portion extending in the peripheral direction. The turn table 165 is rotated along the guide rail 166 based on the scanning start signal. The two nozzles 106 move along the one welding portion extending in the peripheral direction by injecting the water jet 134. While the nozzles 106 move, at the step S120, the peak position of the shock wave generation frequency is obtained by the signal processing apparatus 120A similarly to the step S115.

The control apparatus 147, similarly to the embodiment 5, executes the decision at the step S121, and when the decision at the step S121 becomes "No", "although the stress improvement effect is increased sufficiently, if the injection is continued under the condition, there are possibilities that the stress improvement effect may be changed to an insufficient state" is decided, and the decision at the step S122 is executed. The monitoring parameter in the present embodiment is the peak position. When the decision at the step S122 is "No", it indicates that in the scanning process of the nozzle 106, there is a part in the structural member where the improvement effect of the residual stress is insufficient, that is, there is a part where the tensile residual stress is not improved sufficiently to compressive residual stress. Therefore, Similarly to the embodiment 5, the drive of the turn table 165 is controlled and the control at the steps S124 and S123 is executed by the control apparatus 147. When the decision at the step S121 is "Yes", the decision at the step S125 is executed and when the decision at the step S125 is "Yes", the decision at the step S126 is executed. When the decision at the step S126 is "Yes", the control at the steps S110 and S114 is executed and the WJP for one welding portion is finished.

Even for another welding portion formed on the core shroud 177 in the peripheral direction and a welding portion formed on the core shroud 177 in the axial direction, the WJP is executed similarly.

In the present embodiment, the effects attained in Embodiment 6 can be obtained. In the present embodiment, an optimum stand off is selected and the WJP can be executed similarly to the embodiment 5.

Embodiments 6 and 7 can be applied to the execution of WJP for another reactor internal in the RPV 176 of the boiling water nuclear plant.

Embodiment 8

Figure 35:
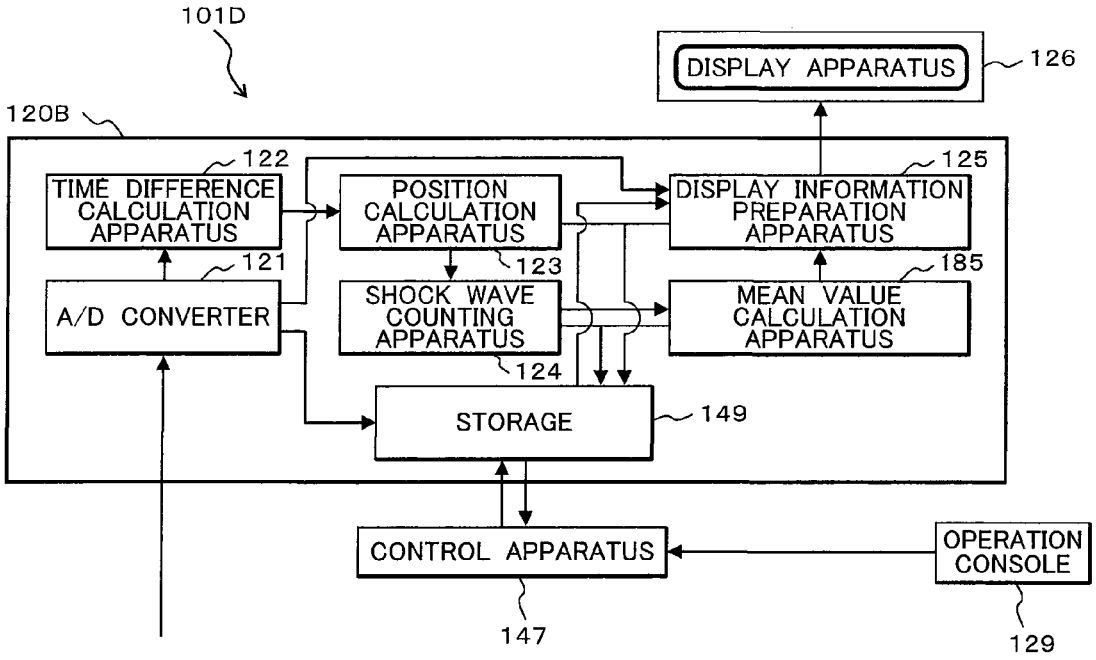
FIG. 35 is a structural diagram showing a signal processing apparatus of a water jet peening apparatus used in a water jet peening method according to embodiment 8 which is another embodiment of the present invention.

A water jet peening method according to embodiment 8 which is another embodiment of the present invention is explained by referring to FIG. 35. A WJP apparatus 101D used in the water jet peening method according to the present embodiment, has a structure that the signal processing apparatus 120A is replaced with a signal processing apparatus 120B shown in FIG. 35 in the WJP apparatus 101A used in the embodiment 5. The other structure of the WJP apparatus 101D is the same as that of the WJP apparatus 101A. The signal processing apparatus 120B has a structure that the peak position calculation apparatus 148 of the signal processing apparatus 120A is replaced with a mean value calculation apparatus 185. The other structure of the signal processing apparatus 120B is the same as that of the signal processing apparatus 120A. The mean value calculation apparatus 185 is connected to the shock wave counting apparatus 124, display information preparation apparatus 125, and storage 149.

Even in the water jet peening method according to the present embodiment, the control or decision at each of the steps S101, S102, S106 to S108, S110, S114, S116 to S119, and S121 to S126 which are described in FIGS. 23 and 24 is executed by the control apparatus 147 and the processes at the steps S115 and S120 are executed by the signal processing apparatus 120B. The WJP is executed for the structural member 102 under the control of the control apparatus 147 similarly to the embodiment 5.

In the water jet peening method according to the present embodiment, the portion different from the embodiment 5 is explained below. The mean value calculation apparatus 185 obtains the mean value of the shock wave generation frequencies based on the occurrence number of each shock wave (the shock wave generation frequency) per unit time obtained by the shock wave counting apparatus 124, at the respective positions set. The mean value of the shock wave occurrence frequencies is a mean value at all the set positions. The mean value is stored in the storage 149.

Figure 36:
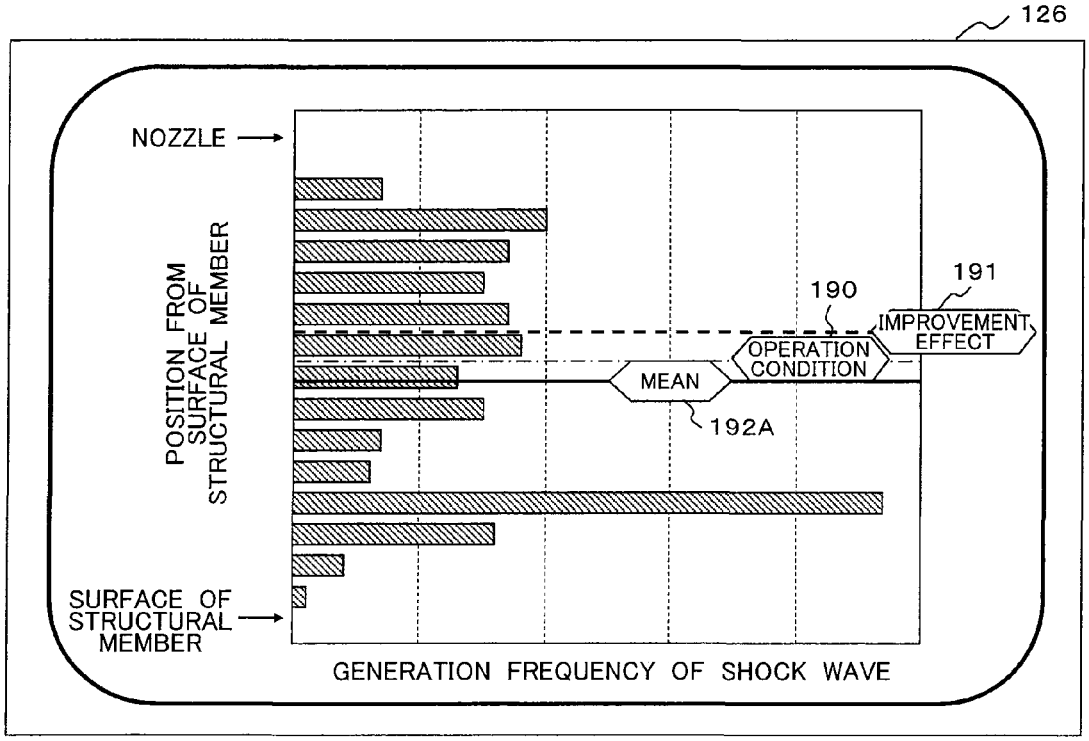
FIG. 36 is an explanatory drawing showing an example of display information showing generation frequency distribution, which is prepared by a display information preparation apparatus shown in FIG. 35, of shock wave in a state that stress improvement effect is obtained.
Figure 37:
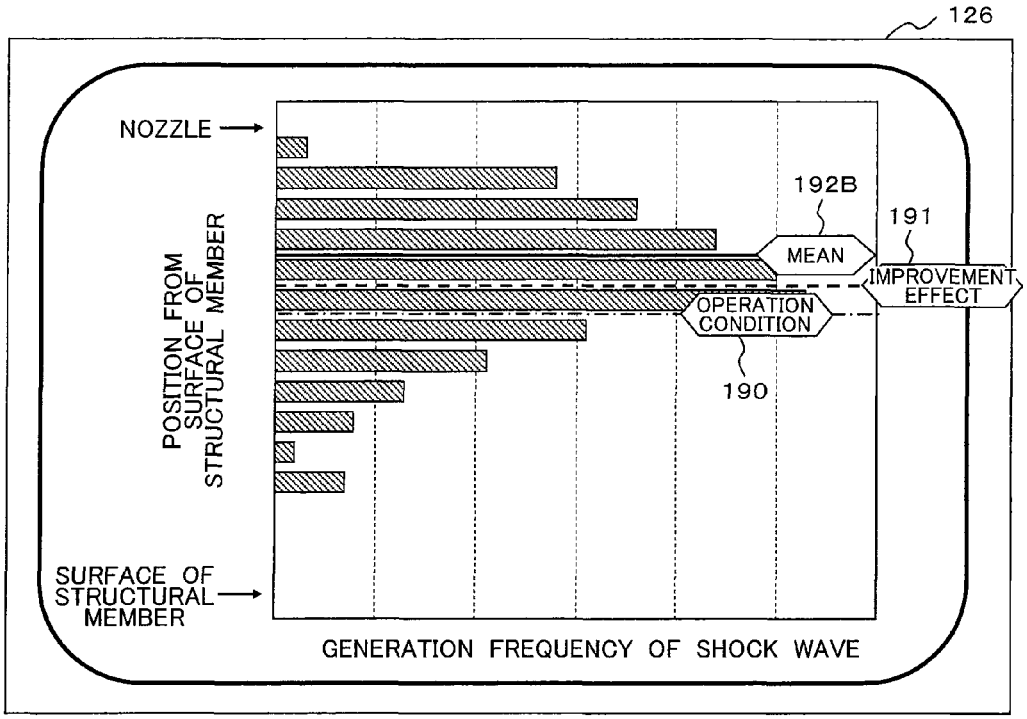
FIG. 37 is an explanatory drawing showing an example of the display information showing generation frequency distribution, which is prepared by a display information preparation apparatus shown in FIG. 35, of shock wave in a state that stress improvement effect is insufficient.

The display information preparation apparatus 125 prepares display information of the distribution of the shock wave generation frequency in the perpendicular direction to the surface of the structural member 102 for which the WJP is executed based on each information of the shock wave generation frequency at the respective positions set, the operation condition change threshold value and improvement effect decision threshold value which are fetched from the storage 149, and the mean value of the shock wave generation frequencies obtained by the mean value calculation apparatus 185. The display information is displayed on the display apparatus 126 and is stored in the storage 149. Examples of the display information displayed on the display apparatus 126 are shown in FIGS. 36 and 37. In the display information examples, an operation condition change threshold value 190 and an improvement effect decision threshold value 191 are included. The operation condition change threshold value 190 and improvement effect decision threshold value 191 used in the present embodiment correspond to the mean value of the shock wave generation frequencies. Furthermore, the examples of each display information shown in FIGS. 36 and 37 include display symbols of the mean value of the shock wave generation frequencies that are indicated by 192A and 192B.

The monitoring parameter in the present embodiment is the mean value of the shock wave generation frequencies. The decision at each of the steps S118, S121, and S122 of the present embodiment is executed using the mean value of the shock wave generation frequencies read from the storage 149.

The present embodiment can obtain the respective effects attained in the embodiment 5.

In the WJP apparatus 101C, the signal processing apparatus 120A can be changed to the signal processing apparatus 120B used in the present embodiment. The water jet peening method according to Embodiment 7 may be executed by using the WJP apparatus 101C in which the signal processing apparatus 120A is replaced with the signal processing apparatus 120B. In this case, the effects attained in Embodiment 7 can be obtained.

Embodiment 9

Figure 38:
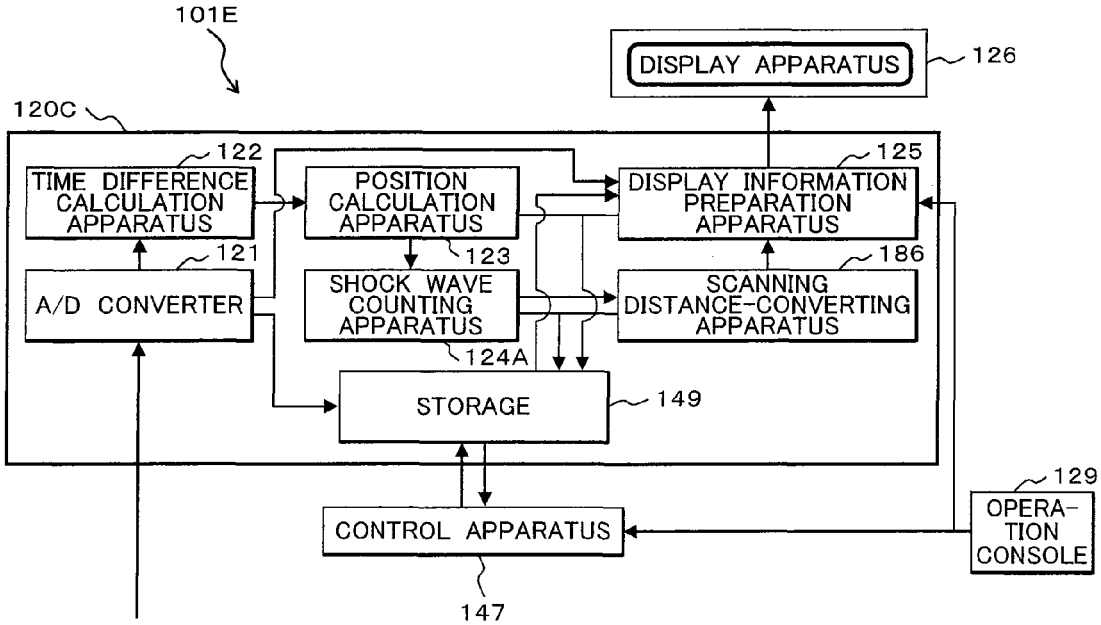
FIG. 38 is a structural diagram showing a signal processing apparatus of a water jet peening apparatus used in a water jet peening method according to embodiment 9 which is another embodiment of the present invention.

A water jet peening method according to embodiment 9 which is another embodiment of the present invention is explained by referring to FIG. 38. A WJP apparatus 101E used in the water jet peening method according to the present embodiment has a structure that the signal processing apparatus 120A is replaced with a signal processing apparatus 120C shown in FIG. 38 in the WJP apparatus 101A used in the embodiment 5. The other structure of the WJP apparatus 101E is the same as that of the WJP apparatus 101A. The signal processing apparatus 120C has a structure that the shock wave counting apparatus 124 of the signal processing apparatus 120A is replaced with a shock wave counting apparatus 124A and furthermore, a scanning distance-converting apparatus 186 is added. The other structure of the signal processing apparatus 120C is the same as that of the signal processing apparatus 120A. The shock wave counting apparatus 124A is connected to the scanning distance-converting apparatus 186 and storage 149. The scanning distance-converting apparatus 186 is connected to the display information preparation apparatus 125 and storage 149.

Even in the water jet peening method according to the present embodiment, the control or decision at each of the steps S101, S102, S106 to S108, S110, S114, S116 to S119, and S121 to S126 which are described in FIGS. 23 and 24 is executed by the control apparatus 147 and the processes at the steps S115 and S120 are executed by the signal processing apparatus 120C. The WJP is executed for the structural member 102 under the control of the control apparatus 147 similarly to the embodiment 5.

In the water jet peening method according to the present embodiment, the portion different from the embodiment 5 is explained below. The shock wave counting apparatus 124A obtains the shock wave generation frequency by using the information of the generation position of each shock wave, at the respective positions (sections) set in the perpendicular direction to the surface of the structural member 102 similarly to the embodiment 5. Furthermore, the shock wave counting apparatus 124A obtains a valid shock wave generation frequency (hereinafter, referred to as a first valid shock wave generation frequency) per unit time which is generated between the position of the threshold value 193 and the surface of the structural member 102, by using the shock wave generation frequency at the respective set positions (sections). The first valid shock wave generation frequency is stored in the storage 149 and is inputted into the scanning distance converter 186. The scanning distance-converting apparatus 186 converts the first valid shock wave generation frequency outputted from the shock wave counting apparatus 124A to a valid shock wave generation frequency (hereinafter, referred to as a second valid shock wave generation frequency) per unit scanning distance of the nozzle 106.

The operator inputs a display information selection command to the operation console 129 before the execution of WJP. The display information selection command is inputted from the operation console 129 to the display information preparation apparatus 125. A display information preparation command is either of (a) preparation of display information using the first valid shock wave generation frequency and (b) preparation of display information using the second valid shock wave generation frequency.

Figure 39:
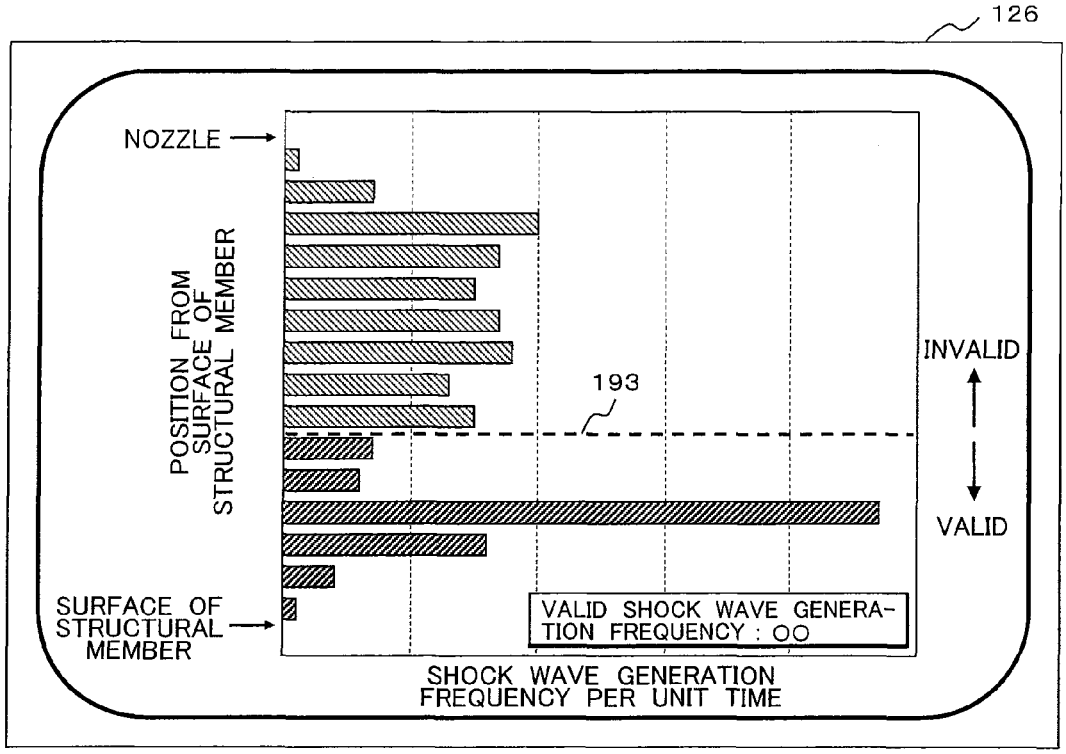
FIG. 39 is an explanatory drawing showing an example of display information showing generation frequency distribution, which is prepared by a display information preparation apparatus shown in FIG. 38, of shock wave in a state that stress improvement effect is obtained.
Figure 40:
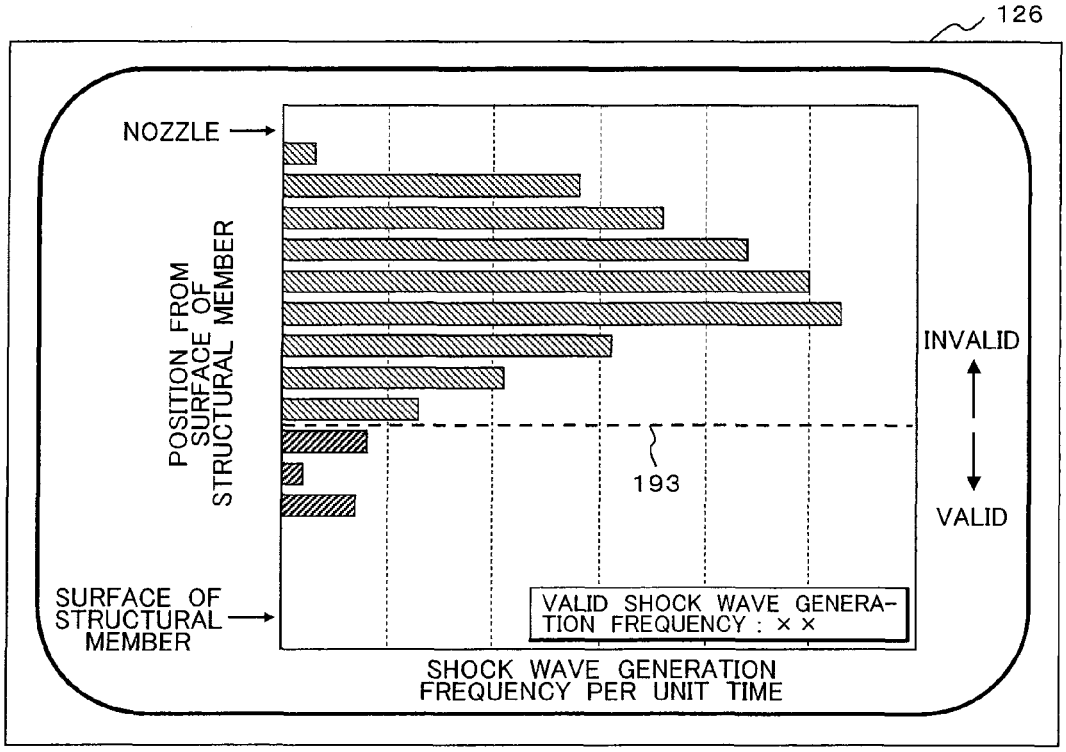
FIG. 40 is an explanatory drawing showing an example of the display information showing generation frequency distribution, which is prepared by a display information preparation apparatus shown in FIG. 38, of shock wave in a state that stress improvement effect is insufficient.

By the display information preparation command, for example, it is assumed that the preparation of display information of (a) is selected. The display information preparation apparatus 125 prepares display information of the distribution of the shock wave generation frequency in the perpendicular direction to the surface of the structural member 102 for which the WJP is executed based on each information of the shock wave generation frequency per unit time at the respective positions set, the threshold value 193, and the first valid shock wave generation frequency which are read and set from the storage 149. The display information is displayed on the display apparatus 126 and is stored in the storage 149. Examples of the display information displayed on the display apparatus 126 are shown in FIGS. 39 and 40. The threshold value 193 is included in the display information examples. Furthermore, the examples of each display information shown in FIGS. 39 and 40 include the value of the first valid shock wave generation frequency.

In FIGS. 39 and 40, the shock wave generated at the position on the surface side of the structural member 102 from the position of the threshold value 193 is a valid shock wave contributing to improvement of the residual stress of the structural member 102. Further, the shock wave generated at the position on the side of the nozzle 106 from the position of the threshold value 193 is an invalid shock wave contributing little to improvement of the residual stress of the structural member 102. The first and second valid shock wave generation frequencies are the generation frequency of a valid shock wave contributing to improvement of the residual stress. The threshold vale 193 is decided by confirming the boundary between the region where a valid shock wave is generated and the region where an invalid shock wave is generated by experimentation.

When the preparation of display information of (b) is selected, in the examples of each display information shown in FIGS. 39 and 40, the horizontal axis indicates a shock wave generation frequency per unit scanning distance and the value of the second valid shock wave generation frequency is included.

The monitoring parameter in the present embodiment is different between the case that the preparation of display information of (a) is selected and the case that the preparation of display information of (b) is selected. When (a) is selected, the monitoring parameter is the first valid shock wave generation frequency and the operation condition change threshold value and improvement effect decision threshold value respectively correspond to the first valid shock wave generation frequency. When (b) is selected, the monitoring parameter is the second valid shock wave generation frequency and the operation condition change threshold value and improvement effect decision threshold value respectively correspond to the second valid shock wave generation frequency.

Since (a) is selected, the decision at each of the steps S118, S121, and S122 of the present embodiment is executed using the first valid shock wave generation frequency read from the storage 149. When (b) is selected, the decision at each of the steps S118, S121, and S122 of the present embodiment is executed using the second valid shock wave generation frequency read from the storage 149.

The present embodiment can obtain the respective effects attained in the embodiment 5. When the valid shock wave generation frequency per unit scanning distance is used, the improvement effect of the residual stress of the WJP execution object can be confirmed more accurately compared with the case that the valid shock wave generation frequency per unit time is used.

In the WJP apparatus 101C, the signal processing apparatus 120A can be changed to the signal processing apparatus 120C used in the present embodiment. The water jet peening method according to the embodiment 7 may be executed using the WJP apparatus 101C in which the signal processing apparatus 120A is replaced with the signal processing apparatus 120C. In this case, the effects attained in the embodiment 7 can be obtained.

Embodiment 10

Figure 41:
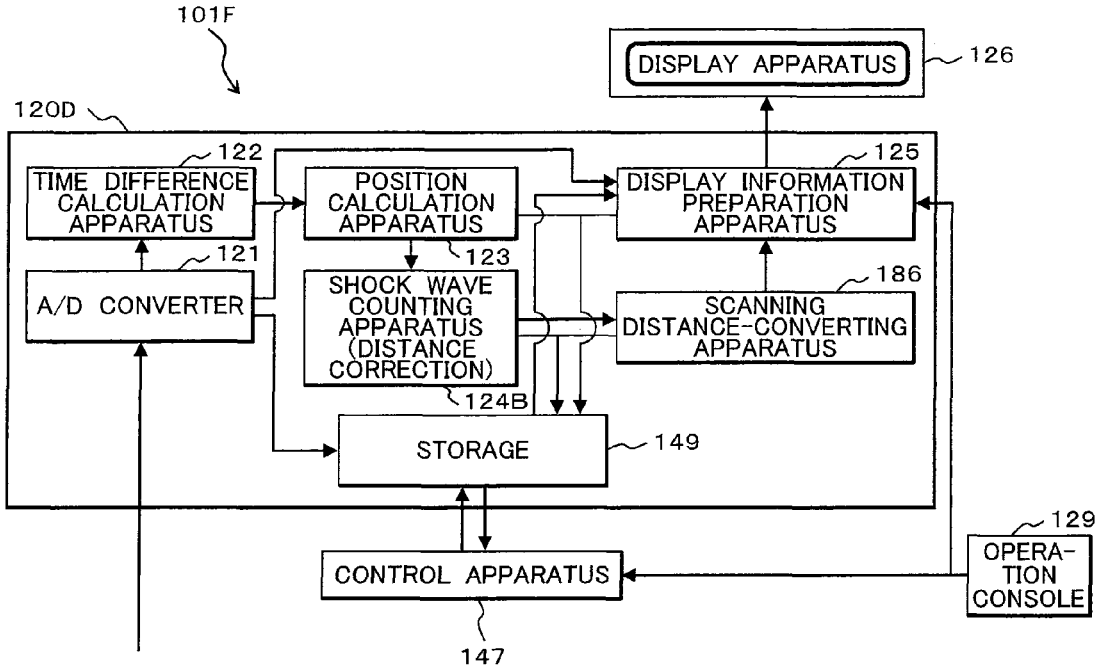
FIG. 41 is a structural diagram showing a signal processing apparatus of the water jet peening apparatus used in a water jet peening method according to embodiment 10 which is another embodiment of the present invention.

A water jet peening method according to embodiment 10 which is another embodiment of the present invention is explained by referring to FIG. 41. A WJP apparatus 101F used in the water jet peening method according to the present embodiment has a structure that the signal processing apparatus 120A is replaced with a signal processing apparatus 120D shown in FIG. 41 in the WJP apparatus 101A used in the embodiment 5. The other structure of the WJP apparatus 101F is the same as that of the WJP apparatus 101A. The signal processing apparatus 120D has a structure that the shock wave counting apparatus 124 of the signal processing apparatus 120A is replaced with a shock wave counting apparatus 124B and furthermore, the scanning distance-converting apparatus 186 is added. The other structure of the signal processing apparatus 120D is the same as that of the signal processing apparatus 120A. The shock wave counting apparatus 124B is connected to the scanning distance-converting apparatus 186 and storage 149. The scanning distance-converting apparatus 186 is connected to the display information preparation apparatus 25 and storage 149.

Even in the water jet peening method according to the present embodiment, the control or decision at each of the steps S101, S102, S106 to S108, S110, S114, S116 to S119, and S121 to S126 which are described in FIGS. 23 and 24 is executed by the control apparatus 147 and the processes at the steps S115 and S120 are executed by the signal processing apparatus 120D. The WJP is executed for the structural member 102 under the control of the control apparatus 147 similarly to the embodiment 5.

In the water jet peening method according to the present embodiment, the portion different from the embodiment 5 is explained below. The shock wave counting apparatus 124B obtains the shock wave generation frequency per unit time using the information of the generation position of each shock wave, at the respective positions (sections) set in the perpendicular direction to the surface of the structural member 102 similarly to the embodiment 5. Furthermore, the shock wave counting apparatus 124A corrects the shock wave generation frequency per unit time at the respective set positions based on the distance from the surface of the structural member 102.

Assuming the distance between the surface of the structural member 102 and the set position as L and the number of shock waves generated at the set position as n, a corrected shock wave generation frequency (hereinafter, referred to as a first corrected shock wave generation frequency) SF per unit time is obtained by $n/L^2$. The first corrected shock wave generation frequency is stored in the storage 149 and is inputted to the scanning distance-converting apparatus 186. The scanning distance-converting apparatus 186 converts the first corrected shock wave generation frequency outputted from the shock wave counting apparatus 124B to a corrected shock wave generation frequency (hereinafter, referred to as a second corrected shock wave generation frequency) per unit scanning distance of the nozzle 106.

In the present embodiment, the display information selection command is inputted from the operation console 129 to the display information preparation apparatus 125 similarly to the embodiment 9. The display information preparation command is either of (c) preparation of display information using the first corrected shock wave generation frequency and (d) preparation of display information using the second corrected shock wave generation frequency.

Figure 42:
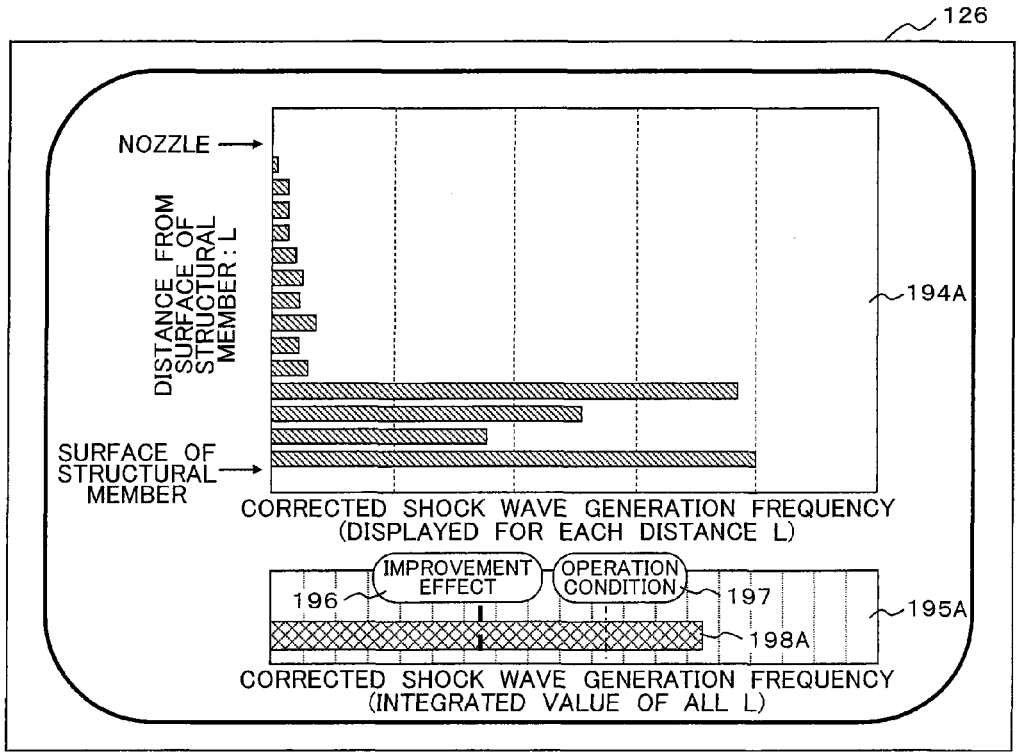
FIG. 42 is an explanatory drawing showing an example of display information showing generation frequency distribution, which is prepared by a display information preparation apparatus shown in FIG. 41, of shock wave in a state that stress improvement effect is obtained.
Figure 43:
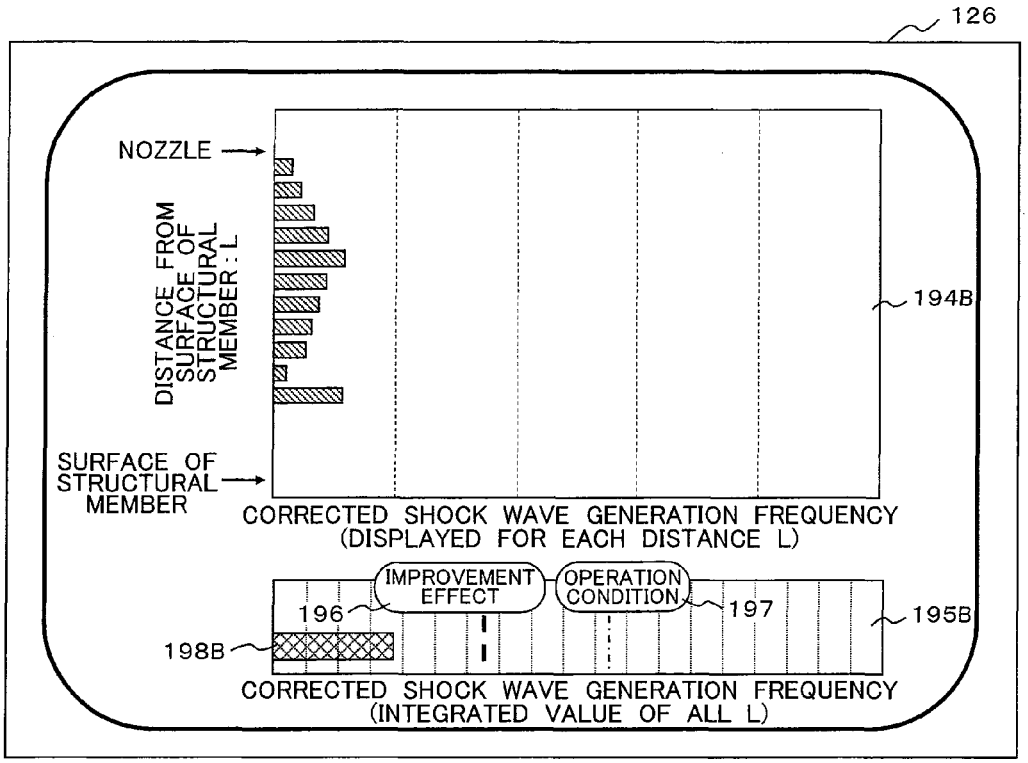
FIG. 43 is an explanatory drawing showing an example of display information showing generation frequency distribution, which is prepared by a display information preparation apparatus shown in FIG. 41, of shock wave in a state that stress improvement effect is insufficient.

By the display information preparation command, for example, it is assumed that the preparation of display information of (c) is selected. The display information preparation apparatus 125 prepares display information of the distribution of the shock wave generation frequency in the perpendicular direction to the surface of the structural member 102 for which the WJP is executed based on each information of the shock wave generation frequency per unit time at the respective positions and the first corrected shock wave generation frequency which are read and set from the storage 149. The display information is displayed on the display apparatus 126 and is stored in the storage 149. Examples of the display information displayed on the display apparatus 126 are shown in FIGS. 42 and 43. In the display information examples shown in FIGS. 42 and 43, the horizontal axis indicates the corrected shock wave generation frequency per unit time. In FIG. 42, the corrected shock wave generation frequency at each distance L from the surface of the structural member is shown in 194A and a corrected shock wave generation frequency 198A when all the distances L are integrated is shown in 195A. In FIG. 43, the corrected shock wave generation frequency at each distance L from the surface of the structural member 102 is shown in 194B and a corrected shock wave generation frequency 198B when all the distances L are integrated is shown in 195B. In the examples of the display information shown in 195A and 195B, an operation condition change threshold value 197 and an improvement effect decision threshold value 198 are included.

The monitoring parameter in the present embodiment is different between the case that the preparation of display information of (c) is selected and the case that the preparation of display information of (d) is selected. When (c) is selected, the monitoring parameter is the first corrected shock wave generation frequency and the operation condition change threshold value and improvement effect decision threshold value respectively correspond to the first corrected shock wave generation frequency. When (d) is selected, the monitoring parameter is the second corrected shock wave generation frequency and the operation condition change threshold value and improvement effect decision threshold value respectively correspond to the second corrected shock wave generation frequency.

Since (c) is selected, the decision at each of the steps S118, S121, and S122 of the present embodiment is executed using the first corrected shock wave generation frequency read from the storage 149. When (d) is selected, the decision at each of the steps S118, S121, and S122 of the present embodiment is executed using the second corrected shock wave generation frequency read from the storage 149.

The present embodiment can obtain the respective effects attained in the embodiment 5. When the corrected shock wave generation frequency per unit scanning distance is used, the improvement effect of the residual stress of the WJP execution object can be confirmed more accurately compared with the case that the corrected shock wave generation frequency per unit time is used.

In the WJP apparatus 101C, the signal processing apparatus 120A can be changed to the signal processing apparatus 120D used in the present embodiment. The water jet peening method according to the embodiment 7 may be executed using the WJP apparatus 101C in which the signal processing apparatus 120A is replaced with the signal processing apparatus 120D. In this case, the effects attained in the embodiment 7 can be obtained.

Embodiment 11

Figure 44:
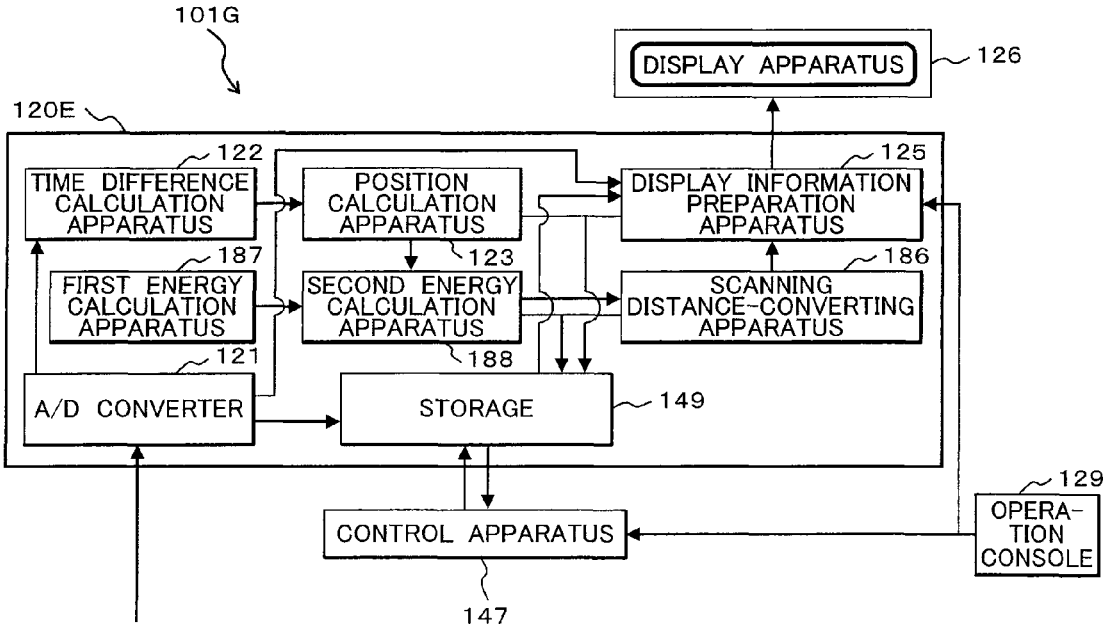
FIG. 44 is a structural diagram showing a signal processing apparatus of a water jet peening apparatus used in a water jet peening method according to embodiment 41 which is another embodiment of the present invention.

A water jet peening method according to embodiment 11 which is another embodiment of the present invention is explained by referring to FIG. 44. A WJP apparatus 101G used in the water jet peening method according to the present embodiment has a structure that the signal processing apparatus 120A is replaced with a signal processing apparatus 120E shown in FIG. 44 in the WJP apparatus 101A used in the embodiment 5. The other structure of the WJP apparatus 101G is the same as that of the WJP apparatus 101A. The signal processing apparatus 120E has a constitution that the shock wave counting apparatus 124 and peak position calculation apparatus 148 are removed and a first energy calculation apparatus 187, a second energy calculation apparatus 188, and the scanning distance-converting apparatus 186 are added in the signal processing apparatus 120A. The other structure of the signal processing apparatus 120E is the same as that of the signal processing apparatus 120A. The first energy calculation apparatus 187 is connected to the A-D converter 121 and second energy calculation apparatus 188.

The second energy calculation apparatus 188 is connected to the position calculation apparatus 123, scanning distance-converting apparatus 186, and storage 149. The scanning distance-converting apparatus 186 is connected to the display information preparation apparatus 125 and storage 149.

Even in the water jet peening method according to the present embodiment, the control or decision at each of the steps S101, S102, S106 to S108, S110, S114, S116 to S119, and S121 to S126 which are described in FIGS. 23 and 24 is executed by the control apparatus 147 and the processes at the steps S115 and S120 are executed by the signal processing apparatus 120E. The WJP is executed for the structural member 102 under the control of the control apparatus 147 similarly to the embodiment 5.

In the water jet peening method according to the present embodiment, the portion different from the embodiment 5 is explained below. The first energy calculation apparatus 187 calculates energy possessed by each shock wave based on the respective shock wave detection signals of the AE sensors 116A and 116B that are inputted from the A-D converter 121. The calculation of the shock wave energy is explained concretely using the shock wave detection signals shown in FIG. 26. Each height of the waveform 150*a* that is an output of the AE sensor 116A and the waveform 150*b* that is an output of the AE sensor 116B is proportional to the shock wave energy. The waveforms 150*a* and 150*b* are generated by detection of one shock wave. The first energy calculation apparatus 187 calculates energy $Ea_1$ based on the height of the waveform 150*a* and calculates energy $Ea_2$ based on the height of the waveform 150*b*.

The calculated energy $Ea_1$ and $Ea_2$ and the generation position of the shock wave obtained by the position calculation apparatus 123 are inputted into the second energy calculation apparatus 188. Assuming the distances between the generation position of the shock wave and each of the AE sensors 116A and 116B as $La_1$ and $La_2$, energy E of the shock wave generated at the generation position is calculated from $\{(Ea_1/La_1^2)+(Ea_2/La_2^2)\}/2$. Furthermore, the second energy calculation apparatus 188 calculates all the energy ΣE that is received from each shock wave by the structural member 102. Assuming the distance between the generation position of the shock wave and the surface of the structural member 102 as L, all the energy ΣE received by the structural member 102 is calculated from Formula (9).

$$\Sigma E=\Sigma(E_i/L_i^2) \tag{9}$$

where i indicates the number of shock waves generated per unit time.

The calculated ΣE is stored in the storage 149 and is inputted into the scanning distance-converting apparatus 186. The energy ΣE that is calculated by the second energy calculation apparatus 188 and is received by the structural member 102 per unit time is referred to as first energy for convenience. The scanning distance-converting apparatus 186 converts the inputted first energy to energy (hereinafter, referred to as the second energy) per unit scanning distance of the nozzle 106.

In the present embodiment, the display information selection command is inputted from the operation console 129 to the display information preparation apparatus 125 similarly to the embodiment 9. The display information preparation command is either of (e) preparation of display information using the first energy and (f) preparation of display information using the second energy.

By the display information preparation command, for example, it is assumed that the preparation of display information of (e) is selected. The display information preparation apparatus 125 prepares display information of the energy received by the structural member 102 based on the information of the first energy read from the storage 149. The display information is displayed on the display apparatus 126 and is stored in the storage 149.

When the preparation of display information of (f) is selected, the display information preparation apparatus 125 prepares the display information based on the second energy.

The monitoring parameter in the present embodiment is different between the case that the preparation of display information of (e) is selected and the case that the preparation of display information of (f) is selected. When (e) is selected, the monitoring parameter is the first energy and the operation condition change threshold value and improvement effect decision threshold value respectively correspond to the first energy. When (f) is selected, the monitoring parameter is the second energy and the operation condition change threshold value and improvement effect decision threshold value respectively correspond to the second energy.

Since (e) is selected, the decision at each of the steps S118, S121, and S122 of the present embodiment is executed using the first energy read from the storage 149. When (f) is selected, the decision at each of the steps S118, S121, and S122 of the present embodiment is executed using the second energy read from the storage 149.

The present embodiment can obtain the respective effects attained in the embodiment 5. When the energy received by the structural member 102 per unit scanning distance is used, the improvement effect of the residual stress of the WJP execution object can be confirmed more accurately compared with the case that the energy received by the structural member 102 per unit time is used.

In the WJP apparatus 101C, the signal processing apparatus 120A can be changed to the signal processing apparatus 120E used in the present embodiment. The water jet peening method according to the embodiment 7 may be executed using the WJP apparatus 101C in which the signal processing apparatus 120A is replaced with the signal processing apparatus 120E. In this case, the effects attained in the embodiment 7 can be obtained.

If the effects according to the embodiment 5 and embodiments 8 to 11 are compared with each other, the following may be said. The confirmation precision of the improvement effect of the residual stress of the WJP execution object increases in the reverse order of the peak position of the shock wave generation frequency (for example, the embodiment 5), the mean value of shock wave generation frequencies (for example, the embodiment 8), the valid shock wave generation frequency (for example, the embodiment 9), the shock wave generation frequency corrected based on the distance (for example, the embodiment 10), and the energy received by the structural member 102 (for example, the embodiment 11). The processing time of the signal processing apparatus becomes shorter in the reverse order of the energy received by the structural member 102 (for example, Embodiment 11), the shock wave generation frequency corrected based on the distance (for example, Embodiment 10), the valid shock wave generation frequency (for example, Embodiment 9), the mean value of shock wave generation frequencies (for example, Embodiment 8), and the peak position of the shock wave generation frequency (for example, Embodiment 5).

The embodiments 1 to 11 aforementioned can be applied to improvement of residual stress of a structural member of a pressurized water nuclear plant. Furthermore, the embodiments 1 to 5 and 8 to 11 can be applied to stress improvement of a steel plate immersed in seawater of a ship hardly pulled up from the sea onto the land and to the removal of barnacles adhered to the steel plate. Further, the embodiments 1, 4, 5, and 8 to 11 and an embodiment that the signal processing apparatus 39 is replaced with the signal processing apparatus 39B in Embodiment 1 may be applied to surface improvement of parts of a car.

INDUSTRIAL APPLICABILITY

The present invention can be applied to the improvement of residual stress of a structural member.

REFERENCE SIGNS LIST

1, 1A, 1B, 101, 101A, 101B, 101C, 101D, 101E, 101F, 101G: water jet peening apparatus, 4, 104: water tank, 5, 105: high-pressure pump, 6, 106: nozzle, 9, 109: high-pressure hose, 10, 10A, 110, 110A: nozzle scanning apparatus, 12, 14, 38, 58A, 58B, 112, 114, 119, 158A, 158B: movement apparatus, 13, 113: first arm, 16: pressure sensor, 20: counter, 22, 23, 147: control apparatus, 28, 135: bubble, 29, 136: shock wave, 39, 39A, 39B, 120, 120A, 120B, 120C, 120D, 120E: signal processing apparatus, 51, 176: reactor pressure vessel, 52: core shroud, 60: arm, 62, 162: post member, 63, 163: elevator, 65, 165: turn table, 72, 72A, 116A, 116B, 116C: AE sensor, 75: detection time decision portion, 76: time difference decision apparatus, 77: shock wave counting apparatus, 115: second arm, 122: time difference calculation apparatus, 123: position calculation apparatus, 124, 124A, 124B: shock wave counting apparatus, 125: display information preparation apparatus, 127: nozzle scanning control apparatus, 128: pump control apparatus, 148: peak position calculation apparatus, 185: mean value calculation apparatus, 186: scanning distance-converting apparatus, 187: first energy calculation apparatus, 188: second energy calculation apparatus.

What is claimed is:

1. A water jet peening method, comprising steps of:

injecting water supplied by a pump from nozzle into water in which the nozzle exists as a water jet;

moving the nozzle injecting the water jet along a water jet peening execution object existing in the water;

impacting a shock wave generated by collapse of bubbles included in the water jet injected from the nozzle into the water against the water jet peening execution object; detecting the generated shock wave by a shock wave detection apparatus arranged in the water; and obtaining an generation frequency of the detected shock wave.

2. The water jet peening method according to claim 1, wherein when the generation frequency becomes equal to or smaller than a first set value, either of a pressure and a flow rate of the water discharged from the pump and supplied to the nozzle is increased; and after either of the pressure and the flow rate of the water is increased, the shock wave is impacted on a part of the water jet peening execution object in which at least the generation frequency is equal to or smaller than the first set value.

3. The water jet peening method according to claim 1, wherein when the generation frequency becomes equal to or smaller than a first set value, a scanning speed of the nozzle is decreased; and after the scanning speed of the nozzle is decreased, the shock wave is impacted on a part of the water jet peening execution object in which at least the generation frequency is equal to or smaller than the first set value.

4. The water jet peening method according to claim 1, wherein when the generation frequency becomes equal to or smaller than a second set value larger than a first set value and the generation frequency is larger than the first set value, either of a pressure and a flow rate of the water discharged from the pump and supplied to the nozzle is increased by scanning the nozzle injecting the water jet; and the nozzle injecting the water jet is scanned in a state that either of the pressure and the flow rate of the water is increased.

5. The water jet peening method according to claim 1, wherein when the generation frequency becomes equal to or smaller than a second set value larger than a first set value and the generation frequency is larger than the first set value, a scanning speed of the nozzle is decreased by scanning the nozzle injecting the water jet; and the nozzle injecting the water jet is scanned in a state that he scanning speed is decreased.

6. The water jet peening method according to claim 1, wherein when the generation frequency becomes equal to or smaller than a second set value larger than a first set value and the generation frequency becomes equal to or smaller than the first set value, either of a pressure and a flow rate of the water discharged from the pump and supplied to the nozzle is increased; and after either of the pressure and the flow rate of the water is increased, the shock wave is impacted on a part of the water jet peening execution object in which at least the generation frequency is equal to or smaller than the first set value.

7. The water jet peening method according to claim 1, wherein when the generation frequency becomes equal to or smaller than a second set value larger than a first set value and the generation frequency becomes equal to or smaller than the first set value, a scanning speed of the nozzle is decreased; and after the scanning speed of the nozzle is decreased, the shock wave is impacted on a part of the water jet peening execution object in which at least the generation frequency is equal to or smaller than the first set value.

8. The water jet peening method according to claim 1, wherein at least two shock wave detection apparatuses are arranged respectively in the water in positions at different distances from a surface of the water jet peening execution object; a difference in detection time of the shock wave between the shock wave detection apparatuses is obtained based on each shock wave detection signal outputted from each of the shock wave detection apparatuses by detecting the shock wave; when the obtained time difference exists within a set range, it is decided that the shock wave is detected; and the generation frequency is obtained based on the decided shock wave.

9. The water jet peening method according to claim 1, wherein the water jet peening execution object is a structural member in a reactor pressure vessel.

10. The water jet peening method according to claim 1, wherein the of the shock wave is displayed on a display apparatus.

11. A water jet peening apparatus, comprising:

a nozzle for injecting a water jet;

a pump for supplying water to the nozzle;

a nozzle scanning apparatus with the nozzle mounted for scanning the nozzle;

a shock wave detection apparatus attached to the nozzle scanning apparatus; and a shock wave counting apparatus for counting shock waves detected by the shock wave detection apparatus and obtaining an generation frequency of the shock waves.

12. The water jet peening apparatus according to claim 11, further comprising:

a display apparatus for displaying information of the generation frequency.

13. The water jet peening apparatus according to claim 11, further comprising:

a first control apparatus for controlling the pump and increasing either of a pressure and a flow rate of the water discharged from the pump and supplied to the nozzle when the generation frequency becomes equal to or smaller than a first set value; and a second control apparatus for controlling the nozzle scanning apparatus and scanning the nozzle at a part of a water jet peening execution object in which at least the generation frequency is equal to or smaller than the first set value when either of the pressure and the flow rate of the water is increased.

14. The water jet peening apparatus according to claim 11, further comprising:

a control apparatus for decreasing a scanning speed of the nozzle by controlling the nozzle scanning apparatus when the generation frequency becomes equal to or smaller than a first set value, and scanning the nozzle at a part of a water jet peening execution object in which at least the generation frequency is equal to or smaller than the first set value, by controlling the nozzle scanning apparatus when the scanning speed is decreased.

15. A water jet peening apparatus according to claim 11, further comprising:

a first control apparatus for increasing either of a pressure and a flow rate of the water discharged from the pump and supplied to the nozzle by controlling the pump when the generation frequency becomes equal to or smaller than a second set value larger than a first set value and the generation frequency is larger than the first set value and when the generation frequency becomes equal to or smaller than the second set value and the generation frequency becomes equal to or smaller than the first set value; and a second control apparatus for scanning the nozzle by controlling the nozzle scanning apparatus when the generation frequency becomes equal to or smaller than the second set value and the generation frequency is larger than the first set value, and scanning the nozzle at a part of a water jet peening execution object in which at least the generation frequency is equal to or smaller than the first set value by controlling the nozzle scanning apparatus when the generation frequency becomes equal to or smaller than the second set value and the generation frequency becomes equal to or smaller than the first set value.

16. The water jet peening apparatus according to claim 11, further comprising:

a control apparatus for decreasing a scanning speed of the nozzle in a state that the nozzle is scanned, by controlling the nozzle scanning apparatus when the generation frequency becomes equal to or smaller than a second set value larger than a first set value and the generation frequency is larger than the first set value, decreasing a scanning speed of the nozzle by controlling the nozzle scanning apparatus when the generation frequency becomes equal to or smaller than the second set value and the generation frequency becomes equal to or smaller than the first set value, and scanning the nozzle at a part of a water jet peening execution object in which at least the generation frequency is equal to or smaller than the first set value by controlling the nozzle scanning apparatus when the scanning speed of the nozzle is decreased.

17. The water jet peening apparatus according to claim 11, further comprising:

at least two shock wave detection apparatuses arranged at different positions in an axial direction of the nozzle;

a shock wave decision apparatus for obtaining a difference in detection time of the shock wave between the respective shock wave detection apparatuses based on each shock wave detection signal outputted form each of the shock wave detection apparatuses by detecting the shock wave, and deciding that it is detection of the shock wave when the obtained time difference exists within a set range; and the shock wave counting apparatus for counting the shock wave decided by the shock wave decision apparatus.

18. A water jet peening method, comprising steps of:

injecting water supplied by a pump from the nozzle into water in which a nozzle exists;

scanning the nozzle injecting the water along a water jet peening execution object existing in the water;

impacting on a shock wave generated by collapse of bubbles included in the water injected into the water from the nozzle against the water jet peening execution object;

detecting the shock wave by a plurality of shock wave detection apparatuses arranged in the water;

obtaining an generation position of the shock wave based on a difference in detection time of the shock wave between a certain shock wave detection apparatus and another shock wave detection apparatus; and obtaining an generation frequency of the shock wave for each of a plurality of sections set in a direction separating from a surface of the water jet peening execution object based on the generation position.

19. The water jet peening method according to claim 18, wherein a monitoring parameter value is obtained based on the generation frequency of the shock wave every the plurality of sections.

20. The water jet peening method according to claim 19, wherein the monitoring parameter value is either of a value per unit time and a value per unit scanning distance of the nozzle.

21. The water jet peening method according to claim 19, wherein when the monitoring parameter value becomes equal to or smaller than a first set value, the nozzle is scanned in a state that a scanning speed of the nozzle is decreased; and the shock wave is impacted on a part of the water jet peening execution object in which the monitoring parameter value is at least equal to or smaller than the first set value.

22. The water jet peening method according to claim 19, wherein when the monitoring parameter value becomes equal to or smaller than a second set value larger than a first set value and the monitoring parameter value is equal to or larger than the first set value, the nozzle is scanned in a state that a scanning speed of the nozzle is decreased.

23. The water jet peening method according to claim 19, wherein when the monitoring parameter value becomes equal to or smaller than a first set value, the nozzle is scanned in a state that either of a pressure and a flow rate of the water discharged from the pump and supplied to the nozzle is increased; and the shock wave is impacted on a part of the water jet peening execution object in which the monitoring parameter value is at least equal to or smaller than the first set value.

24. The water jet peening method according to claim 19, wherein when the monitoring parameter value becomes equal to or smaller than a second set value larger than a first set value and the monitoring parameter value is equal to or larger than the first set value, the nozzle is scanned in a state that either of a pressure and a flow rate of the water discharged from the pump and supplied to the nozzle is increased.

25. The water jet peening method according to claim 19 wherein the monitoring parameter value is any one of a position in which the generation frequency of the shock wave is maximized, a mean value of the generation frequencies of the shock wave, the generation frequency of the shock wave contributing to improvement of residual stress existing in the water jet peening execution object, and a corrected generation frequency obtained by correcting the generation frequency of the shock wave in consideration of a distance between a surface of the water jet peening execution object and an generation position of the shock wave.

26. The water jet peening method according to claim 18, wherein display information including information of the generation frequency of the shock wave every the plurality of sections is prepared; and the display information is displayed on a display apparatus.

27. A water jet peening method, comprising steps of:

injecting water supplied by a pump from the nozzle into water in which a nozzle exists;

scanning the nozzle injecting the water along a water jet peening execution object existing in the water;

impacting a shock wave generated by collapse of bubbles included in the water injected into the water from the nozzle against the water jet peening execution object;

detecting the shock wave by a plurality of shock wave detection apparatuses arranged in the water;

obtaining an generation position of the shock wave based on a difference in detection time of the shock wave between a certain shock wave detection apparatus and another shock wave detection apparatus;

obtaining respective energy of the plurality of shock waves based on detection signals of the shock waves detected by the plurality of shock wave detection apparatuses; and obtaining energy received from the plurality of shock waves by the water jet peening execution object based on the energy of the plurality of shock waves and the generation positions of the plurality of shock waves.

28. A water jet peening apparatus, comprising:

a nozzle for injecting water;

a pump for supplying water to the nozzle;

a nozzle scanning apparatus with the nozzle mounted for scanning the nozzle;

a plurality of shock wave detection apparatuses attached to the nozzle scanning apparatus; and a signal processing apparatus for obtaining an generation position of the shock wave based on a difference in detection time of a shock wave between a certain the shock wave detection apparatus and another the shock wave detection apparatus, and obtaining an generation frequency of the shock wave for each of a plurality of sections set in a direction separating from a surface of an water jet peening execution object based on the generation position of the shock wave.

29. The water jet peening apparatus according to claim 28, further comprising:

a display information preparation apparatus for preparing display information including information of the generation frequency of the shock wave every the plurality of sections; and a display apparatus for displaying the display information.

30. The water jet peening apparatus according to claim 28, further comprising:

the signal processing apparatus for obtaining a monitoring parameter value based on the generation frequency of the shock wave every the plurality of sections.

31. The water jet peening apparatus according to claim 30, further comprising:

a control apparatus for decreasing a scanning speed of the nozzle by controlling the nozzle scanning apparatus when the monitoring parameter value becomes equal to or smaller than a first set value, and scanning the nozzle at a part of the water jet peening execution object in which the monitoring parameter value is at least equal to or smaller than the first set value by controlling the nozzle scanning apparatus when the scanning speed is decreased.

32. The water jet peening apparatus according to claim 30, further comprising:

a control apparatus for scanning the nozzle in a state that the scanning speed of the nozzle is decreased by controlling the nozzle scanning apparatus when the monitoring parameter value becomes equal to or smaller than a second set value larger than a first set value and the monitoring parameter value is equal to or larger than the first set value.

33. The water jet peening apparatus according to claim 30, further comprising:

a control apparatus for increasing either of a pressure and a flow rate of the water discharged from the pump and supplied to the nozzle by controlling the pump when the monitoring parameter value becomes equal to or smaller than a first set value, and scanning the nozzle at a part of the water jet peening execution object in which the monitoring parameter value is at least equal to or smaller than the first set value by controlling the nozzle scanning apparatus when either of the pressure and the flow rate is increased.

34. The water jet peening apparatus according to claim 30, further comprising:

a control apparatus for increasing either of a pressure and a flow rate of the water discharged from the pump and supplied to the nozzle by controlling the pump when the monitoring parameter value becomes equal to or smaller than a second set value larger than a first set value and the monitoring parameter value is equal to or larger than the first set value, and scanning the nozzle by controlling the nozzle scanning apparatus when either of the pressure and the flow rate is increased.

35. A water jet peening apparatus, comprising:

a nozzle for injecting water;

a pump for supplying water to the nozzle;

a nozzle scanning apparatus with the nozzle mounted for scanning the nozzle;

a plurality of shock wave detection apparatuses attached to the nozzle scanning apparatus; and a signal processing apparatus for obtaining an generation position of the shock wave based on a difference in detection time of a shock wave between a certain the shock wave detection apparatus and another the shock wave detection apparatus, obtaining respective energy of the plurality of shock waves based on detection signals of the shock waves detected by the plurality of shock wave detection apparatuses, and obtaining energy received from the plurality of shock waves by a water jet peening execution object based on the energy of the plurality of shock waves and the generation positions of the plurality of shock waves.

* * * * *